US008845387B2

(12) United States Patent
Grafton et al.

(10) Patent No.: US 8,845,387 B2
(45) Date of Patent: Sep. 30, 2014

(54) EXPANDABLE PLAY SET

(75) Inventors: Charles E. Grafton, El Segundo, CA (US); Glenn Yu, San Marino, CA (US)

(73) Assignee: Mattel, Inc., El Segundo, CA (US)

( * ) Notice: Subject to any disclaimer, the term of this patent is extended or adjusted under 35 U.S.C. 154(b) by 195 days.

(21) Appl. No.: 13/458,162

(22) Filed: Apr. 27, 2012

(65) Prior Publication Data

US 2012/0276810 A1 Nov. 1, 2012

Related U.S. Application Data

(60) Provisional application No. 61/480,783, filed on Apr. 29, 2011, provisional application No. 61/528,626, filed on Aug. 29, 2011.

(51) Int. Cl.
*A63H 3/52* (2006.01)
*A63H 18/02* (2006.01)

(52) U.S. Cl.
CPC . *A63H 18/02* (2013.01); *A63H 3/52* (2013.01)
USPC ..... 446/478; 446/444

(58) Field of Classification Search
CPC ..... A61H 18/00; A61H 3/52; A61H 33/42
USPC ..... 446/478
See application file for complete search history.

(56) References Cited

U.S. PATENT DOCUMENTS 3,735,923 A 5/1973 Brigham et al.
4,505,686 A * 3/1985 Mariol ..... 446/95
4,513,648 A * 4/1985 Mioche ..... 83/871
4,536,162 A * 8/1985 Ace et al. ..... 446/102
D280,998 S * 10/1985 Effler et al. ..... D21/507
D280,999 S * 10/1985 Cavnar ..... D21/507
4,575,350 A * 3/1986 Hippely et al. ..... 446/368
4,582,500 A * 4/1986 Hanson et al. ..... 446/423
6,350,174 B1 * 2/2002 Halford et al. ..... 446/444
7,516,750 B2 * 4/2009 Zheng ..... 135/125
7,552,563 B2 * 6/2009 Becker ..... 52/79.5
7,618,301 B2 * 11/2009 Knight et al. ..... 446/75
7,654,276 B2 * 2/2010 Zheng ..... 135/117
7,927,176 B2 * 4/2011 Payne ..... 446/478
7,946,307 B2 * 5/2011 Zheng ..... 135/96
D669,940 S * 10/2012 Berkshire ..... D21/471
8,298,038 B2 * 10/2012 O'Connor et al. ..... 446/444
8,328,596 B2 * 12/2012 Payne ..... 446/478
D678,960 S * 3/2013 Tamura ..... D21/507
D683,411 S * 5/2013 Mimlitch et al. ..... D21/509

(Continued)

OTHER PUBLICATIONS

European Search Report dated Jan. 17, 2013.

*Primary Examiner* — Kurt Fernstrom
*Assistant Examiner* — Dolores Collins
(74) *Attorney, Agent, or Firm* — Cantor Colburn LLP

(57) ABSTRACT

A playset is provided herein the playset having: a structure having a first level and a second level, the second level being located above the first level; a mechanism secured to the structure for moving an object from the first level to the second level; and a collapsible third level located below the first level, the collapsible third level being configured for movement between a contracted position and an expanded position with respect to the first level, wherein a portion of the first level is configured to support the structure on an edge of an elevated surface such that collapsible third level is capable of being moved into the expanded position.

19 Claims, 68 Drawing Sheets

(56) References Cited

U.S. PATENT DOCUMENTS

| | | | | |
|---|---|---|---|---|
| 2003/0066553 | A1* | 4/2003 | Zheng | 135/126 |
| 2006/0040582 | A1* | 2/2006 | Hopper et al. | 446/75 |
| 2007/0072516 | A1* | 3/2007 | Liff et al. | 446/478 |
| 2008/0070474 | A1 | 3/2008 | Nuttall | |
| 2008/0081536 | A1 | 4/2008 | Payne et al. | |
| 2011/0269373 | A1* | 11/2011 | Zheng et al. | 446/478 |
| 2012/0045965 | A1* | 2/2012 | Zhou et al. | 446/478 |

* cited by examiner

EXPANDABLE PLAY SET

CROSS REFERENCE TO RELATED APPLICATIONS

This application claims the benefit of U.S. Provisional Patent Application Ser. No. 61/480,783, filed Apr. 29, 2011 and U.S. Provisional Patent Application Ser. No. 61/528,626, filed Aug. 29, 2011, the contents each of which are incorporated herein by reference thereto.

BACKGROUND

Exemplary embodiments of the present invention relate generally to an expandable playset and more particularly an expandable playset configured for use in a variety of configurations.

Playsets for children are typically of very simple design and construction, because the design necessitates such simplicity. Therefore, the level of play that a child can achieve with such playsets, while surely fun and educational, may be limited by the number of features that can be incorporated into such a play set.

Accordingly, it is desirable to provide a playset having a variety of features.

SUMMARY OF THE INVENTION

Exemplary embodiments of the present invention provide a playset the playset having: a structure having a first level and a second level, the second level being located above the first level; a mechanism secured to the structure for moving an object from the first level to the second level; and a collapsible third level located below the first level, the collapsible third level being configured for movement between a contracted position and an expanded position with respect to the first level, wherein a portion of the first level is configured to support the structure on an edge of an elevated surface such that collapsible third level is capable of being moved into the expanded position.

In another embodiment a playset is provided, the playset having: a structure having a first side resembling a façade and a second side opposite the first side wherein objects can be inserted behind the façade, the structure further comprising a first level and a second level, the second level being located above the first level; a mechanism secured to the structure for moving an object from the first level to the second level; and a collapsible third level located below the first level, the collapsible third level being configured for movement between a contracted position and an expanded position with respect to the first level, wherein the first level is configured to support the structure on an edge of an elevated surface such that collapsible third level is capable of being moved into the expanded position.

In still another embodiment, a playset is provided, the playset having: a structure having at least a first level and a second level, the second level being located above the first level and the first level being realeasbly secured to the first level and capable of movement downward and away from the first level to an expanded position; a mechanism for securing the structure to an edge of an elevated surface; and a trigger for releasing the first level from the second level wherein actuation of the trigger causes the first level to move downward and away from the second level towards the expanded position.

BRIEF DESCRIPTION OF THE DRAWINGS

Other advantages of exemplary embodiments of the present invention will be readily appreciated as the same becomes better understood by reference to the following detailed description when considered in connection with the accompanying drawings wherein.

DETAILED DESCRIPTION OF EXEMPLARY EMBODIMENTS

Figure 1:
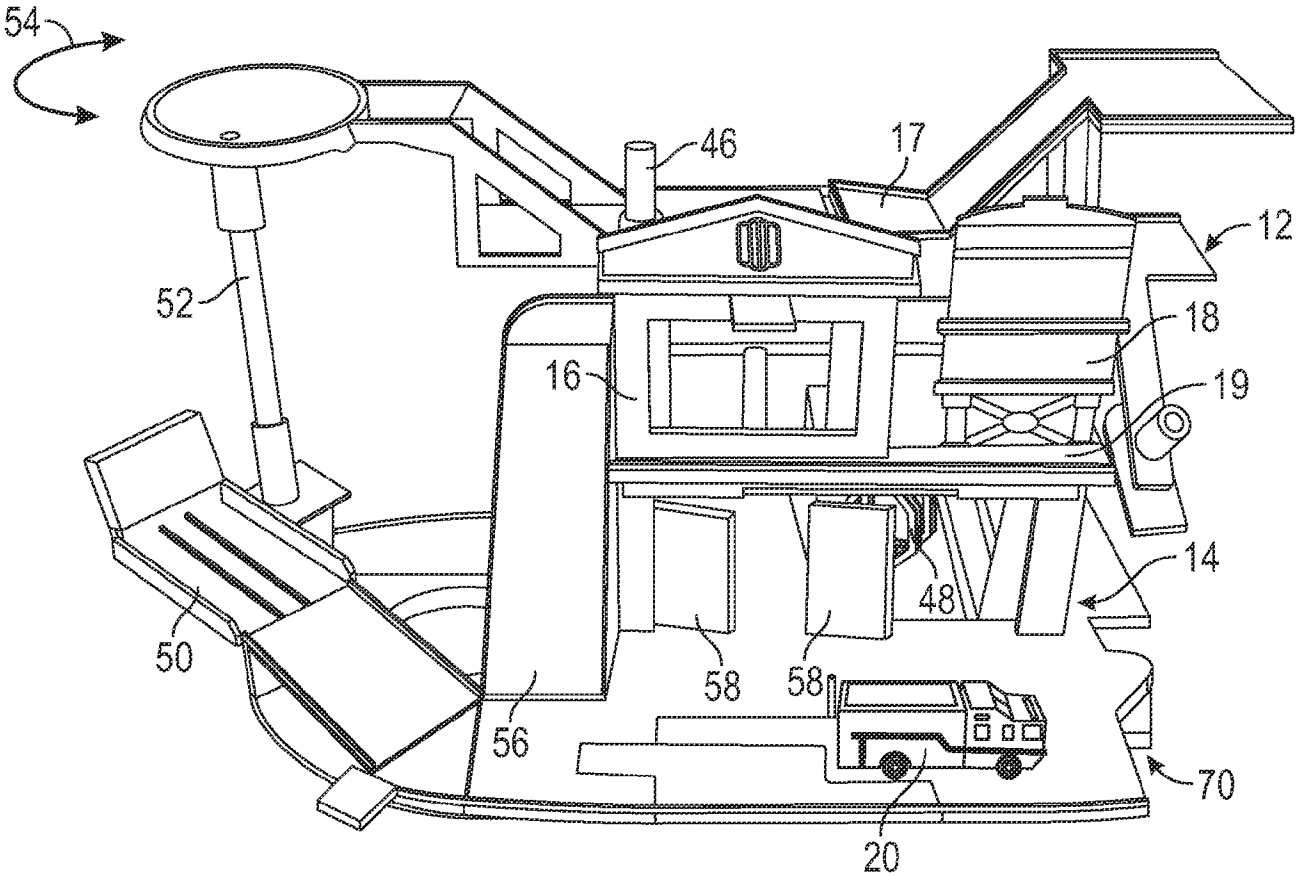
FIG. 1 is a forward perspective view of the playset in a first configuration.
Figure 2:
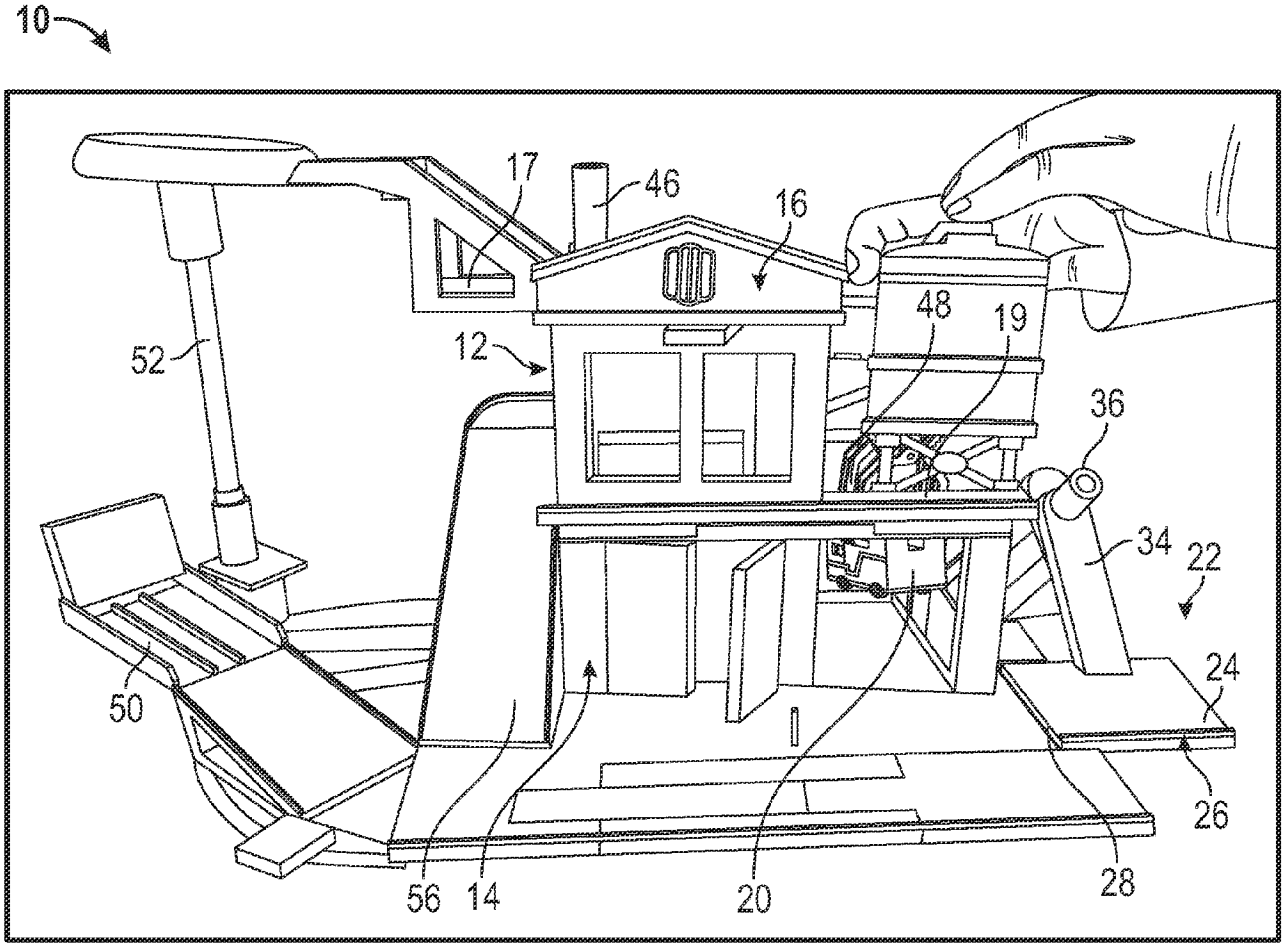
FIGS. 2-5 illustrate movement of mechanisms of the playset.
Figure 3:
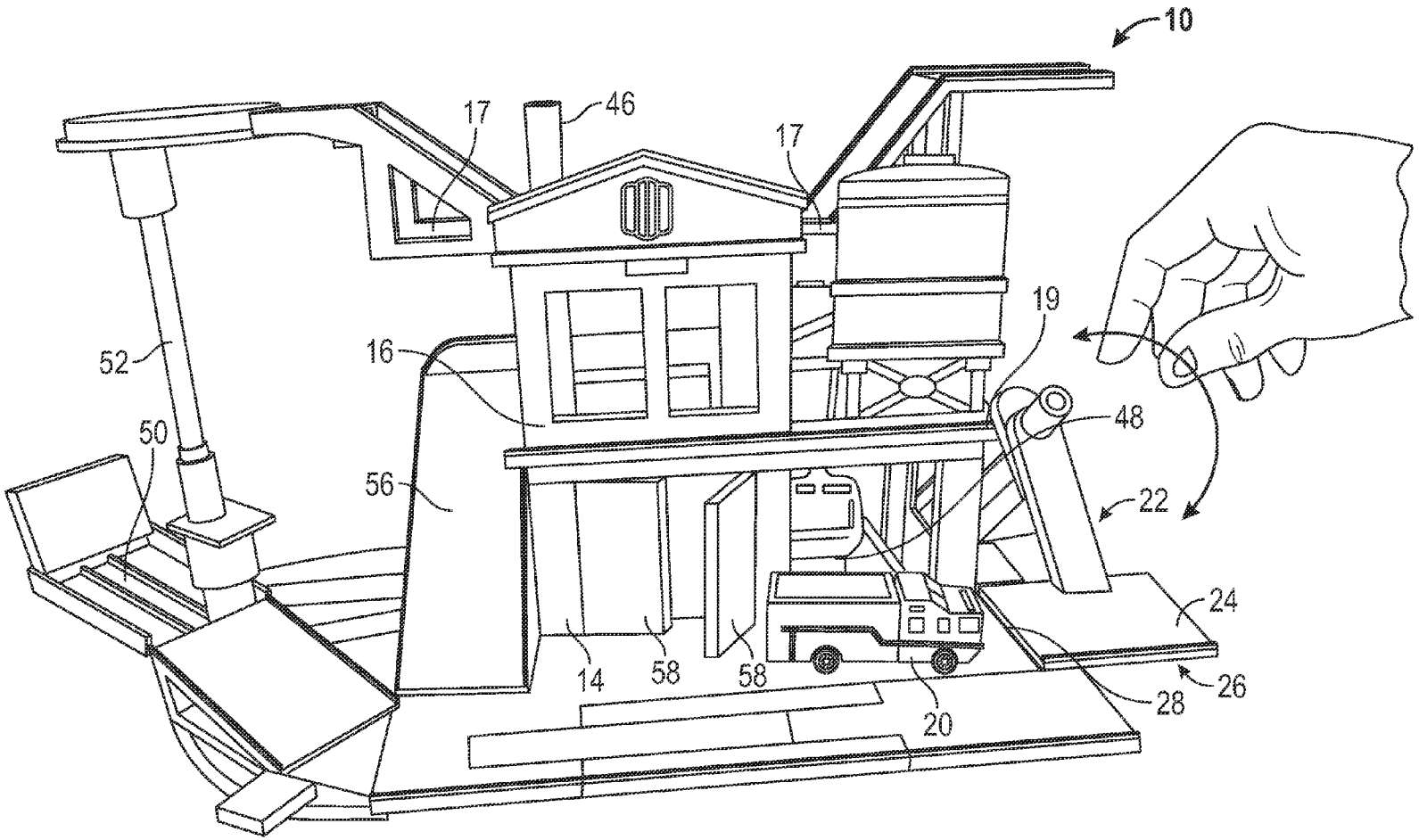
Figure 4:
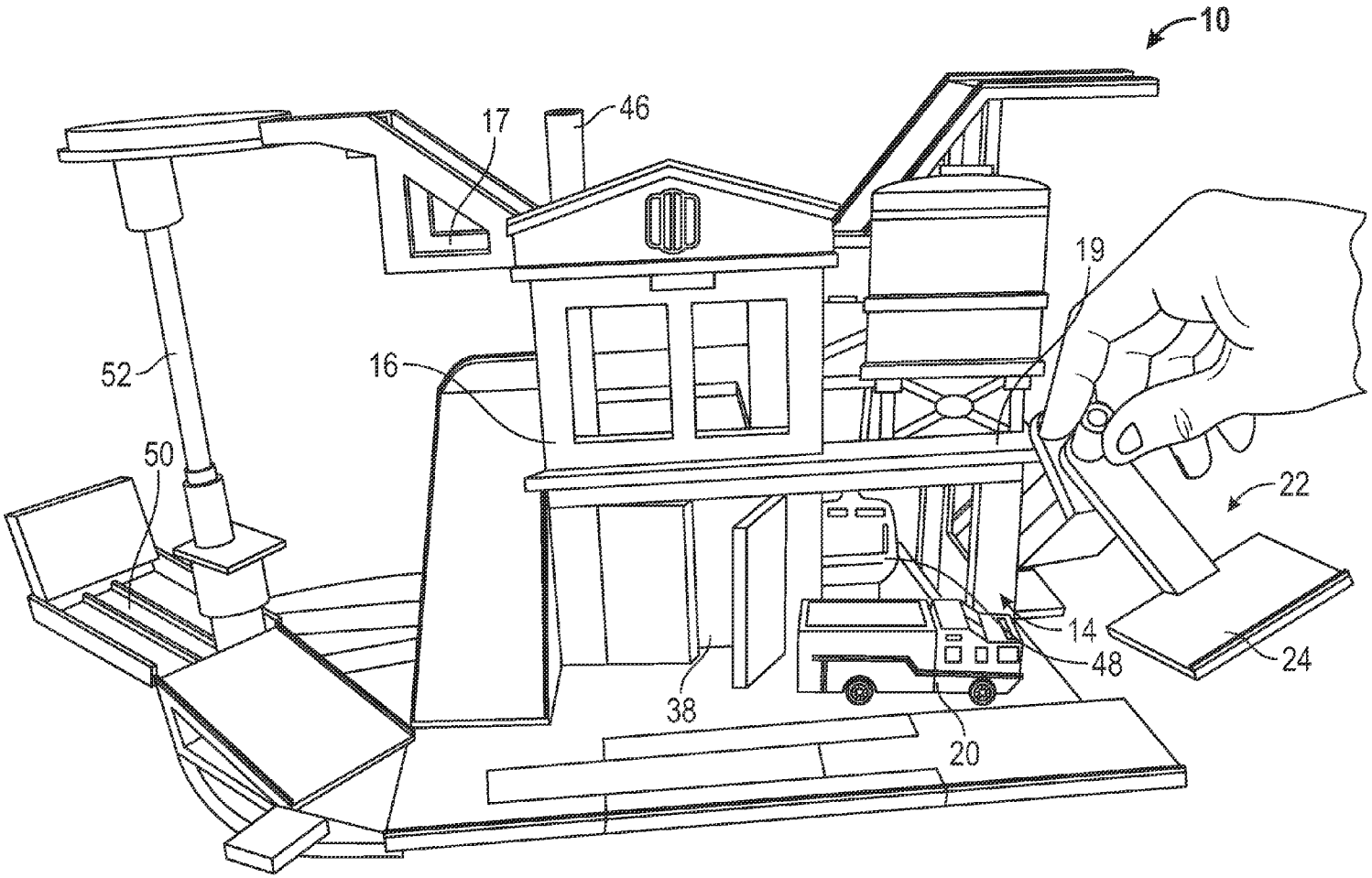
Figure 5:
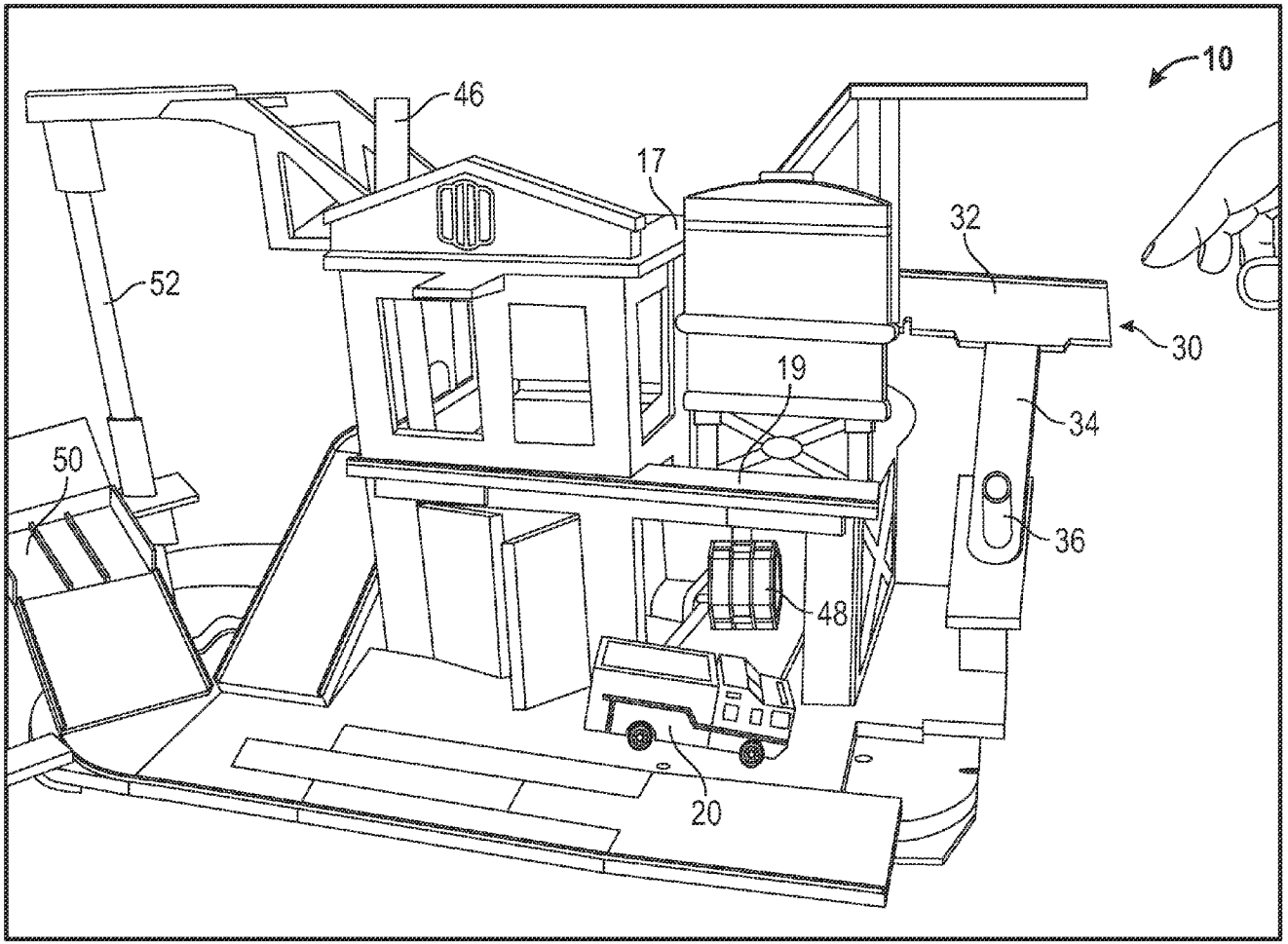
Figure 6:
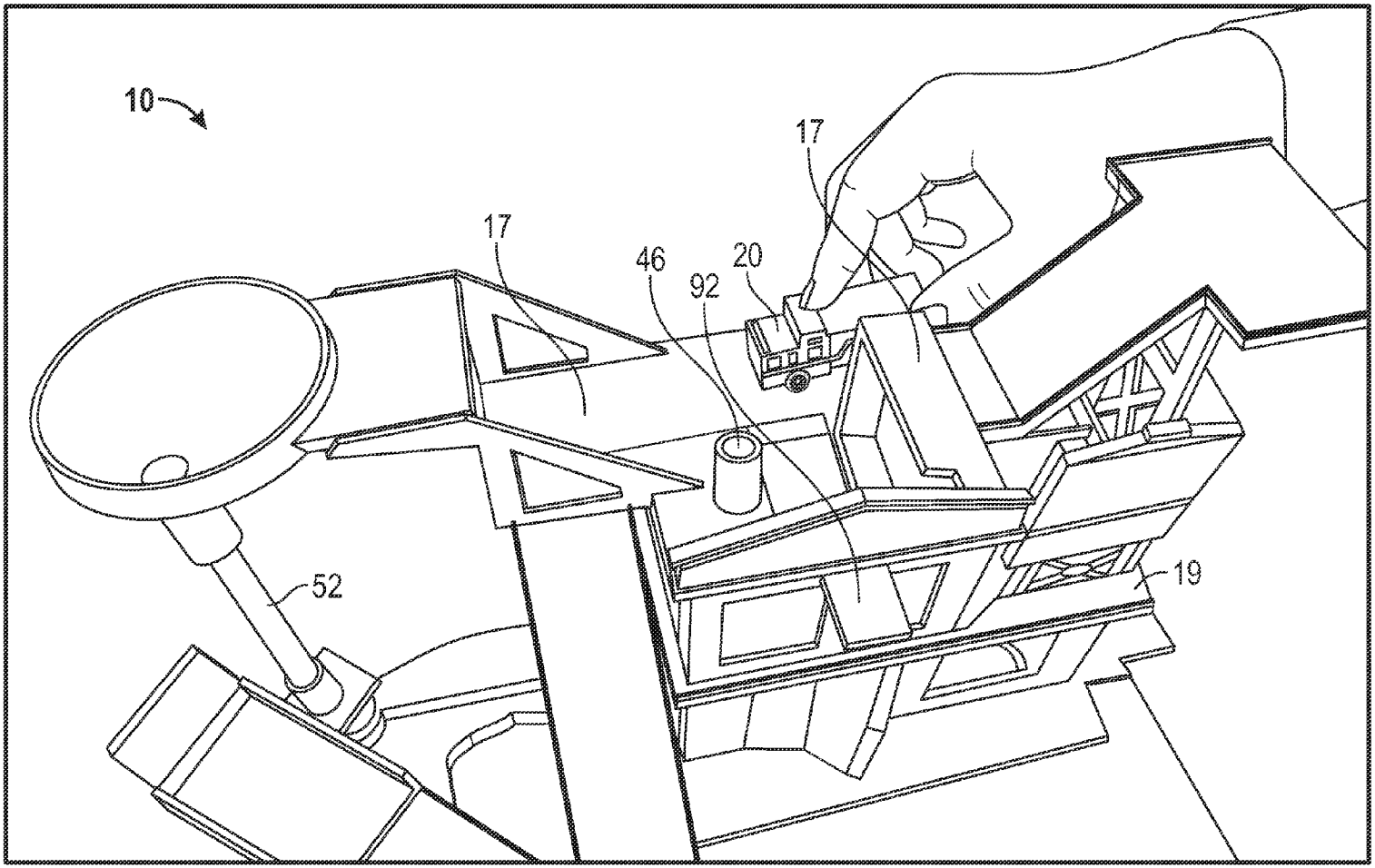
FIG. 6 is a top perspective view of the playset in the first configuration.
Figure 7A:
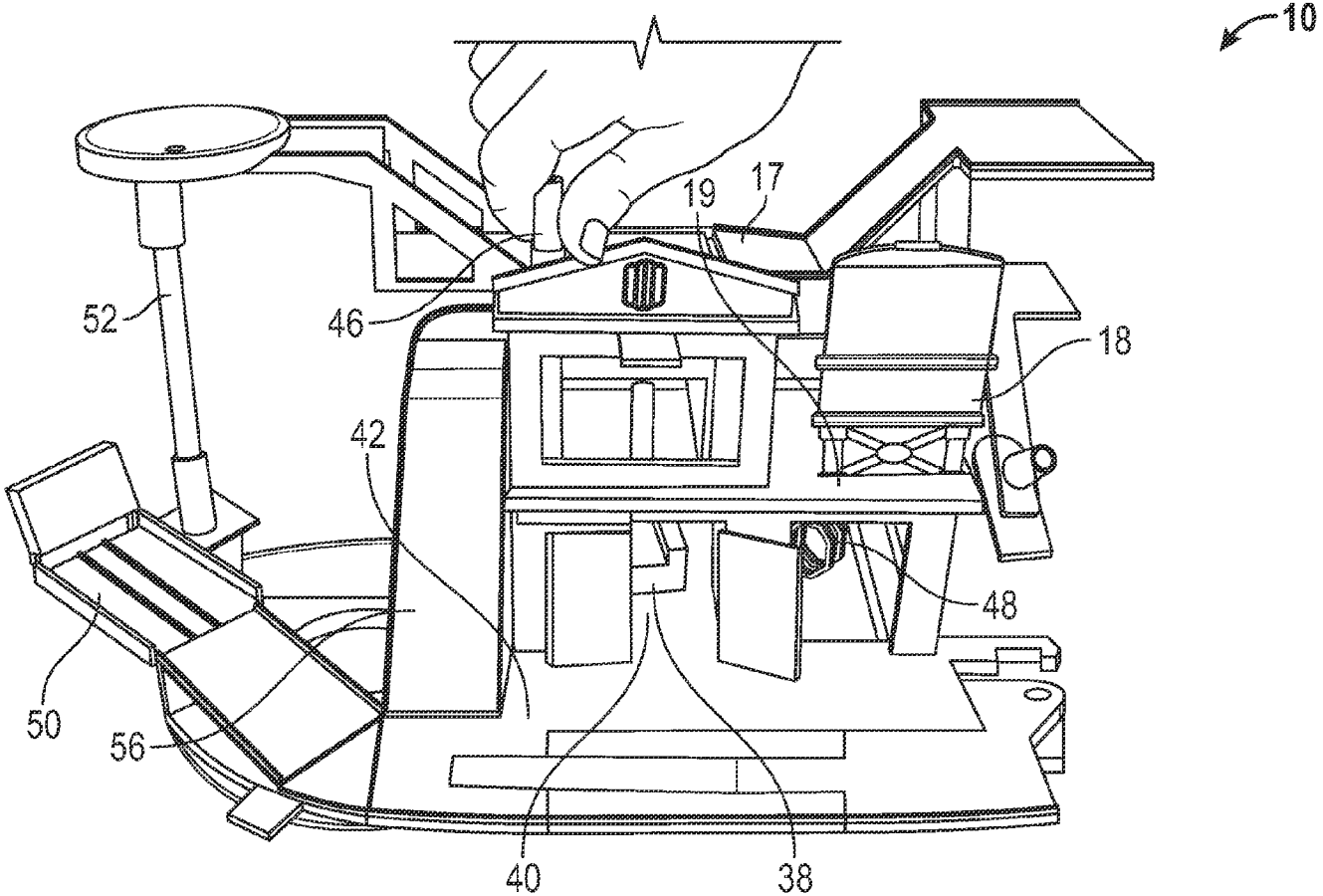
FIGS. 7A-7C illustrate movement of another mechanism of the playset.
Figure 7B:
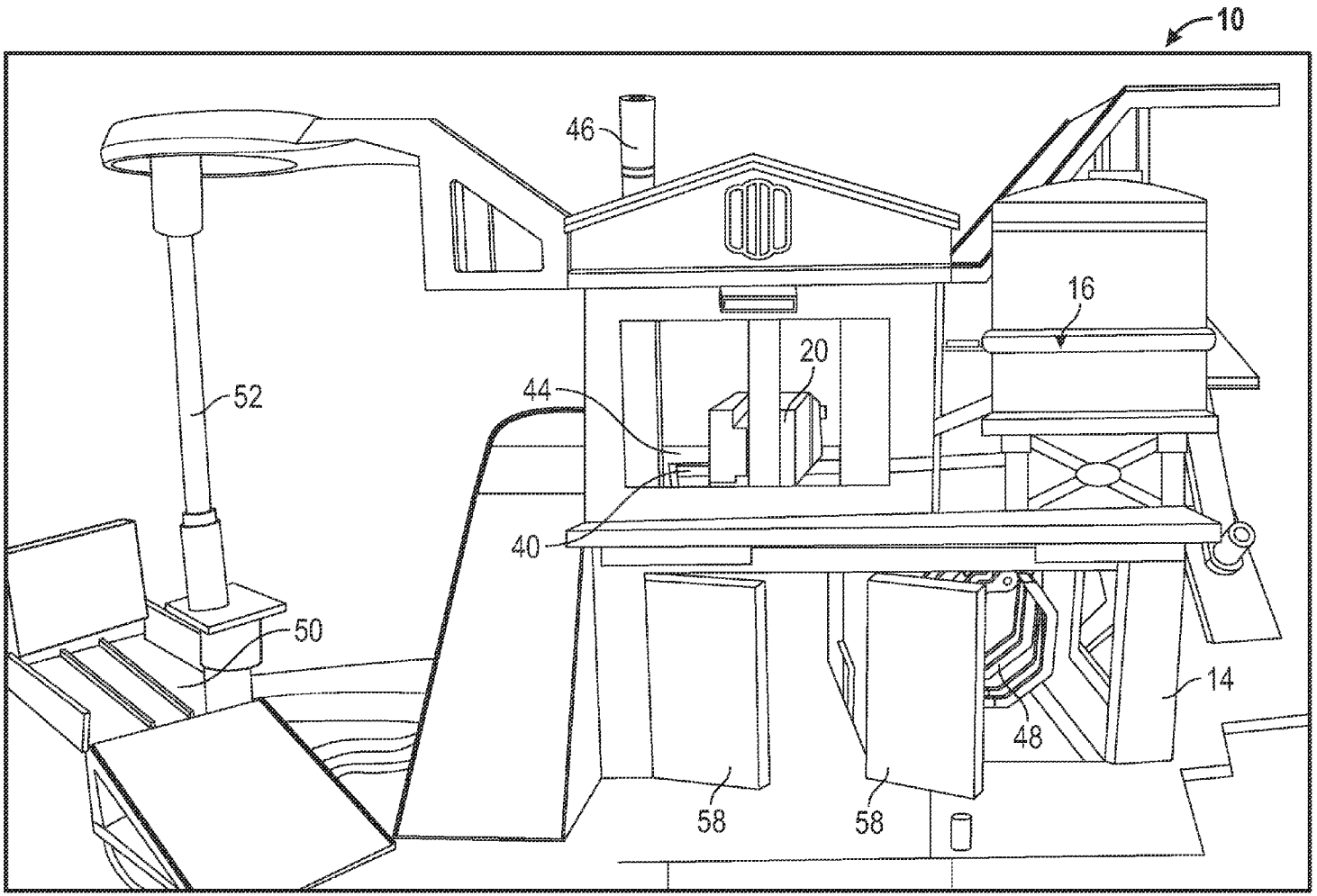
Figure 7C:
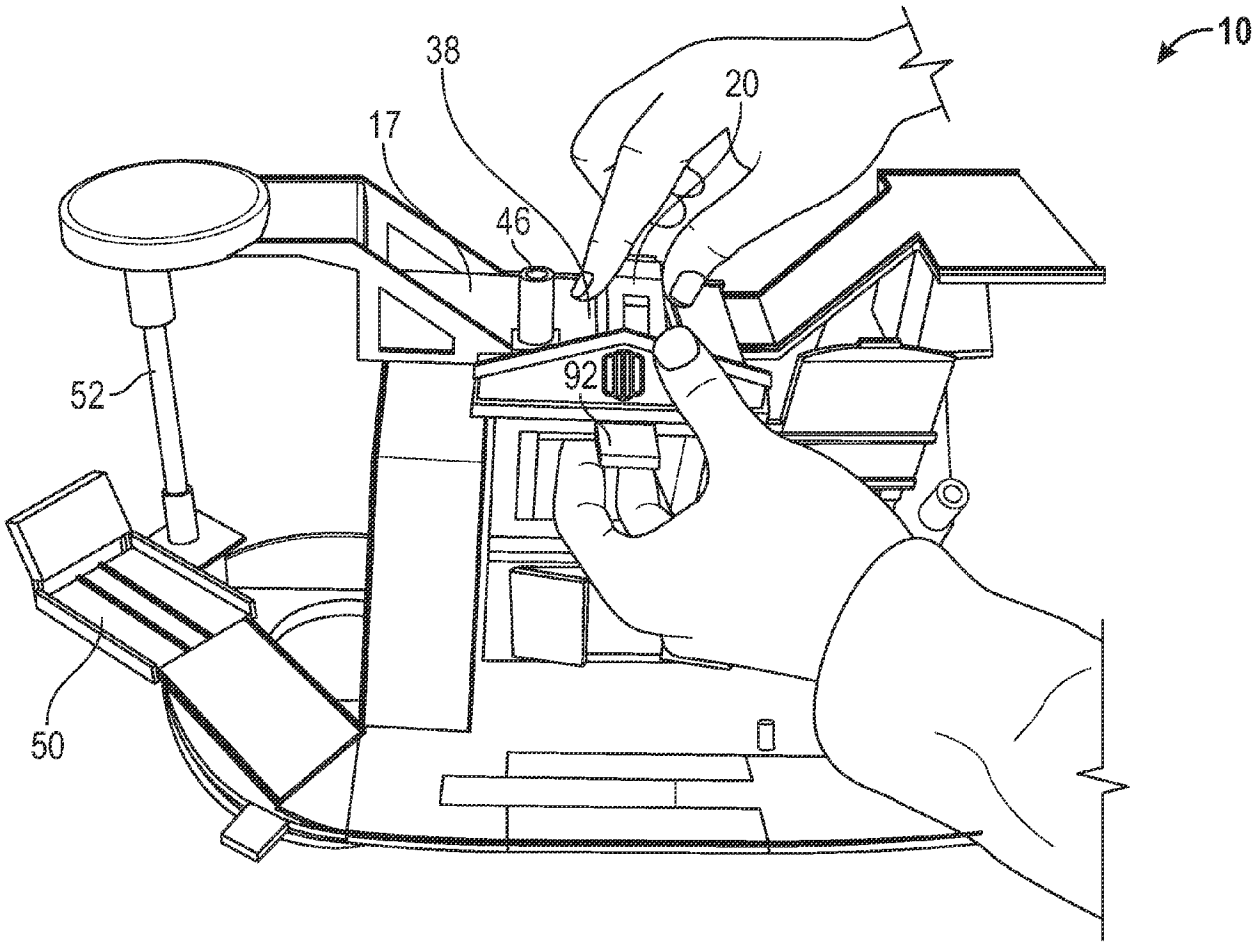
Figure 8:
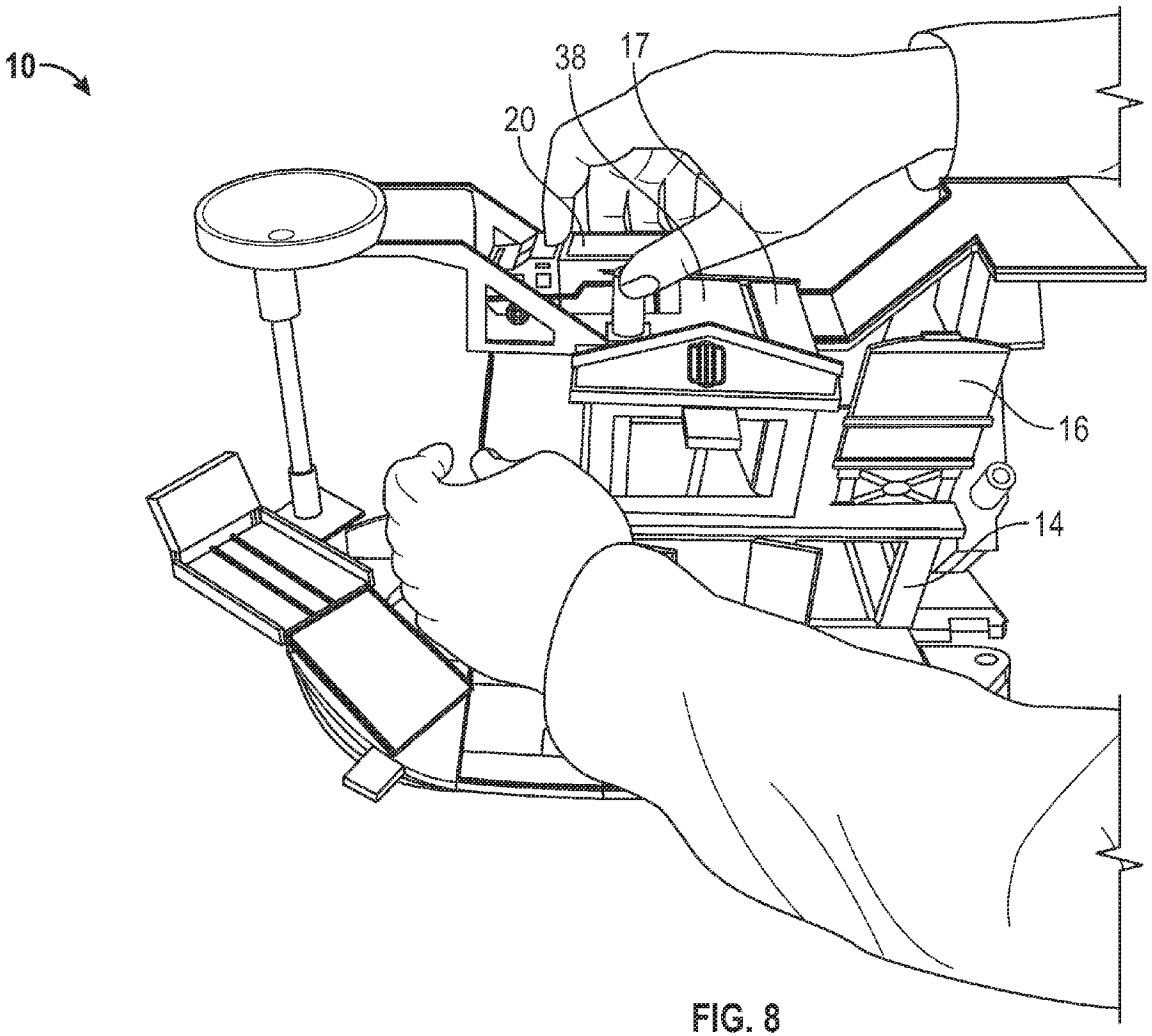
FIG. 8 is a top perspective view of the playset in the first configuration.
Figure 9:
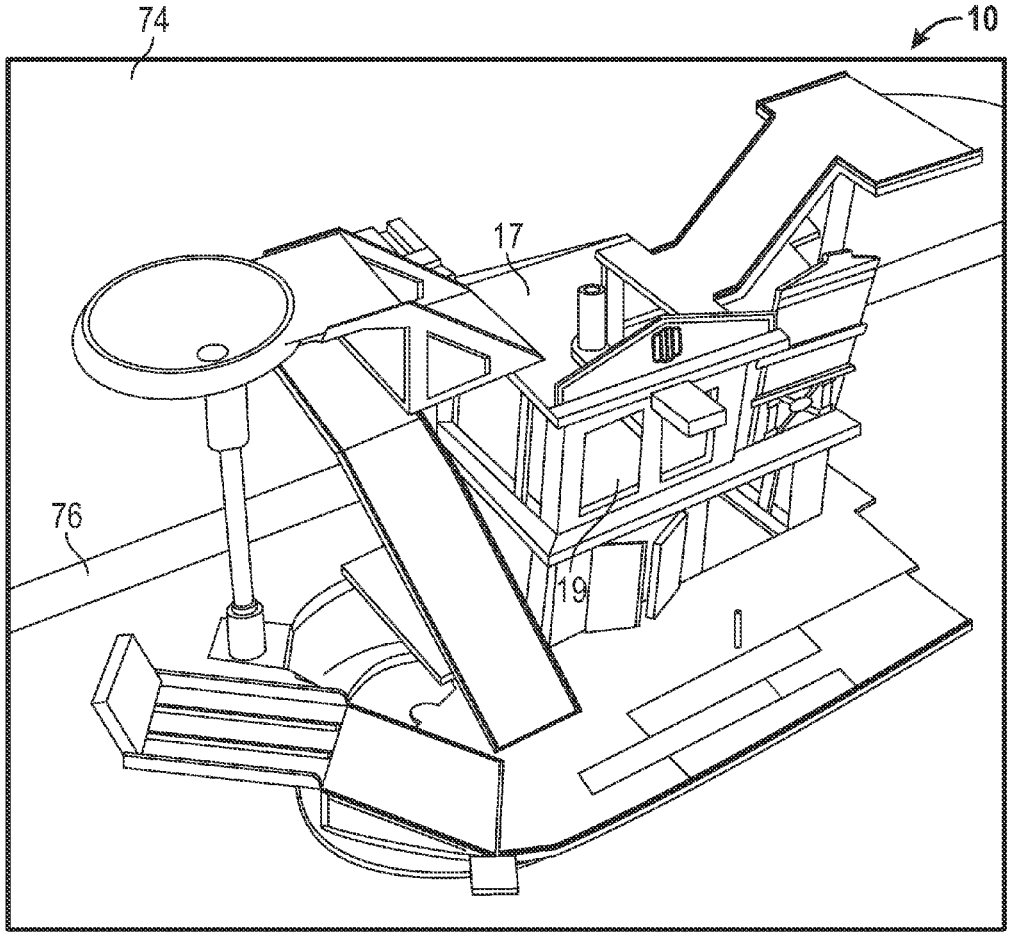
FIG. 9 is a front perspective view of the playset secured to a surface.
Figure 10:
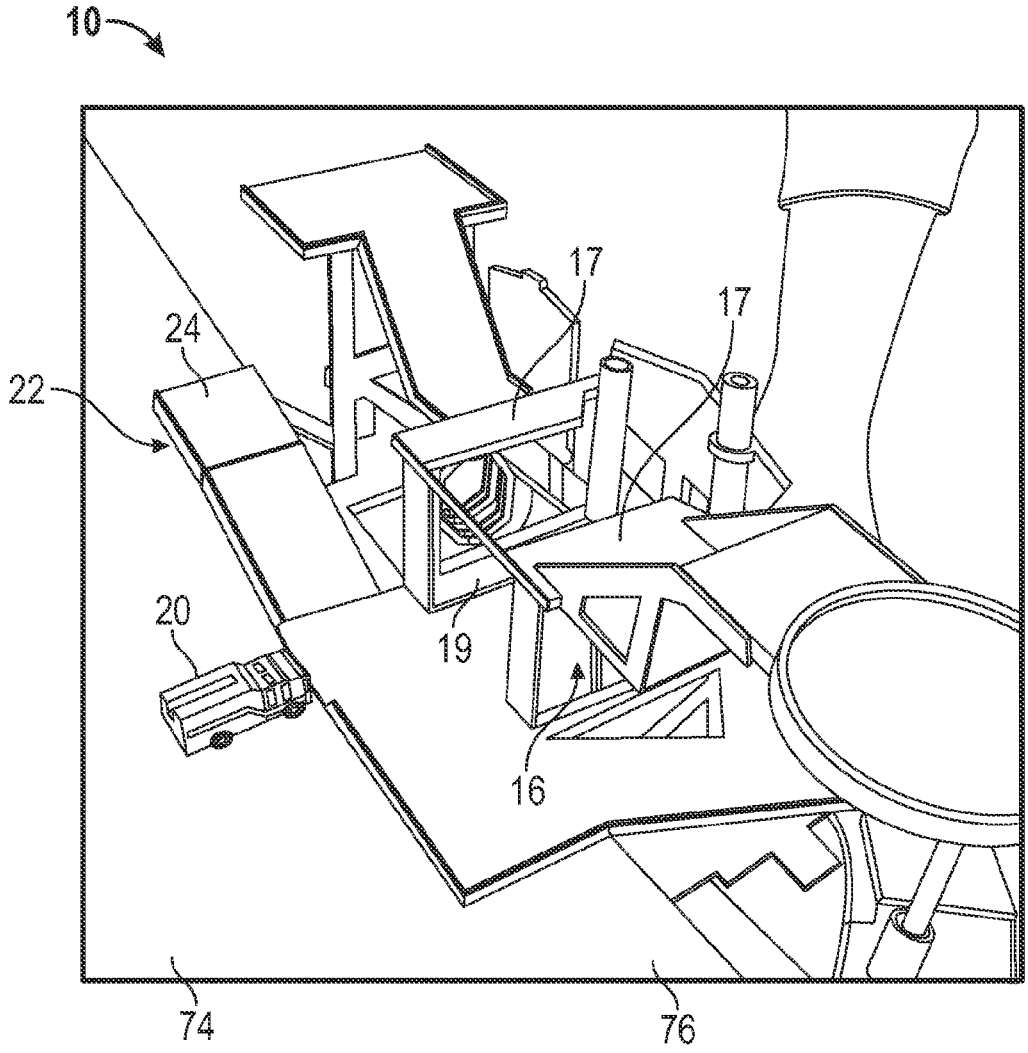
FIG. 10 is a rearward perspective view of the playset secured to a surface.
Figure 11:
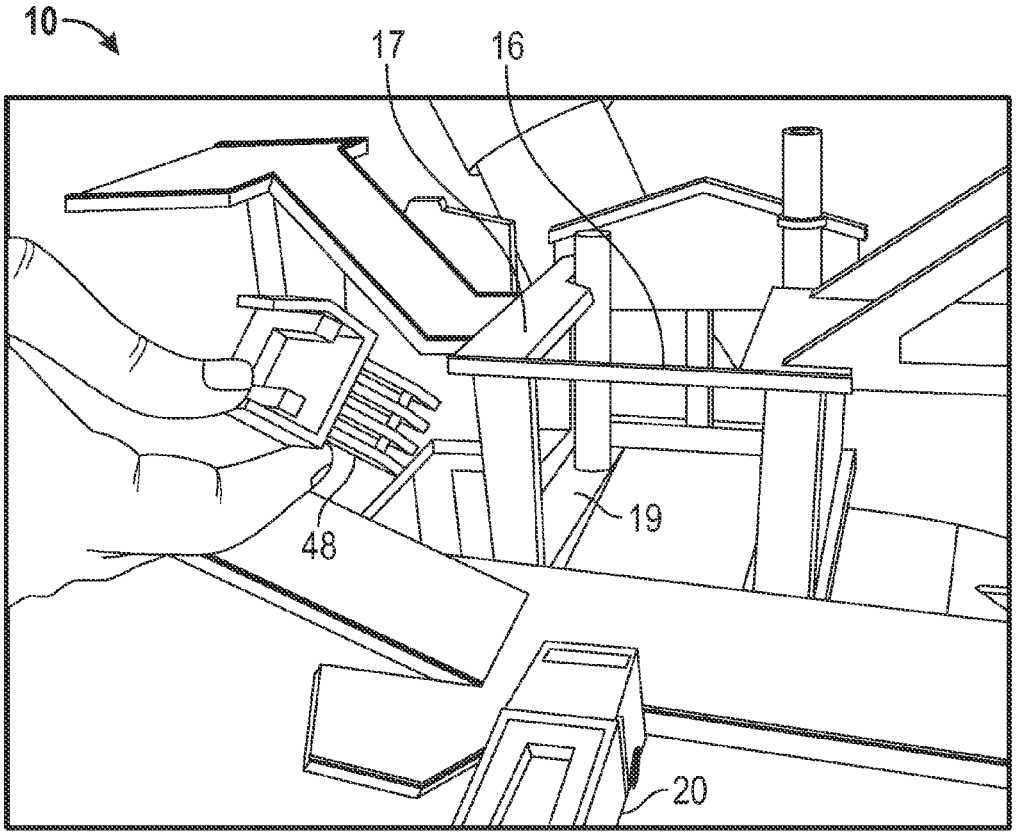
FIG. 11 illustrates a mechanism of the playset.
Figure 12A:
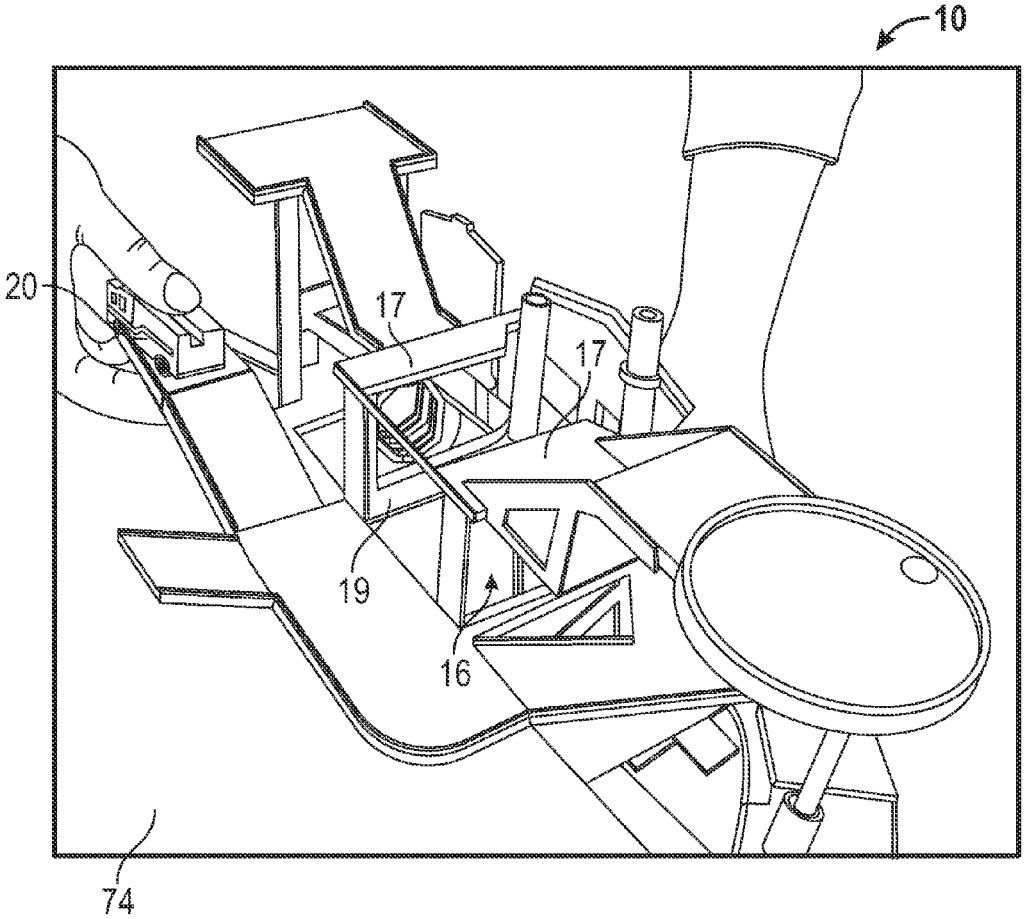
FIGS. 12A-12C illustrate movement of a mechanism of the playset in an expanded configuration.
Figure 12B:
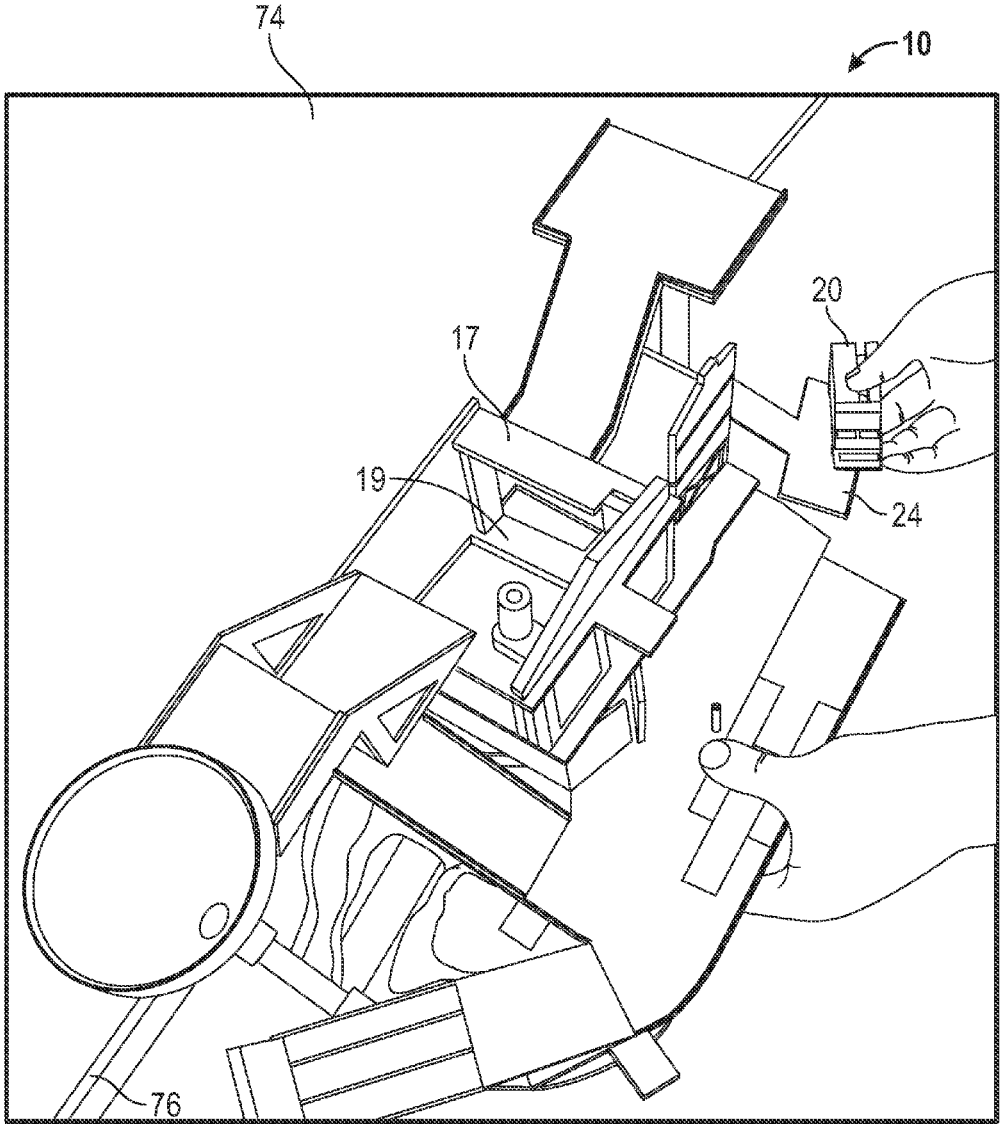
Figure 12C:
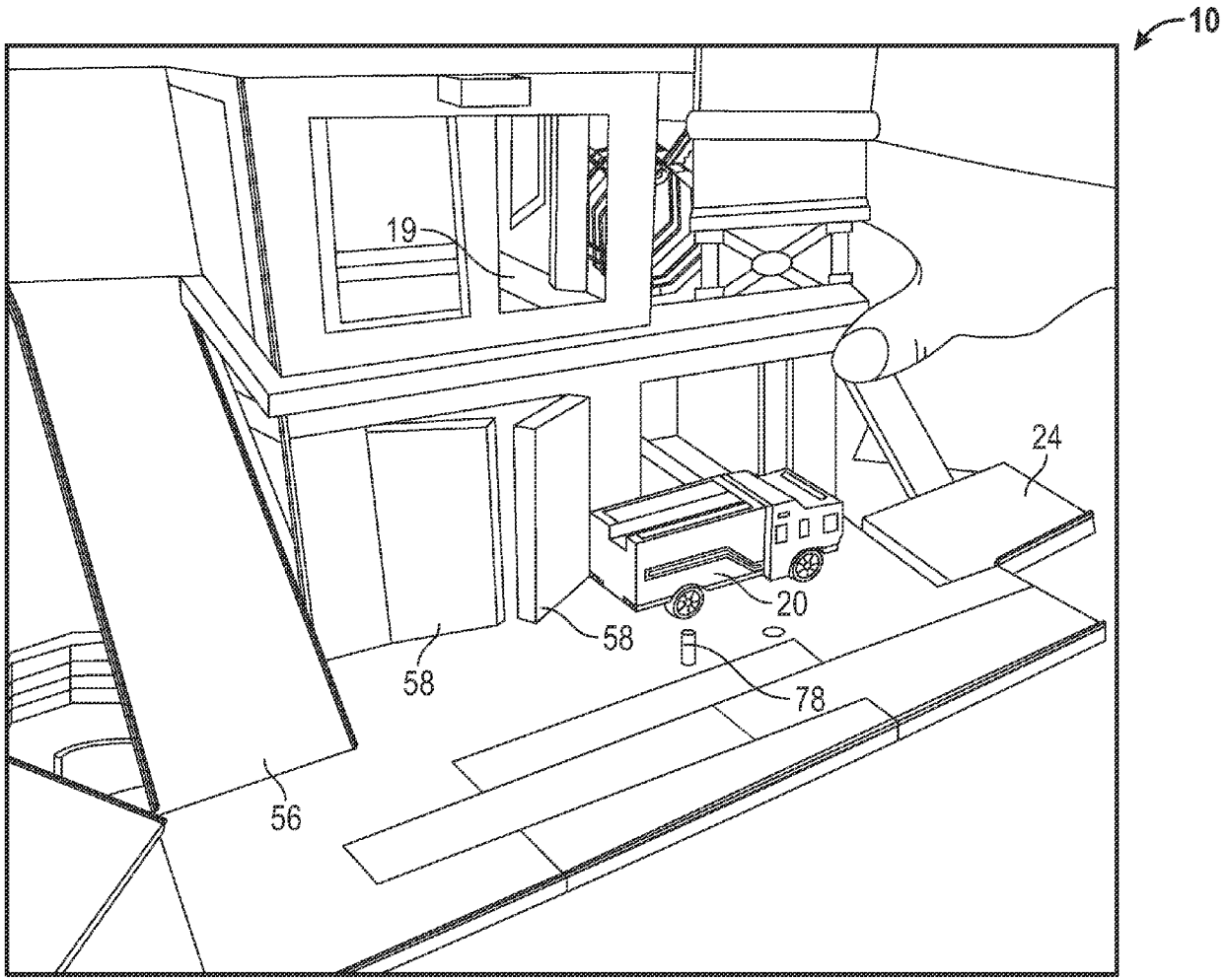
Figure 13:
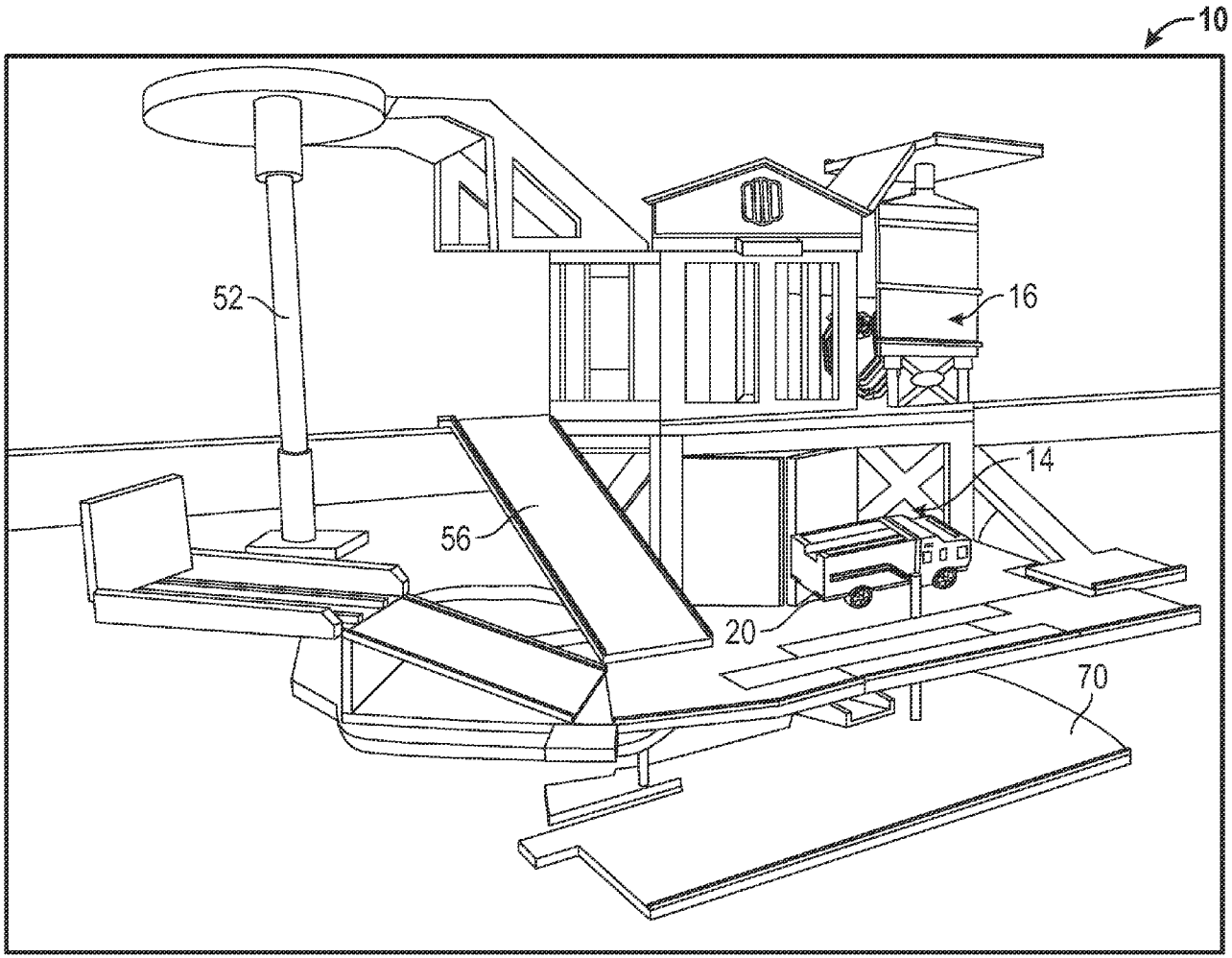
FIGS. 13-19C illustrate various configurations and components of the playset when it is in the expanded configuration.
Figure 14:
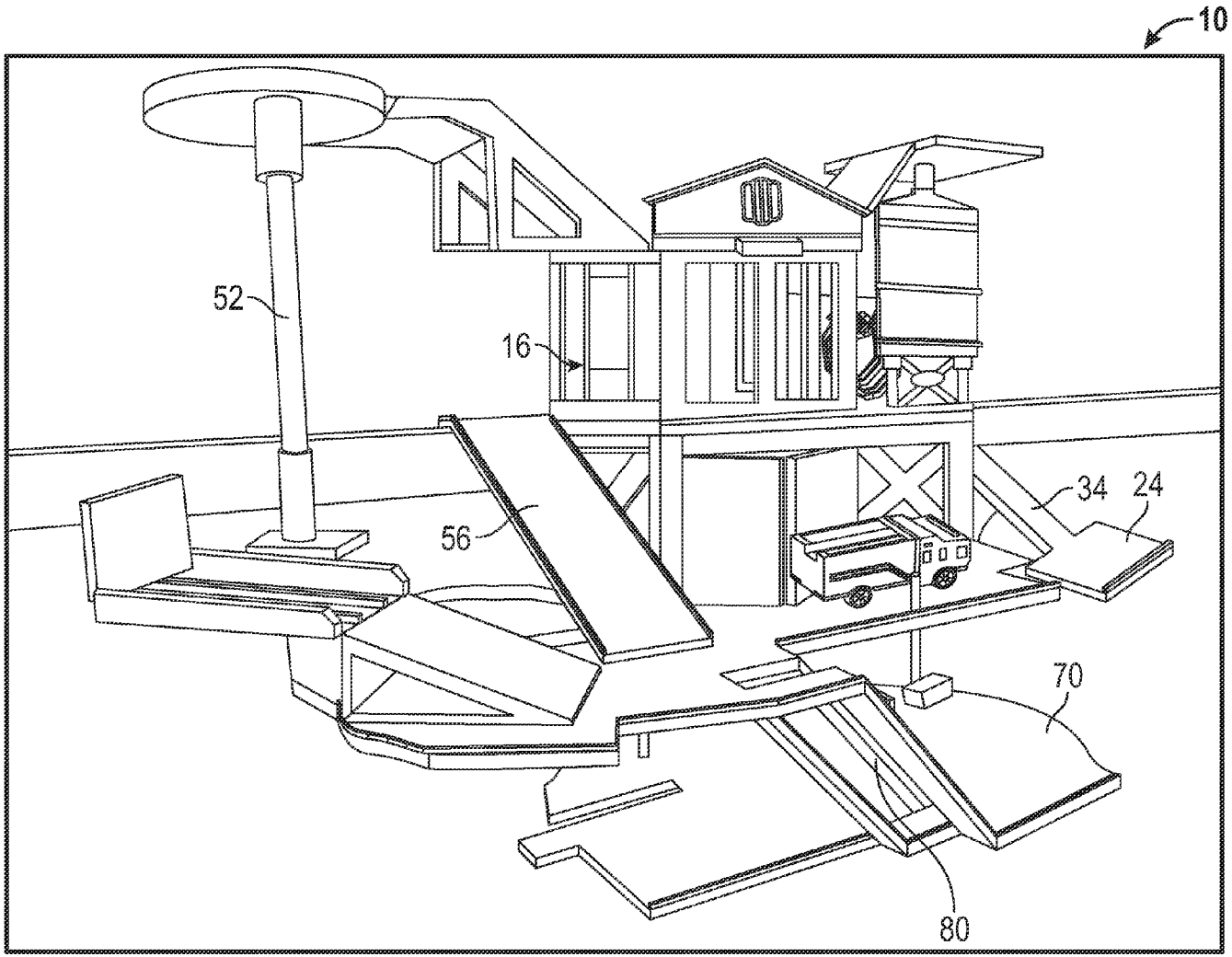
Figure 15:
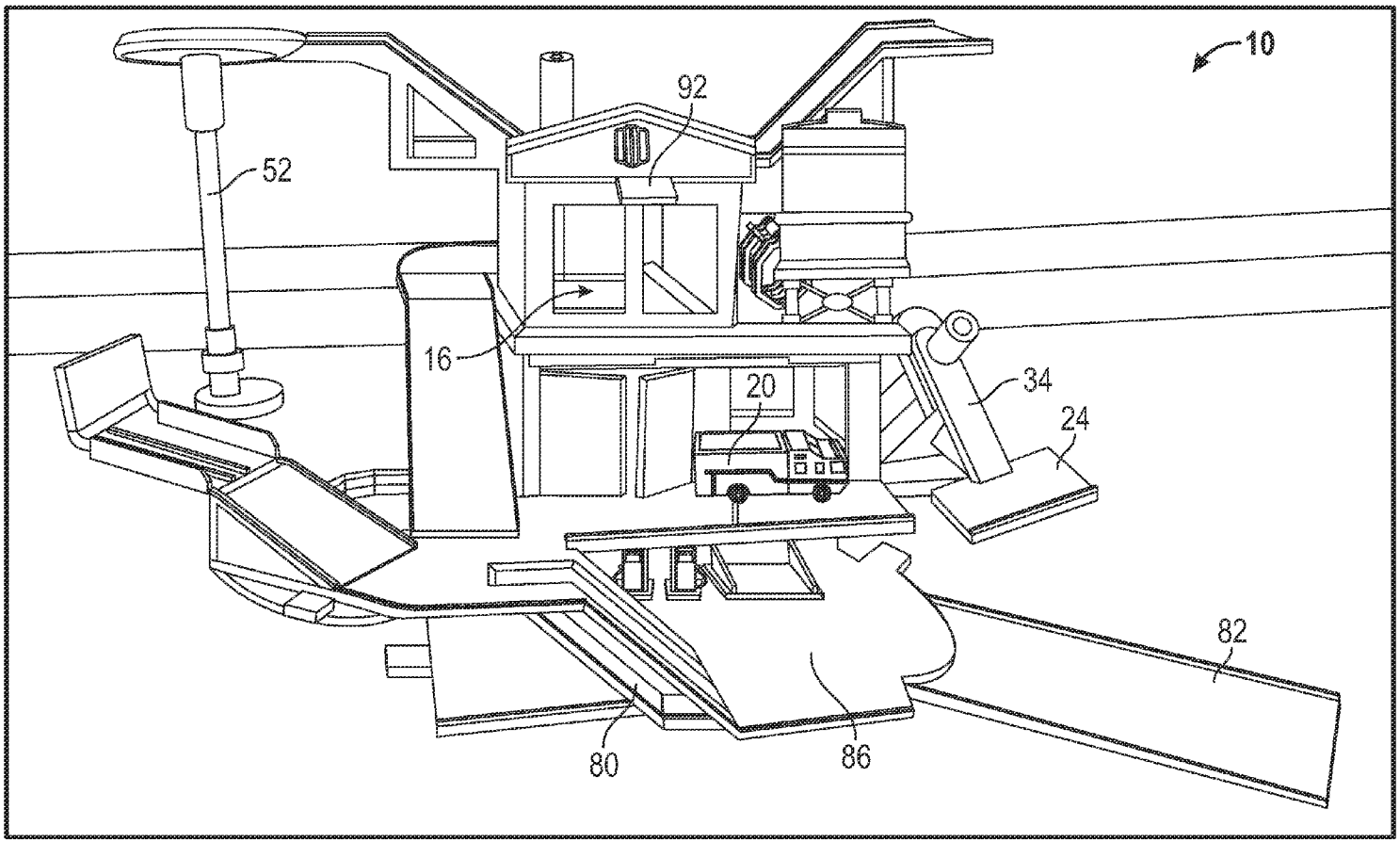
Figure 16:
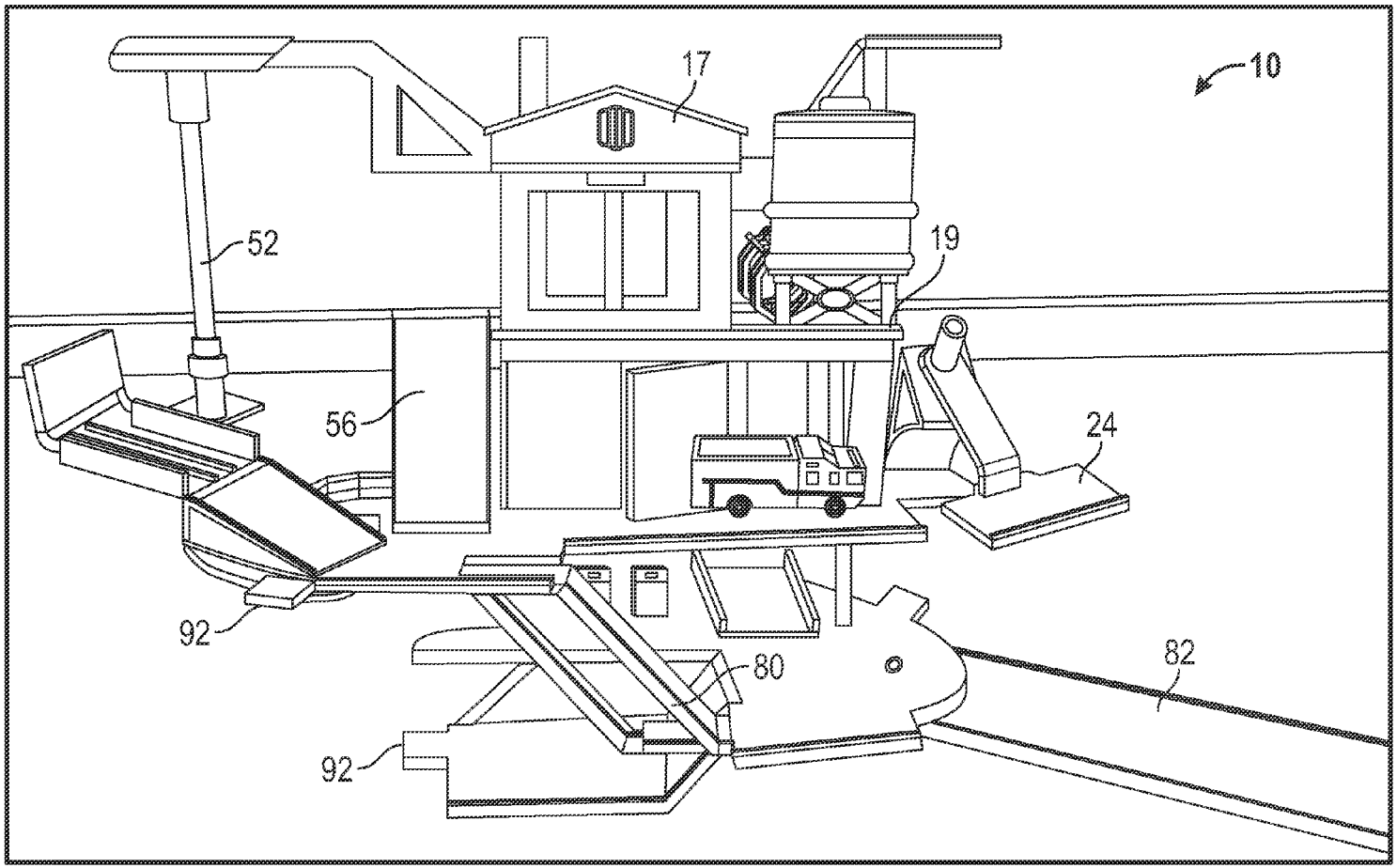
Figure 17:
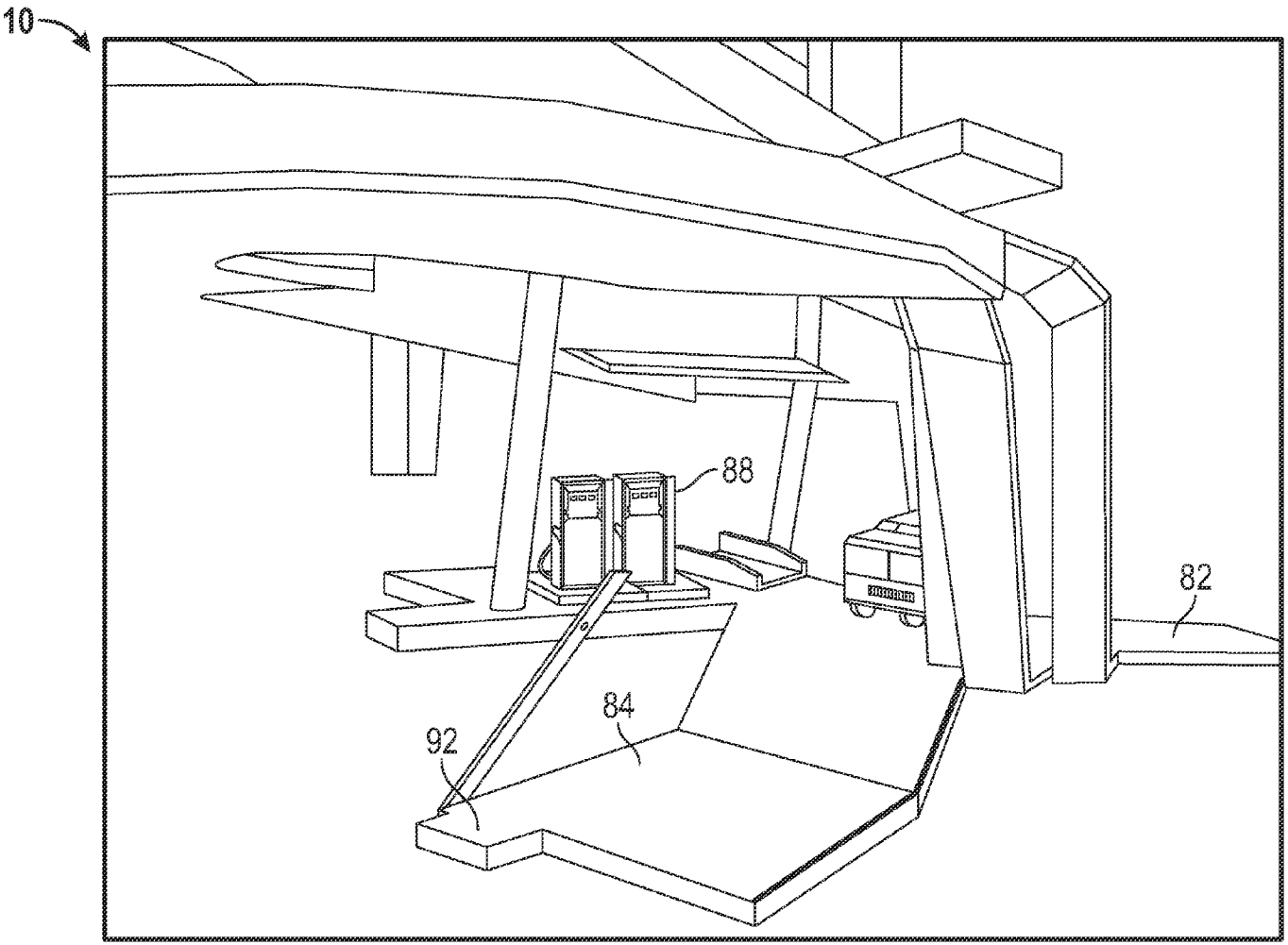
Figure 17A:
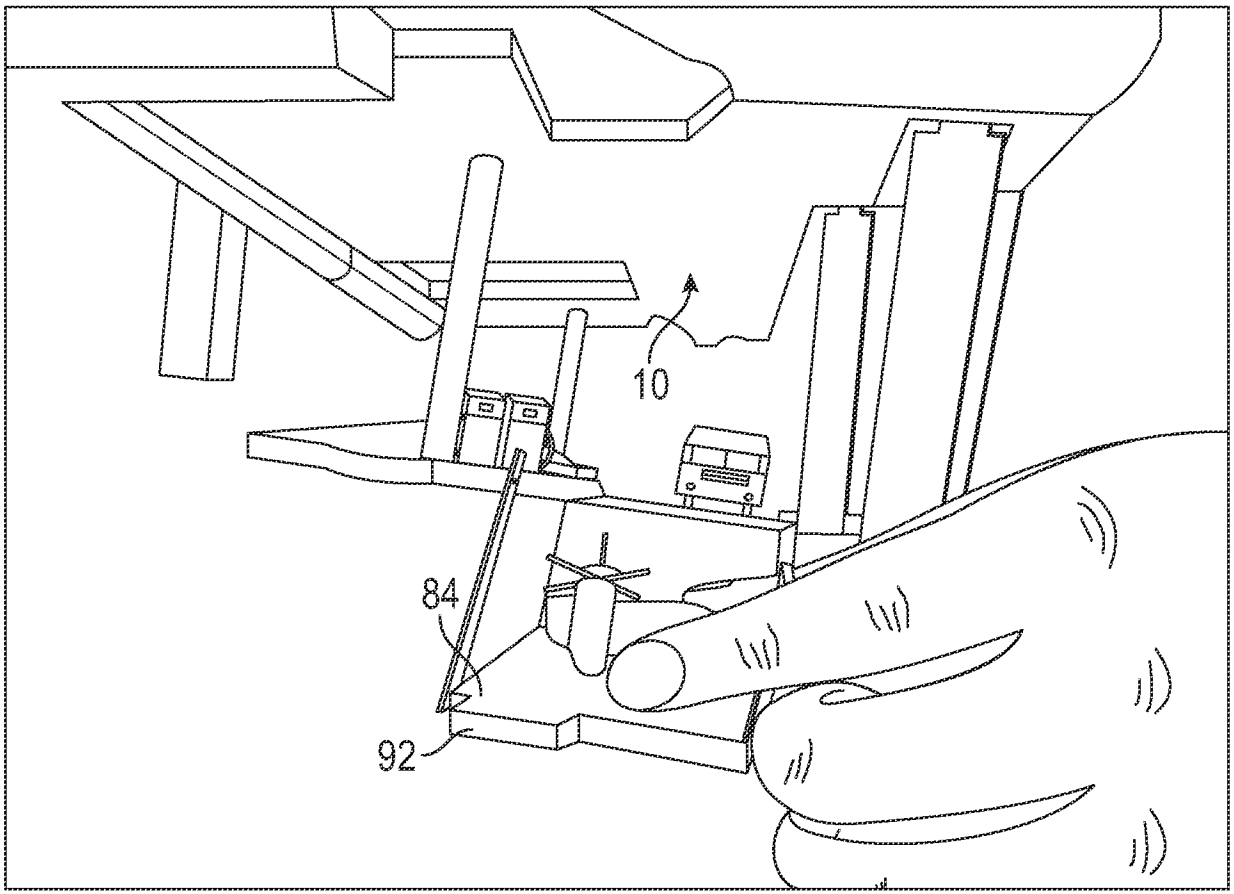
Figure 17B:
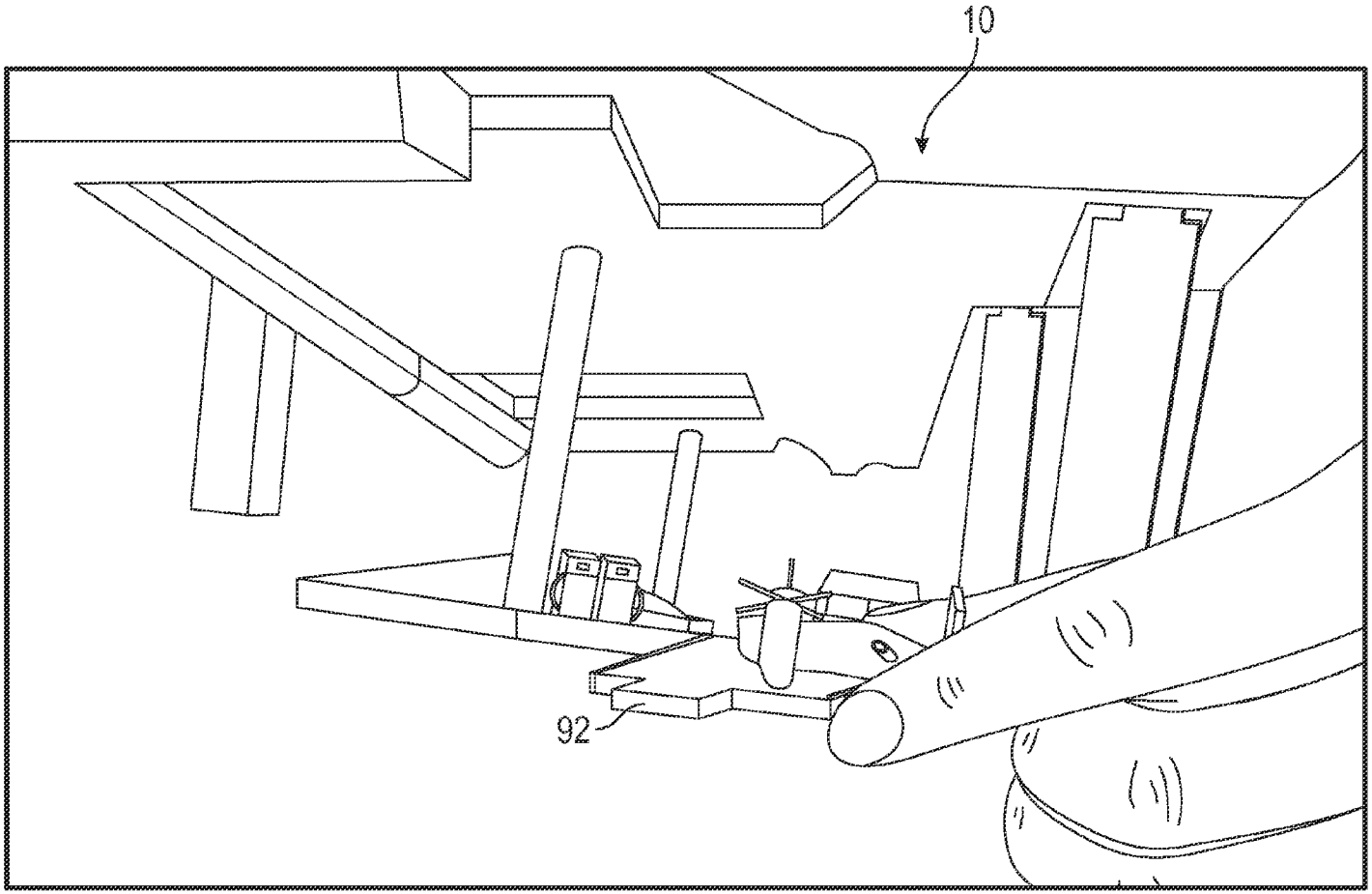

In accordance with an exemplary embodiment of the present invention a playset 10 is provided. In one embodiment the playset 10 is configured for use on a surface and in another embodiment the playset 10 is configured for use on an edge of a surface.

Referring now to FIGS. 1-8, non-limiting embodiments of surface play of playset 10 are illustrated. The playset 10 resembles a structure 12 having a plurality of levels 14 and 16 for example, in one non-limiting embodiment structure is a firehouse. Of course, numerous other configurations are contemplated to be within the scope of various embodiments of the present invention. As illustrated, the structure 12 has a first side 18 resembling a façade of a building and a second side opposite the first side wherein objects 20 can be inserted behind the façade. The structure further has a first level 14 and a second level 16, wherein the second level 16 is located above the first level 14. In addition and as referred to herein a roof surface 17 of the second level provides another floor located above the floor 19 of the second level.

In order to enhance play several mechanisms 22 for moving the object 20 from the first level 14 to the second level 16 and vice versa are provided. In one embodiment, the mechanism 22 is a platform 24 pivotally secured to the structure 12 for movement between a first position 26 wherein an edge 28 of the platform 24 is adjacent to a floor of the first level 14 and a second position 30 wherein another edge 32 of the platform is adjacent to the floor 19 of the second level 16. (See at least FIGS. 2-5). In one embodiment and in order to translate platform 24 from the first position 26 to the second position 30 and vice versa platform 24 is secured to an arm member 34 that is pivotally or rotationally secured to the structure 12 and is capable of being rotated via a knob member 36.

In another embodiment another mechanism 22 is provided. Here, the mechanism 22, is an elevator 38 movably secured to the structure 12 for movement between a first position wherein a floor 40 of the elevator is flush with a floor 42 of the first level and a second position wherein the floor 40 of the elevator is flush with a floor 44 of the second level. In this embodiment, the elevator 38 is moved from the first position to the second position by rotating a knob member 46.

In still another embodiment, the mechanism 22 is a retractable claw member 48 configured to be mounted on the structure in a plurality of locations. In one implementation, the retractable claw member 48 is secured to a cable or line 51 that allows the claw member 48 to the retracted upwardly and lowered. Still further and in yet another embodiment, the mechanism 22 is a platform 50 rotationally mounted to a pole member 52 secured to the structure, wherein the platform 50 is configured for movement between a first position wherein an edge of the platform is adjacent to the floor of the first level 14 and a second position wherein another edge of the platform is adjacent to the roof surface 17 of the second level 16. In this embodiment, the mechanism 22 is a spin-down gravity elevator rotatably received on the pole member 52 illustrated on the side of the structure 12. When the platform 50 is in the first position it is at the top of the pole member and is configured such that when it is released it spins down to the second position at the floor of the first level 14. As illustrated and when the platform is in the first position it is adjacent to the "top" or roof surface 17 of the structure which can be viewed as another level in addition to the first and second level. Accordingly and when the platform is in the first position objects 20 can travel from the roof 17 onto the platform 50 and then travel to the first level and vice versa via platform 50. In addition and to move platform 50 to the first position it is configured to be lifted up the pole member 52 by hand wherein a clicking ratchet internal mechanism (not shown) repositions at the roof 17 for the next spin-down to the second position. In addition, the platform 50 moves vertically with respect to the pole member 52 as it rotates about the pole member 52 in the direction of arrows 54 from the first position to the second position.

In addition, the structure 12 further comprises a ramp member 56 which provides a means for the object 20 to travel from the second level 16 to the first level 14. In addition and as previously mentioned and in one embodiment, the structure 12 is configured to resemble a firehouse and the object 20 is a fire truck. Of course, other configurations are contemplated to be within the scope of exemplary embodiments of the invention. Still further pole member 52 will resemble a fireman's pole and additional features include pivoting door members 58.

Referring now to FIGS. 9-19C in conjunction with FIGS. 1-8, the playset 10 further comprises a collapsible third level 70 located below the first level 14. In the illustrated embodiment the collapsible third level 70 is configured for movement between a contracted position (FIGS. 1-8) and an expanded position (FIGS. 13-19C) with respect to the first level 14. In addition, the second level 16 is configured to have a floor portion 72 that extends laterally away from the second level 16 such that floor portion 72 can support the structure 12 on a portion of a surface 74 proximate to an edge 76 of the surface 74 such that the first level 14 is located below surface 74 and the third level 70 can be manipulated into the expanded position downwardly from the first level 14. Accordingly and in this embodiment, the second level 16 via floor portion 72 supports the structure along an edge 76 of a surface 74 such that the playset 10 and in particular third level 70 can be manipulated into an expanded configuration thus providing enhanced play. Still further, and in order to ensure that the playset is fixedly secured to edge 76 a releasable clamp system (not shown) is provided to engage edge 76 and complementary surfaces located proximate to edge 76.

In order to transition the third level 70 from the collapsed configuration to the expanded configuration and actuation button 78 is provided. Here actuation button 78 when depressed will release the third level 70 from the first level 14. Accordingly and when the structure 12 is supported along edge 76 the third level 70 will drop downwardly from the first level 14 thus providing another level of play. In addition, the third level 70 further comprises a ramp member 80 that extends from the first level 14 to the third level 70 when the third level 70 is in the expanded position. In addition, the playset also has an extendable platform 82 and a ramp member 84. Here, the extendable platform 82 rotates from the third level 70 when the third level 70 is in the expanded position and the ramp member 84 is pivotally mounted to only the third level 70 at one end and is configured for movement between a first position wherein the ramp member 84 is flush with a floor 86 of the third level 70 and a second position wherein a portion of the ramp member 84 is located below the floor 86 of the third level 70. In an exemplary embodiment, each of the ramp member 80, extendable platform 82 and ramp member 84 are configured to automatically transition into their expanded positions when the actuation button 78 is depressed and the third level 70 moves to the expanded configuration. Accordingly and by simply depressing actuation button 70 when the structure 12 is secured to an edge 76 of a surface 74 the structure 12 expands into a larger playset.

In this embodiment, the platform 24 of the mechanism 22 provides a means for transferring object 20 from the first level 14 to the second level 16 and vice versa. Still further, the platform 24 when in the second position is adjacent to the floor portion 72 of the second level 16 which supports the structure on the edge 76 of the surface 74. In addition and when the playset 10 is in the expanded configuration such that the third level 70 is deployed below the first level 14 the claw member 48 is now capable of transferring the object 20 between anyone of the first level 14, second level 16, and the third level 70.

The third level 70 also has a façade member 88 that is pivotally mounted to the floor 86 of the third level 70 such that the facade member 88 can translate from a deployed position wherein the façade member 88 is essentially vertical or perpendicular with respect to perpendicular the floor 86. In one embodiment façade member 88 is spring biased such that movement of the third level 70 from the collapse position to the expanded position will allow the façade member 88 to spring into its vertical configuration with respect to floor 86.

Figure 18A:
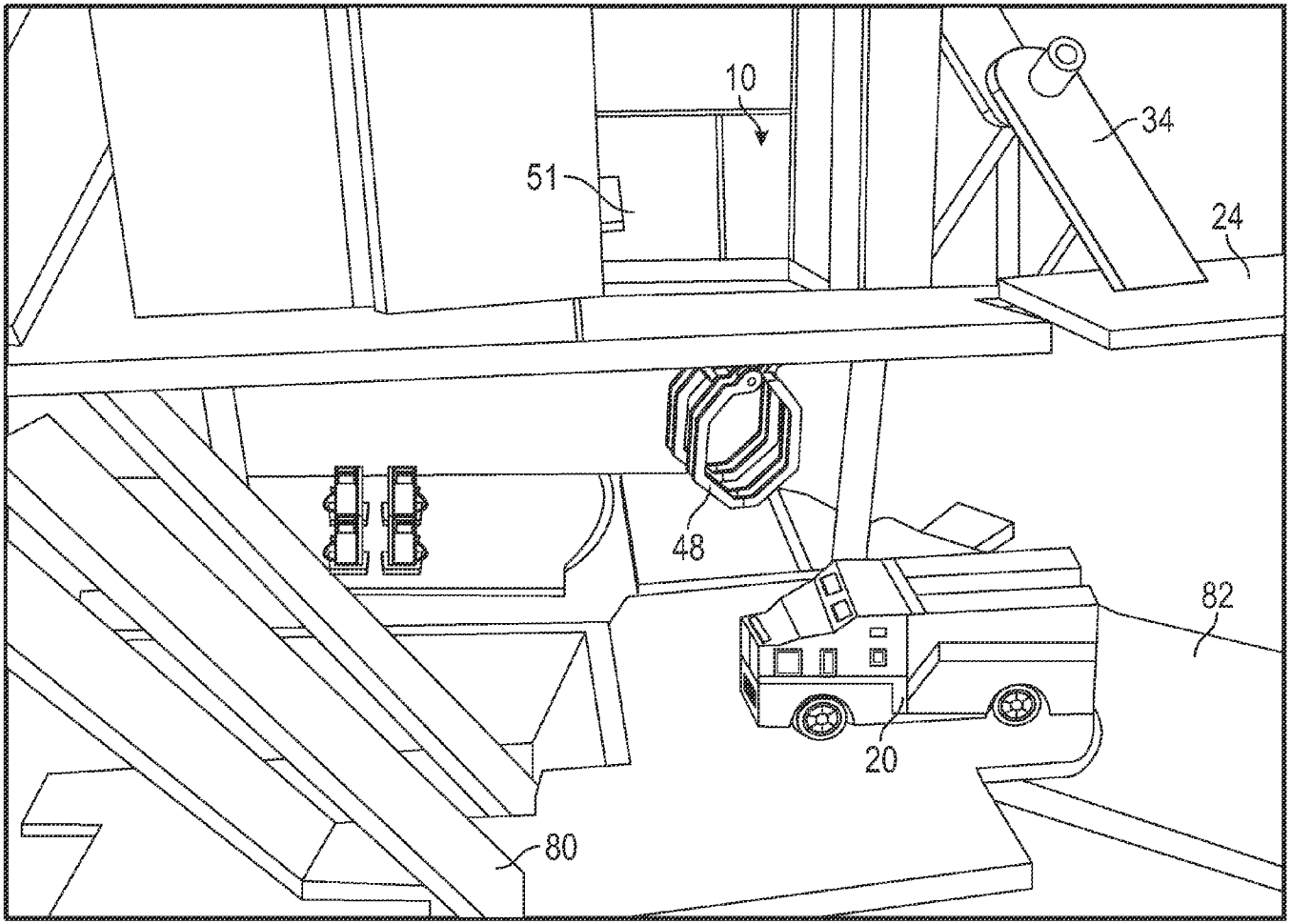
Figure 18B:
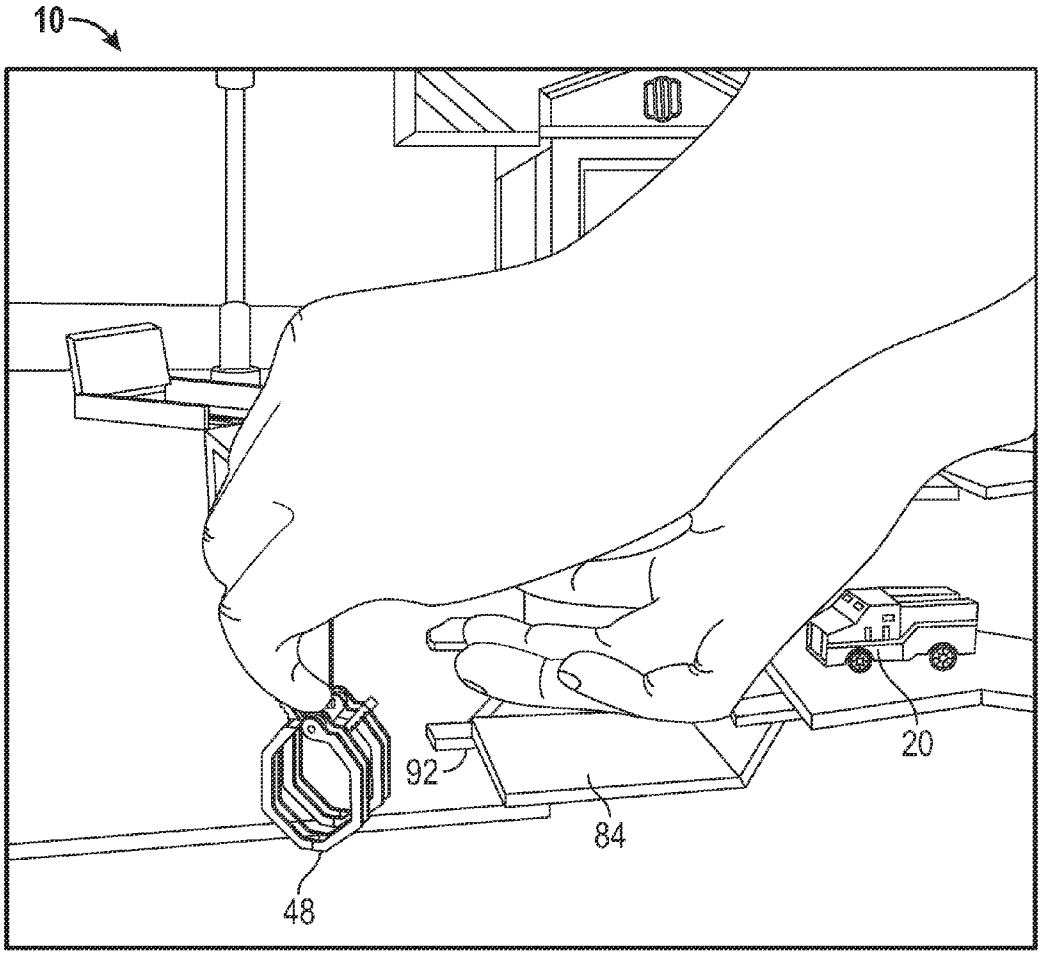
Figure 18C:
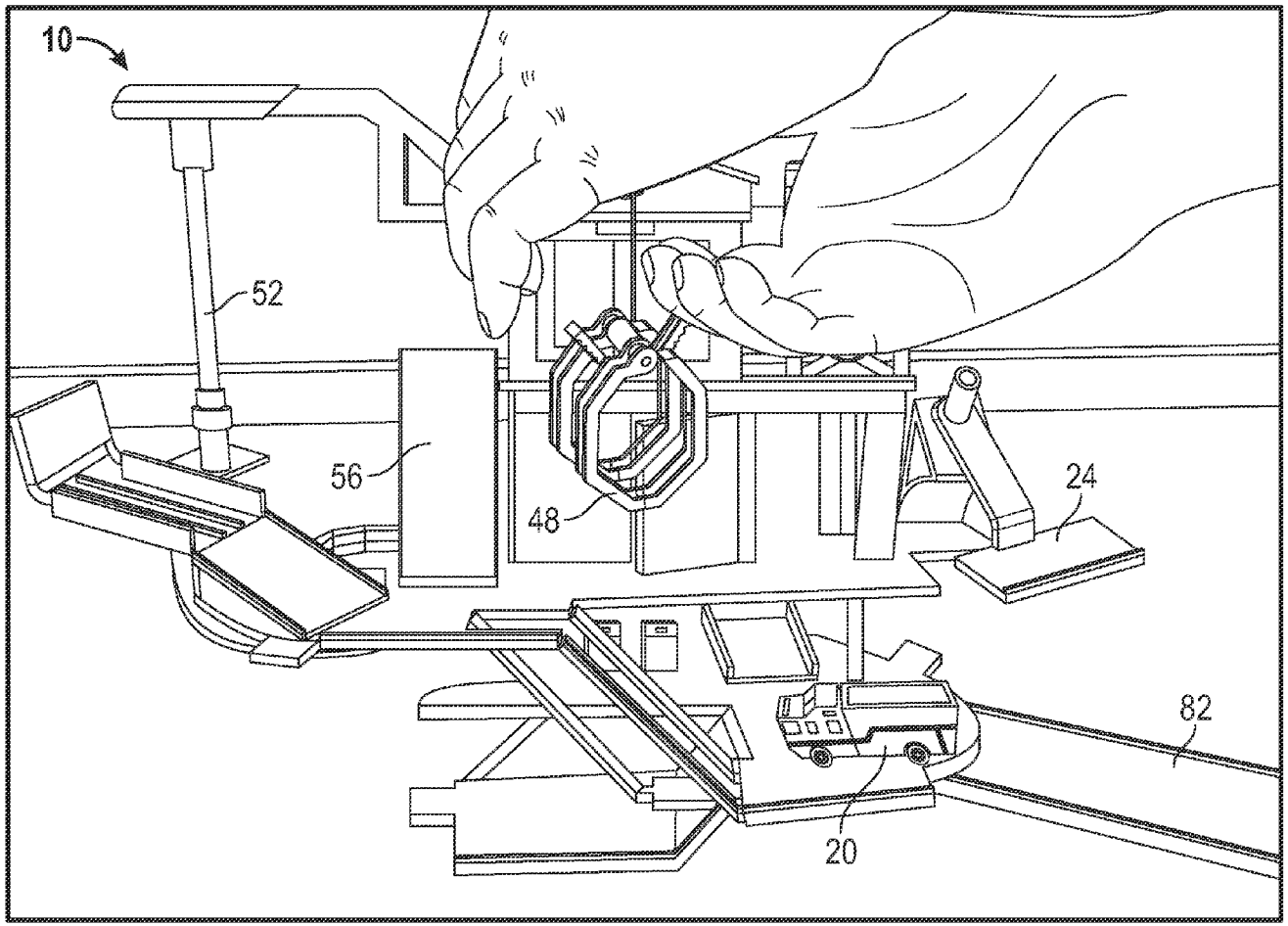
Figure 19A:
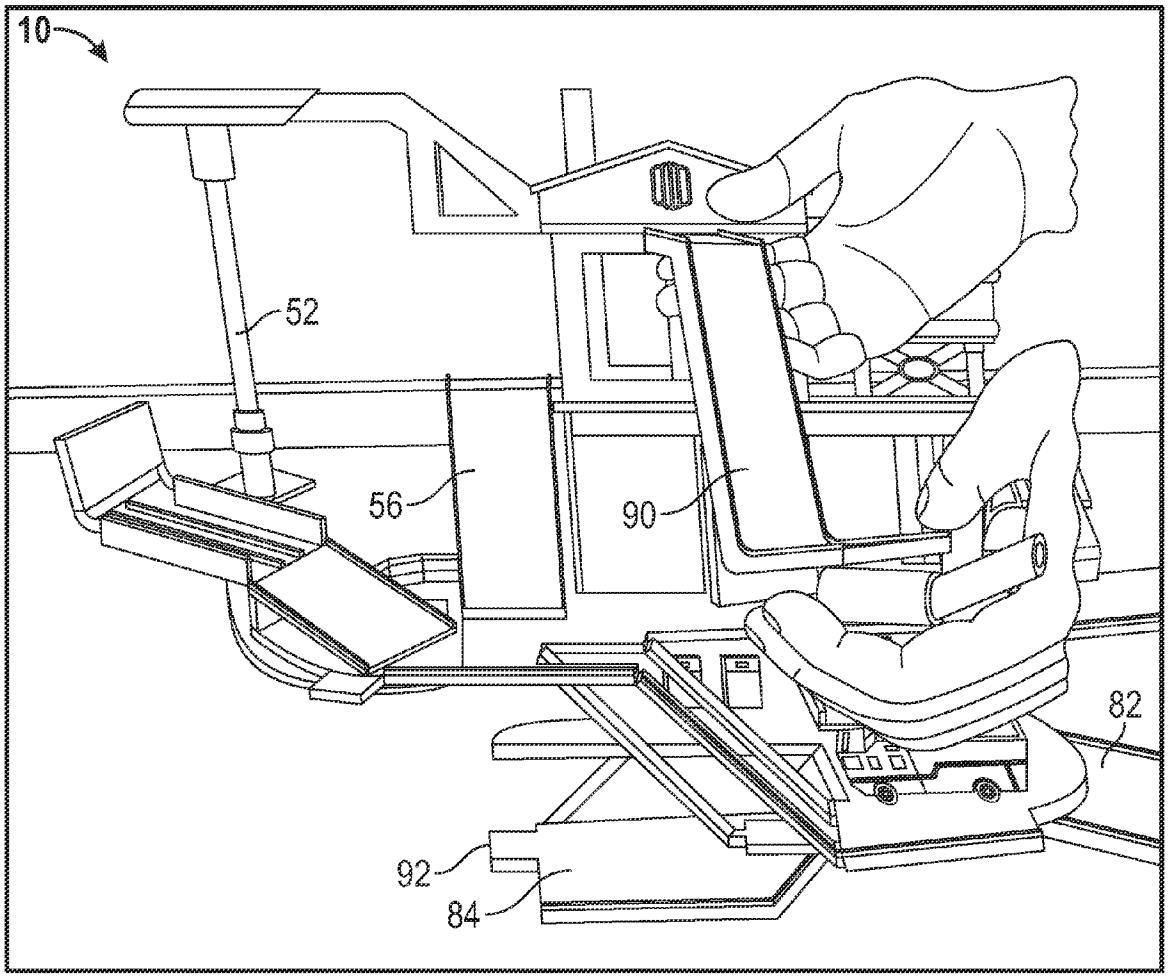
Figure 19B:
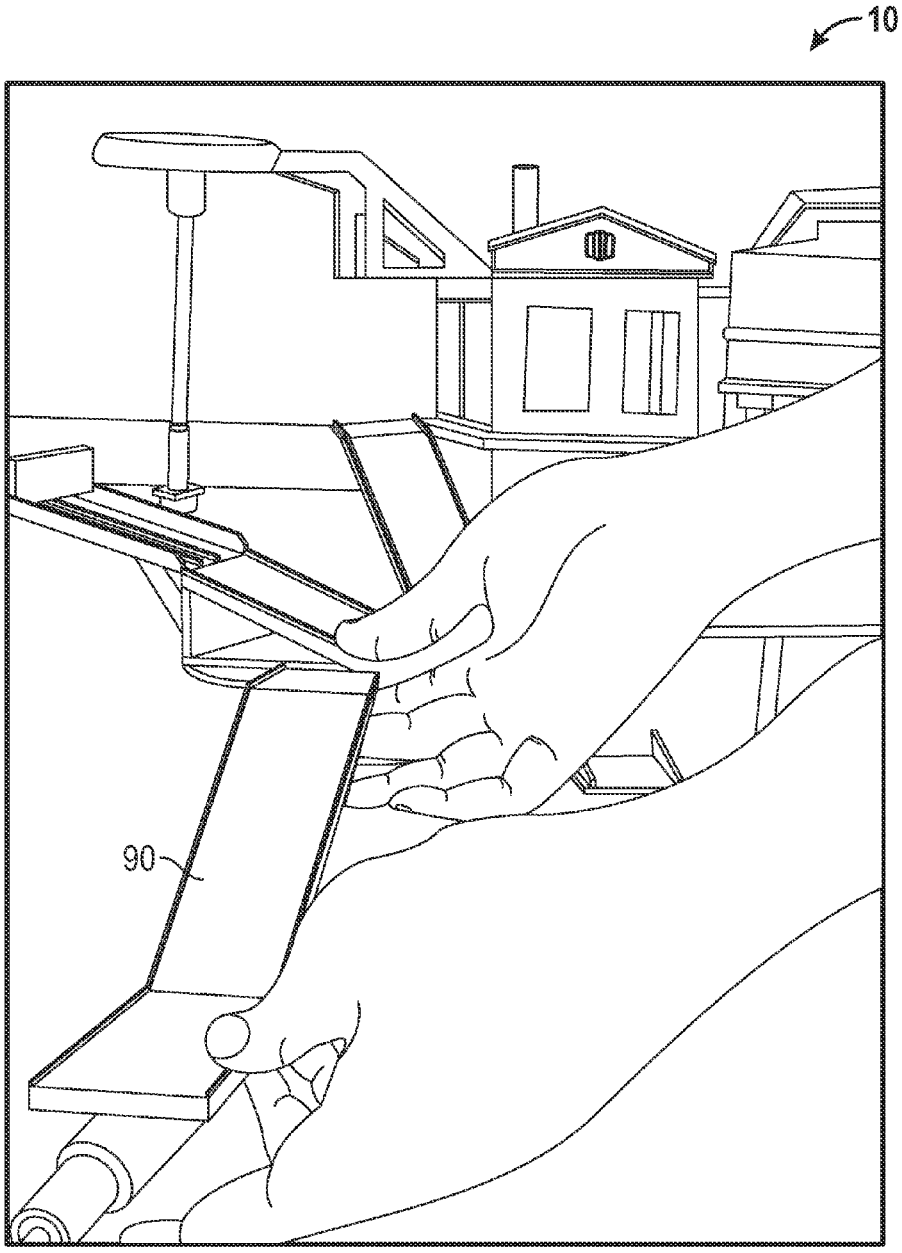
Figure 19C:
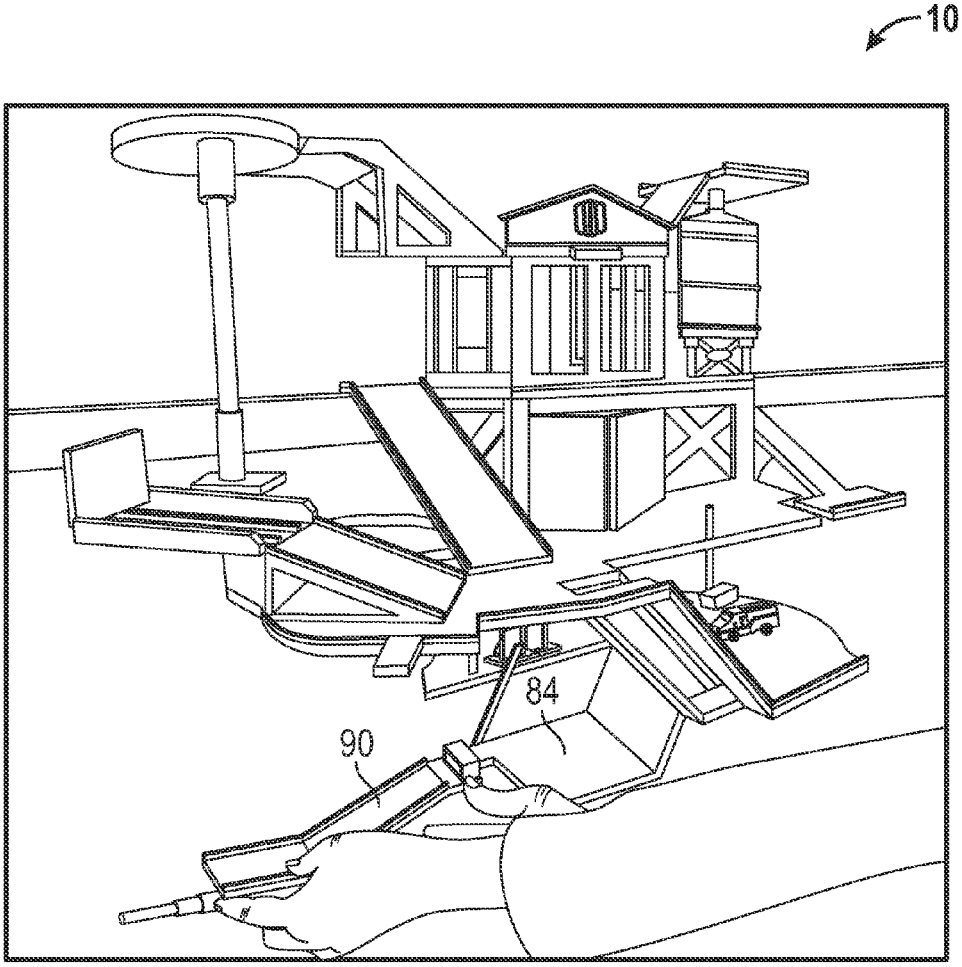
Figure 20:
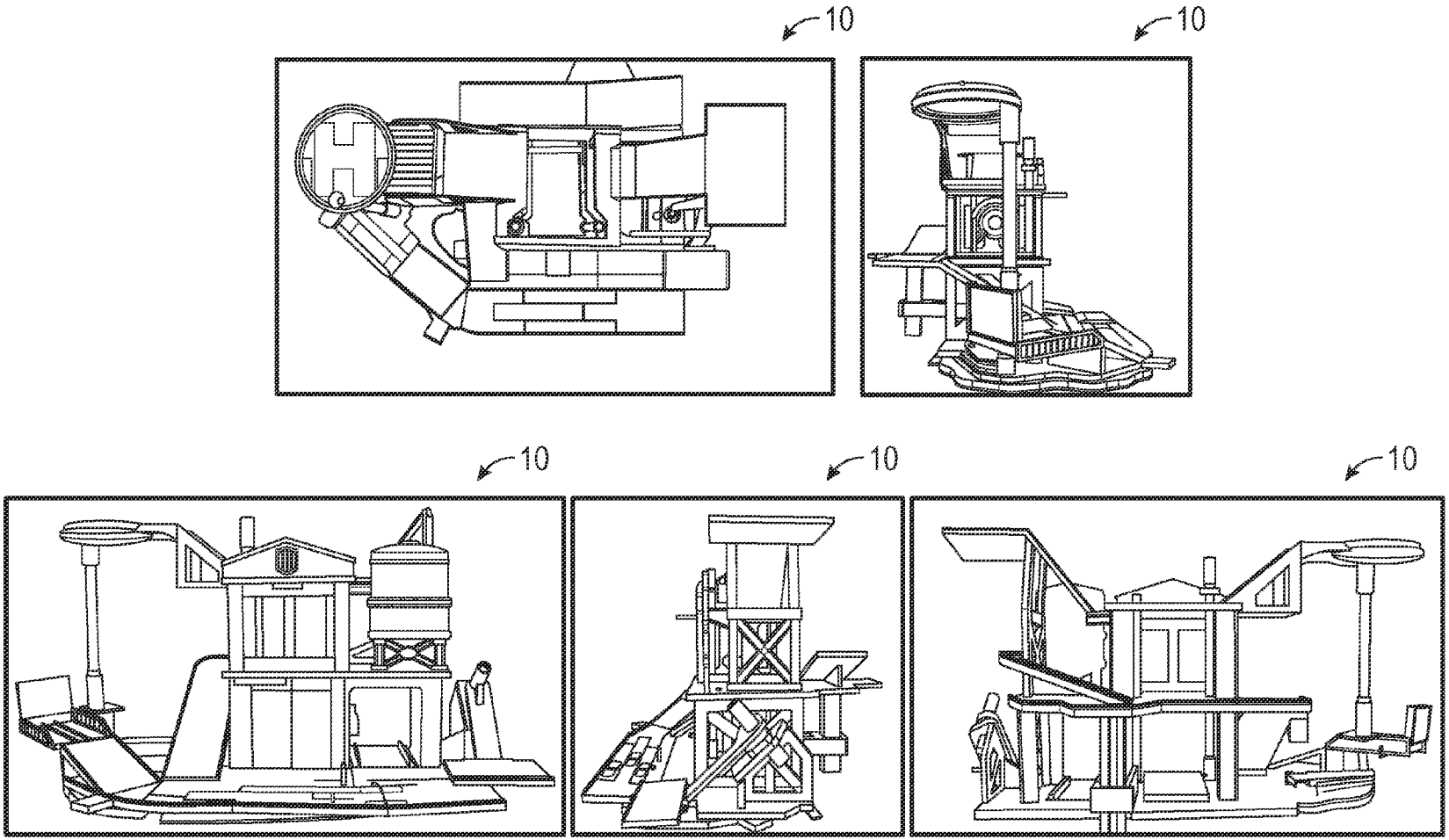
FIGS. 20 and 21 illustrate various views of exemplary embodiments of the present invention.
Figure 21:
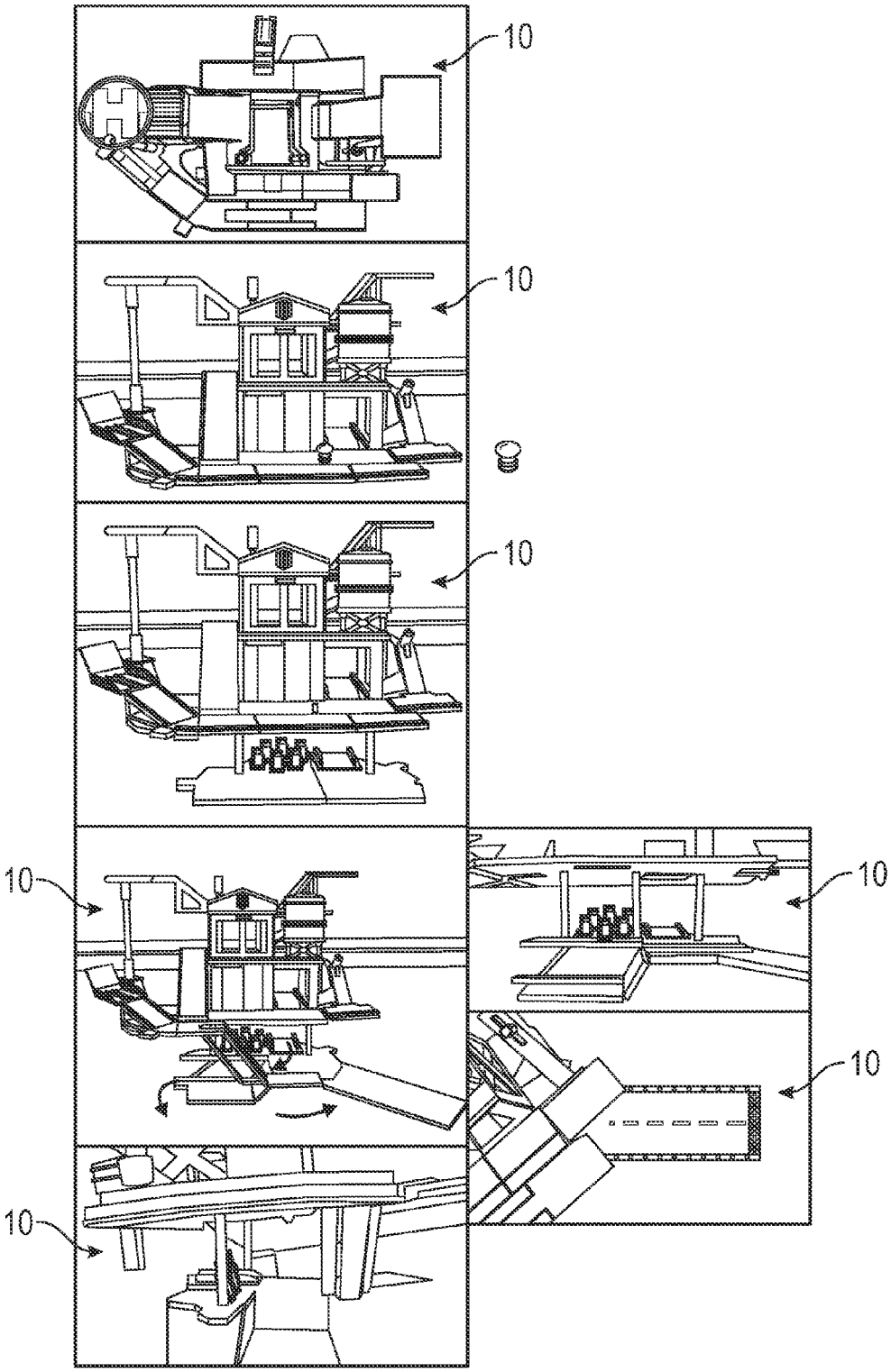
Figure 22A:
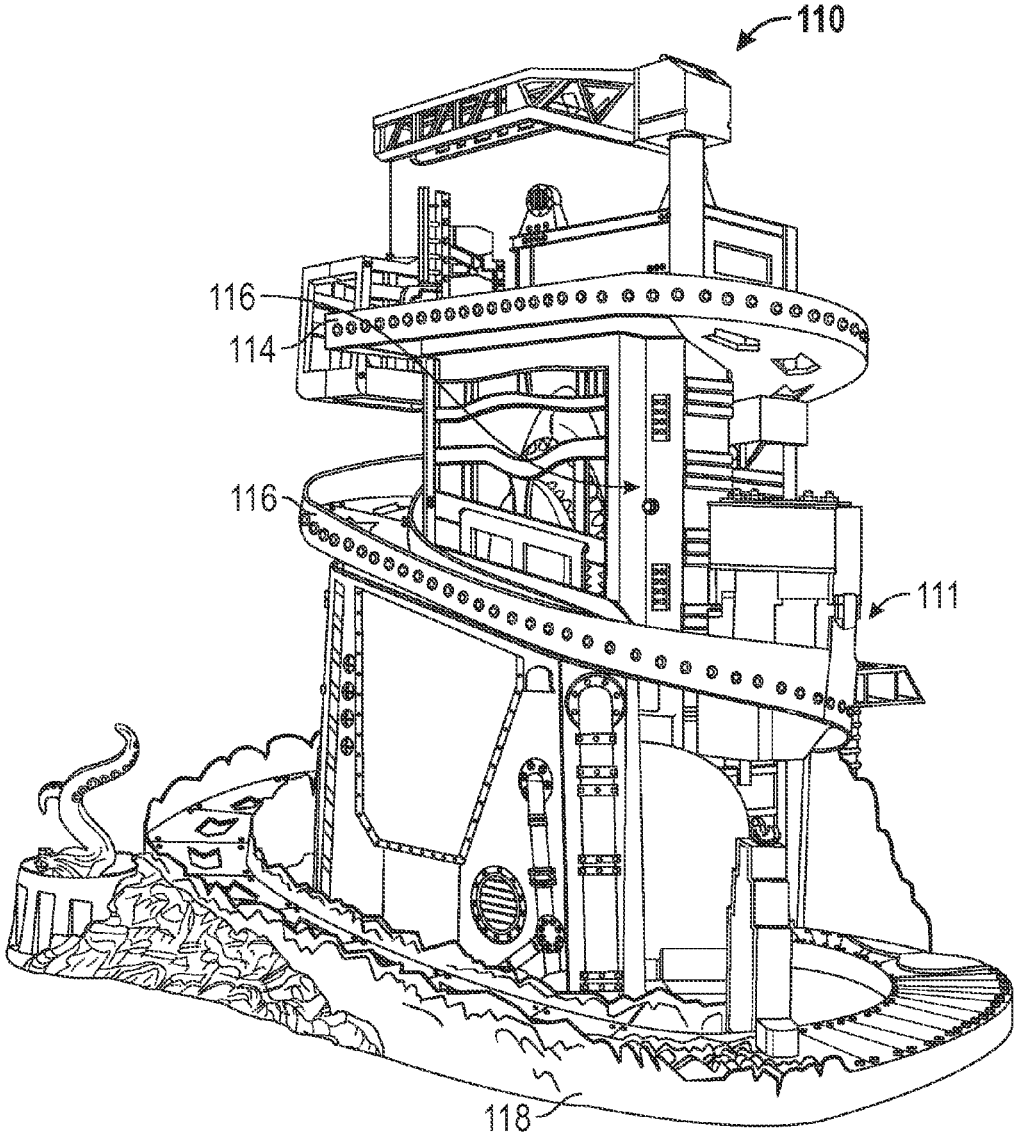
FIGS. 22A-29B illustrate various views of alternative exemplary embodiments of the present invention.
Figure 22B:
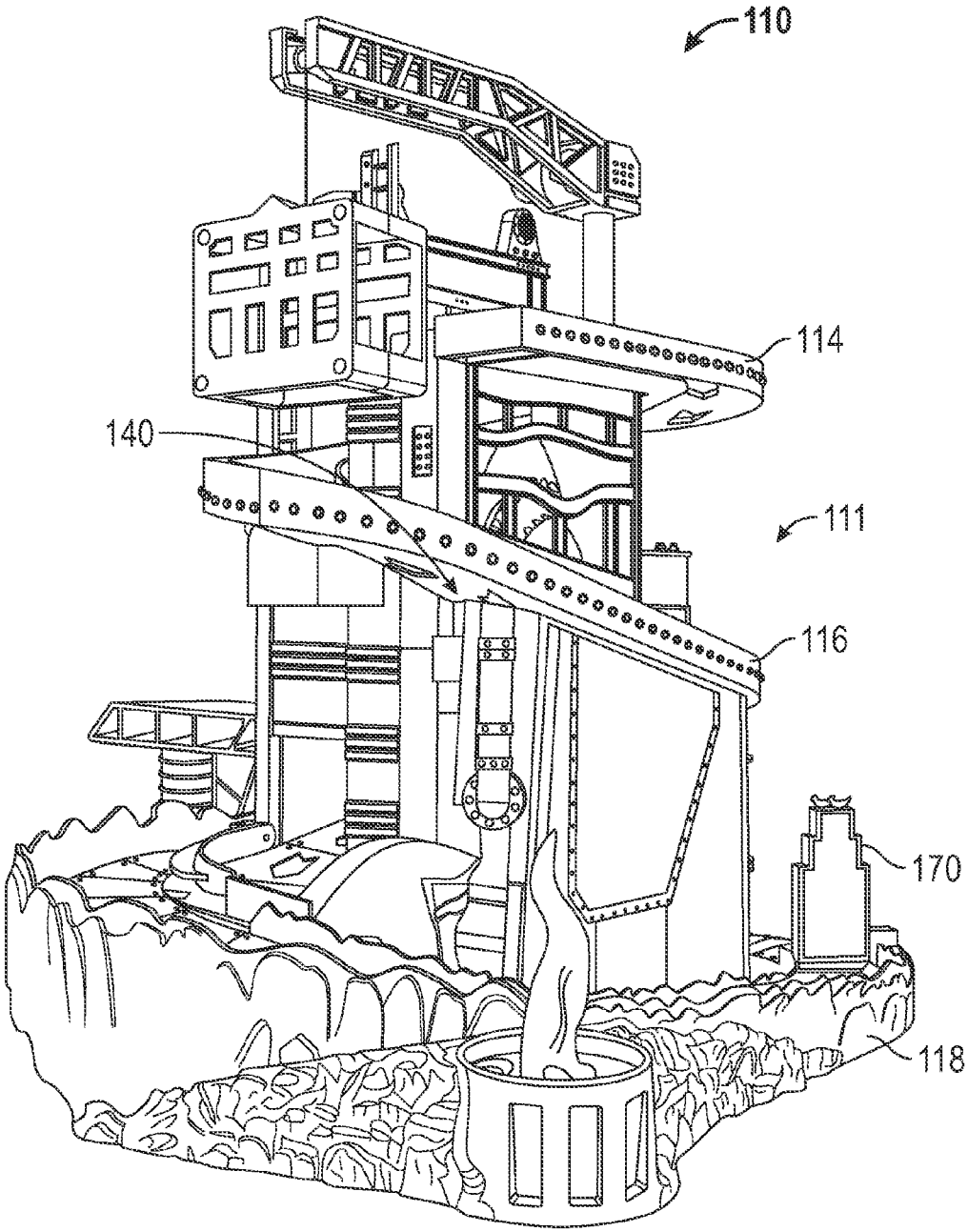
Figure 22C:
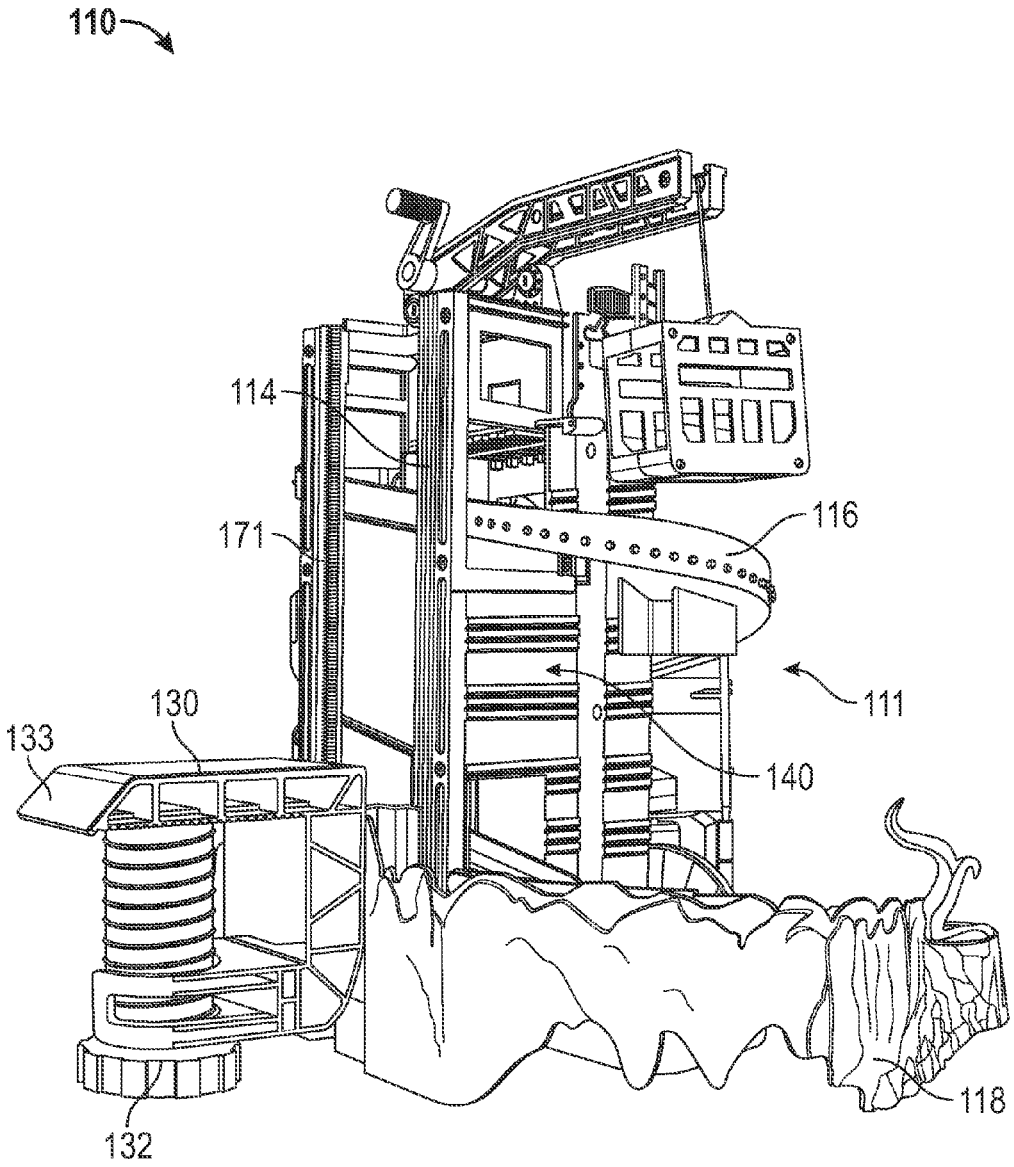
Figure 22D:
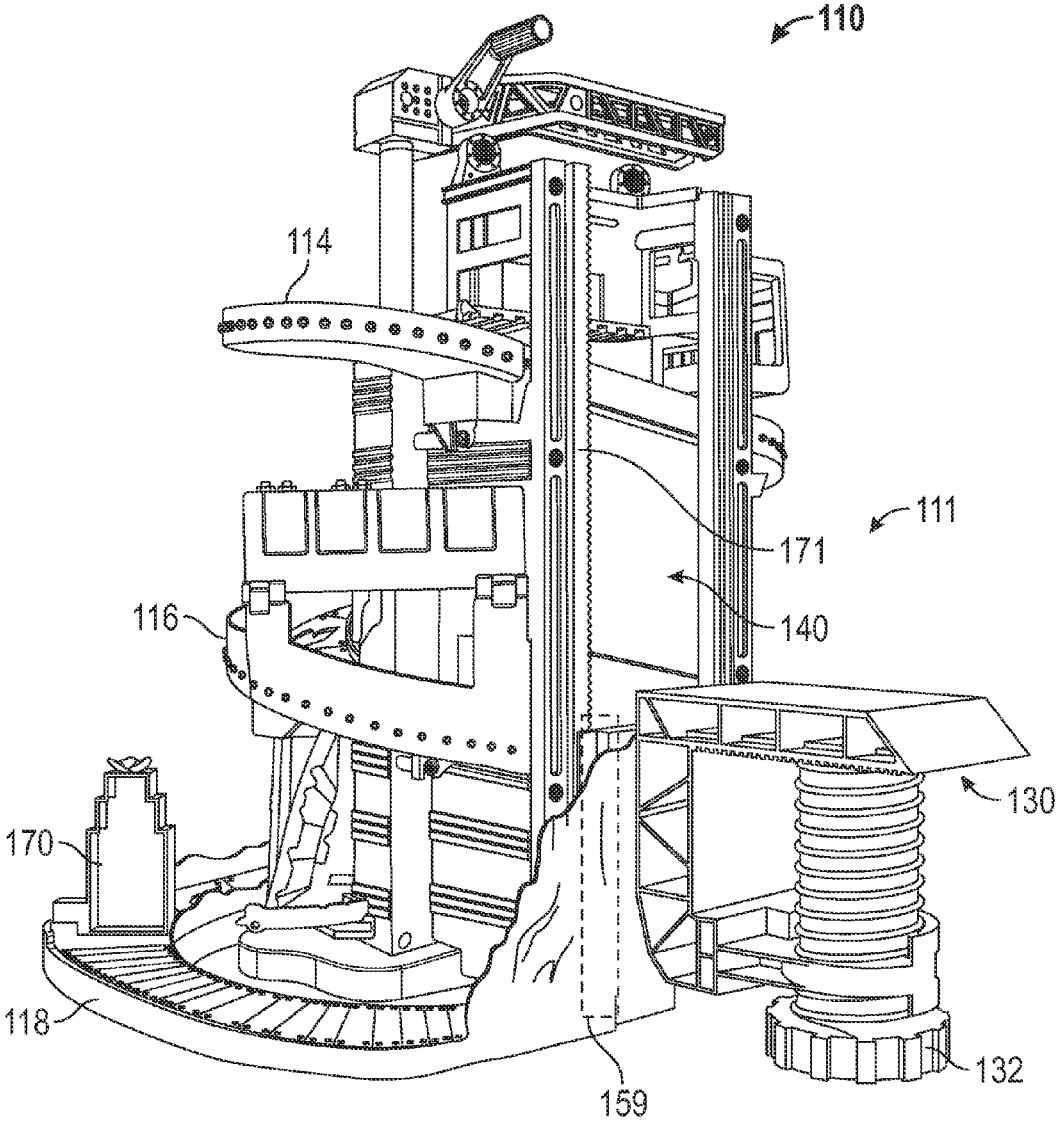
Figure 22E:
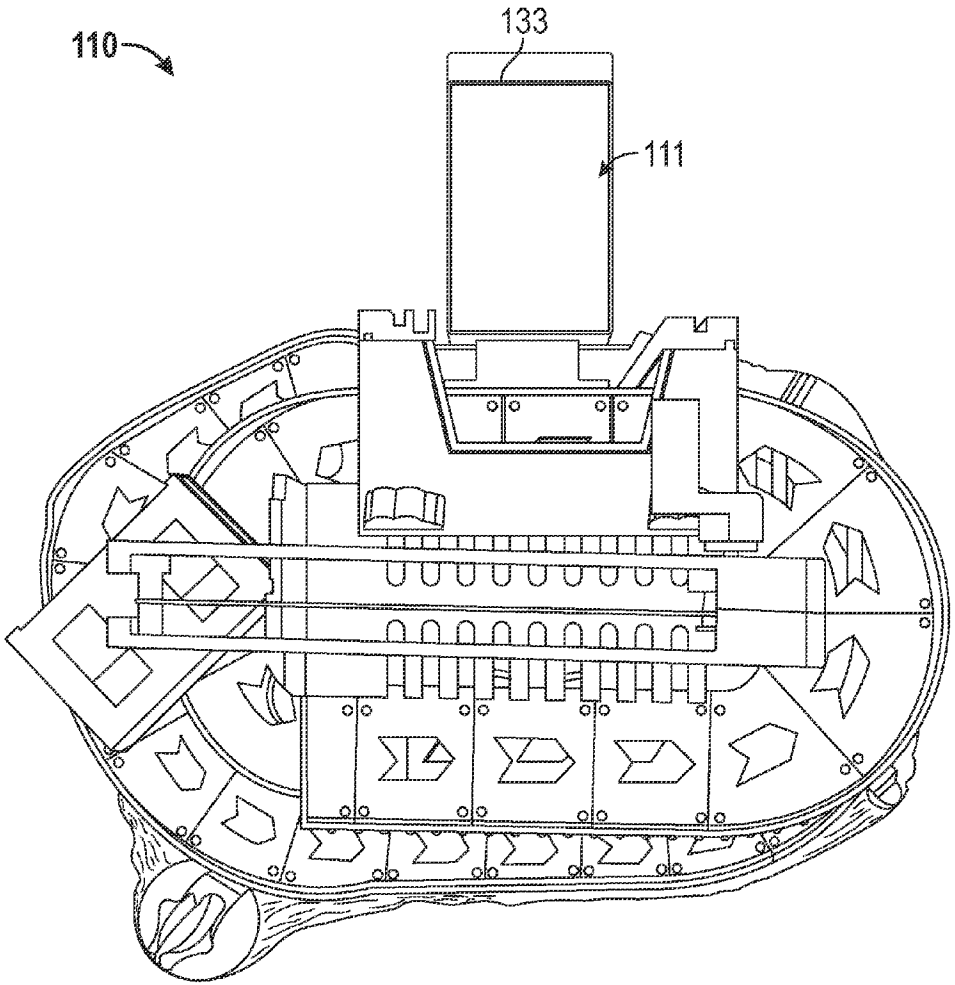
Figure 23A:
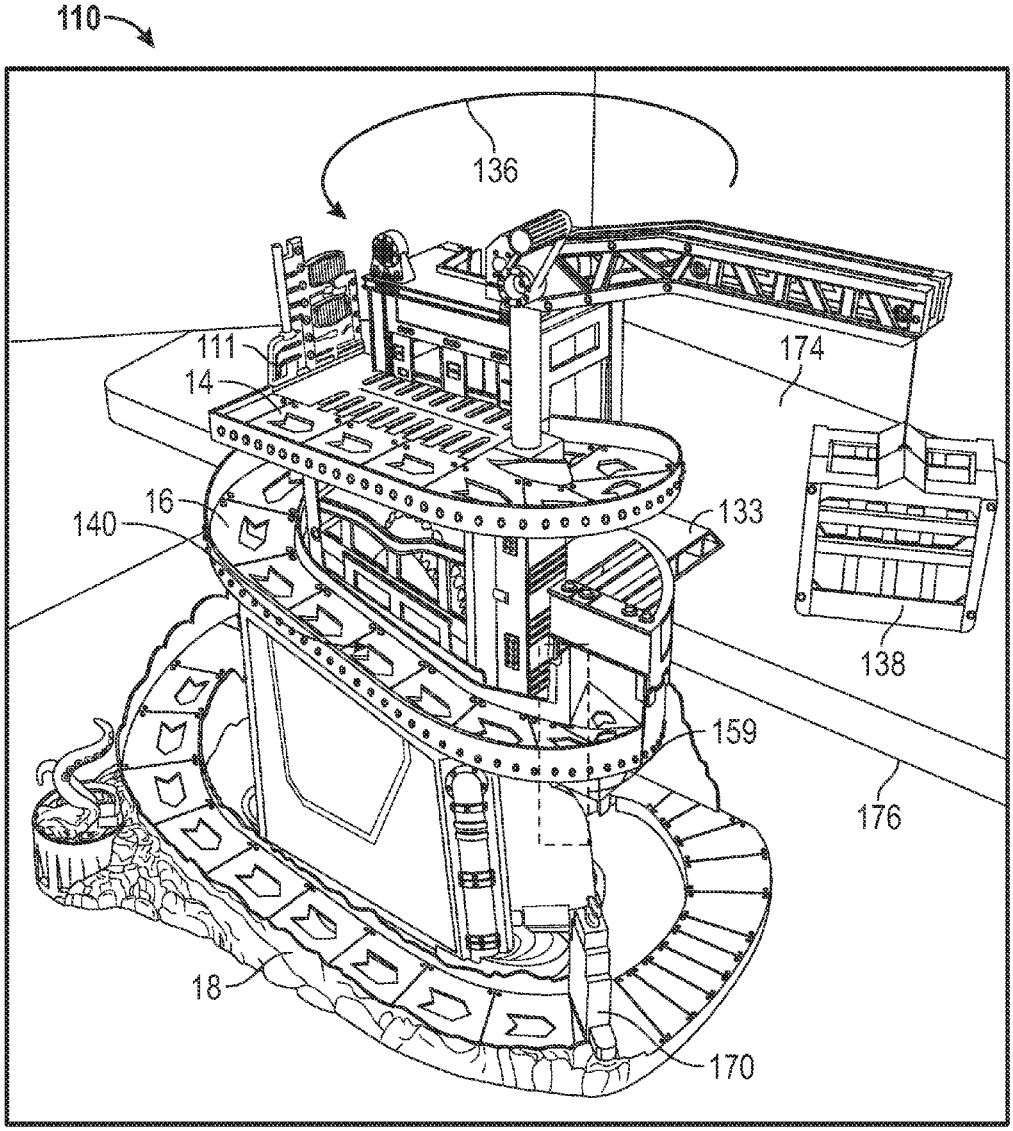
Figure 23B:
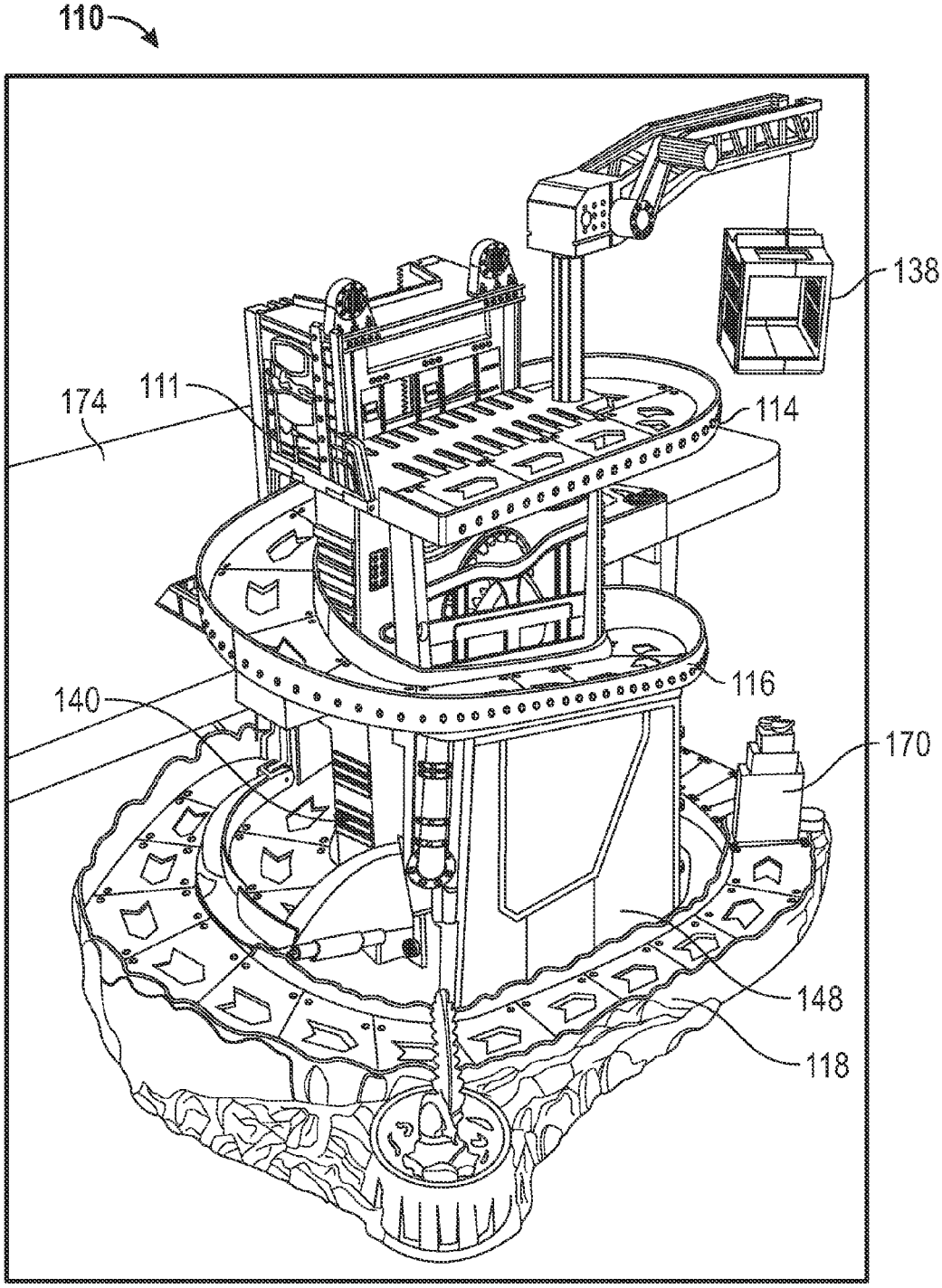

As illustrated in FIGS. 18A-18C, the claw member 48 can be relocated into a variety of locations with respect to the structure 12. In addition and referring now to FIGS. 19A-19C, a pivotable ramp member 90 is provided wherein one end of ramp member 90 can be secured to various locations of the structure 12 via a feature 92 while the other end of ramp member 90 extends away from the structure 12. In one embodiment, the ramp member 90 will have a plurality of sections each pivotally secured to each other and having detent features cooperating with each other such that an articulating ramp member 90 is provided.

Accordingly, various embodiments of the present invention provide a playset 10 having a structure 12 with a variety of configurations and levels which provide for surface play as well as edge play, wherein structure can be manipulated into an expanded configuration to provide additional features. Moreover, some features of the structure 12 can be used in surface play in one configuration and then have an expanded configuration when the structure is used for edge play. For example, the elevator 38 can transition between at least three floors (including the roof) when the structure 12 is in a collapsed configuration. Similarly, the claw member 48 can travel between three floors or levels when the structure 12 is in an expanded configuration or alternatively two floors or levels when the structure 12 is in a collapsed configuration. In various alternative non-limiting embodiments, the structure 12, the elevator 38 and the claw member 48 can be configured to allow for movement of the elevator 38 and the claw member 48 between more or less levels than previously mentioned.

Figure 24A:
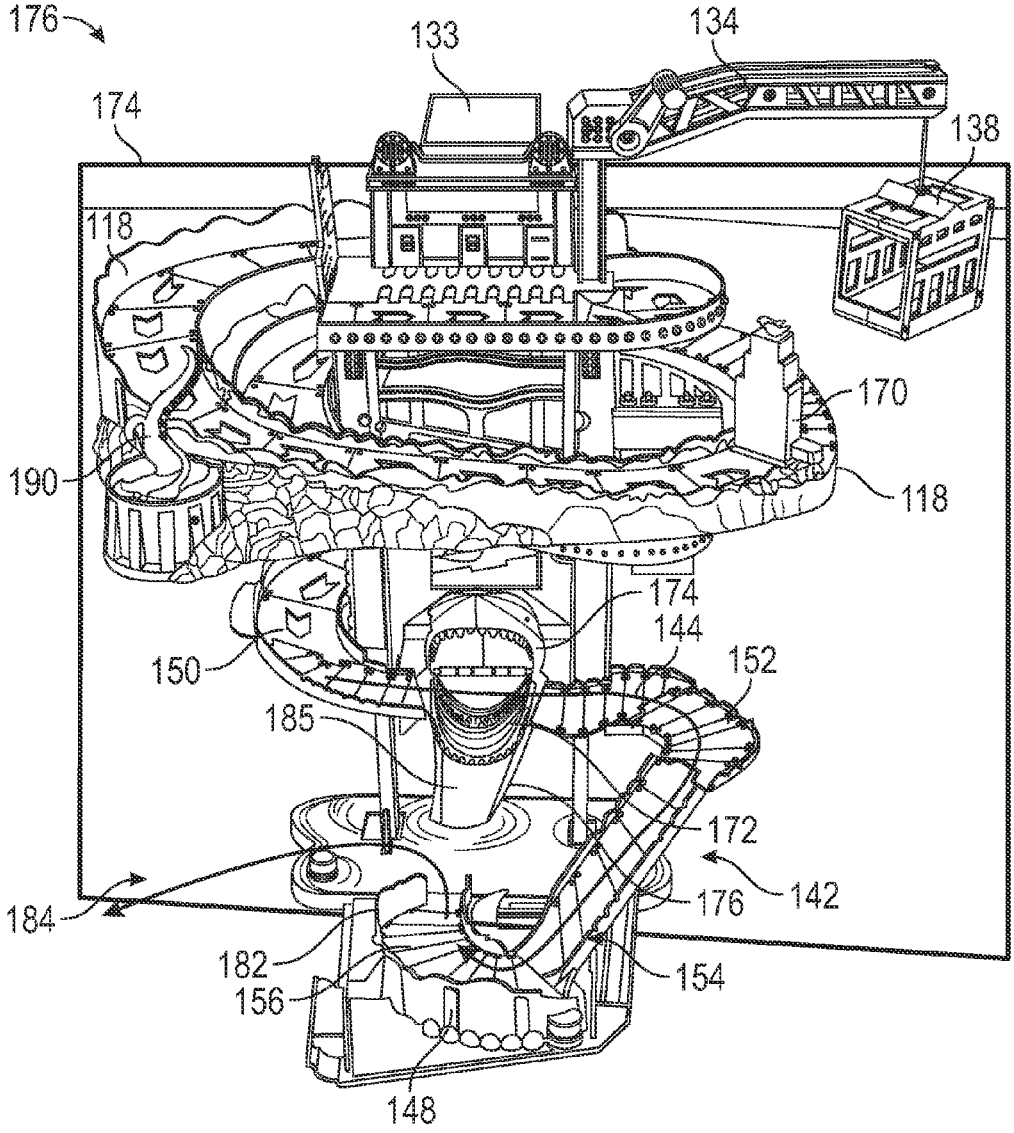
Figure 24B:
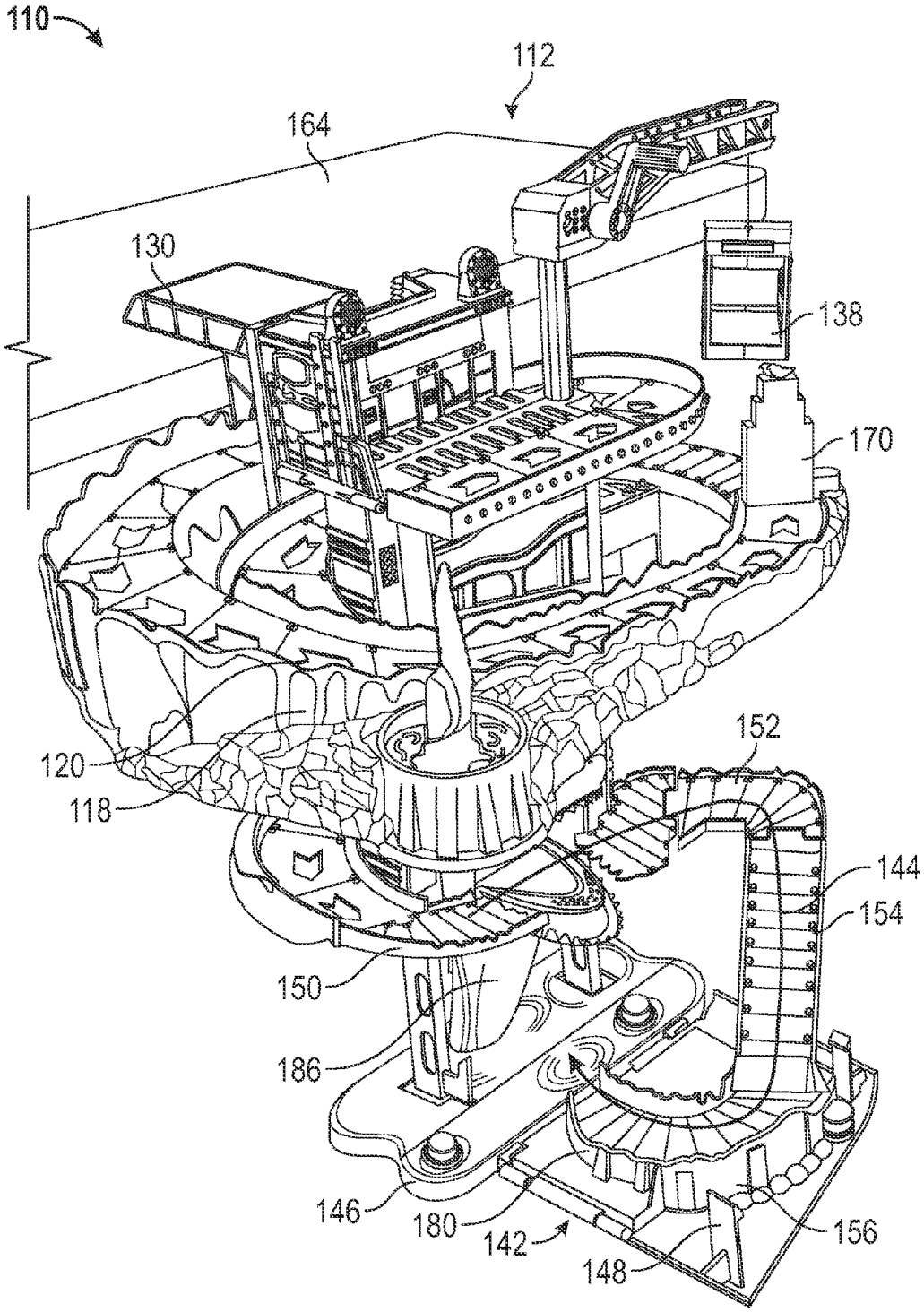
Figure 24C:
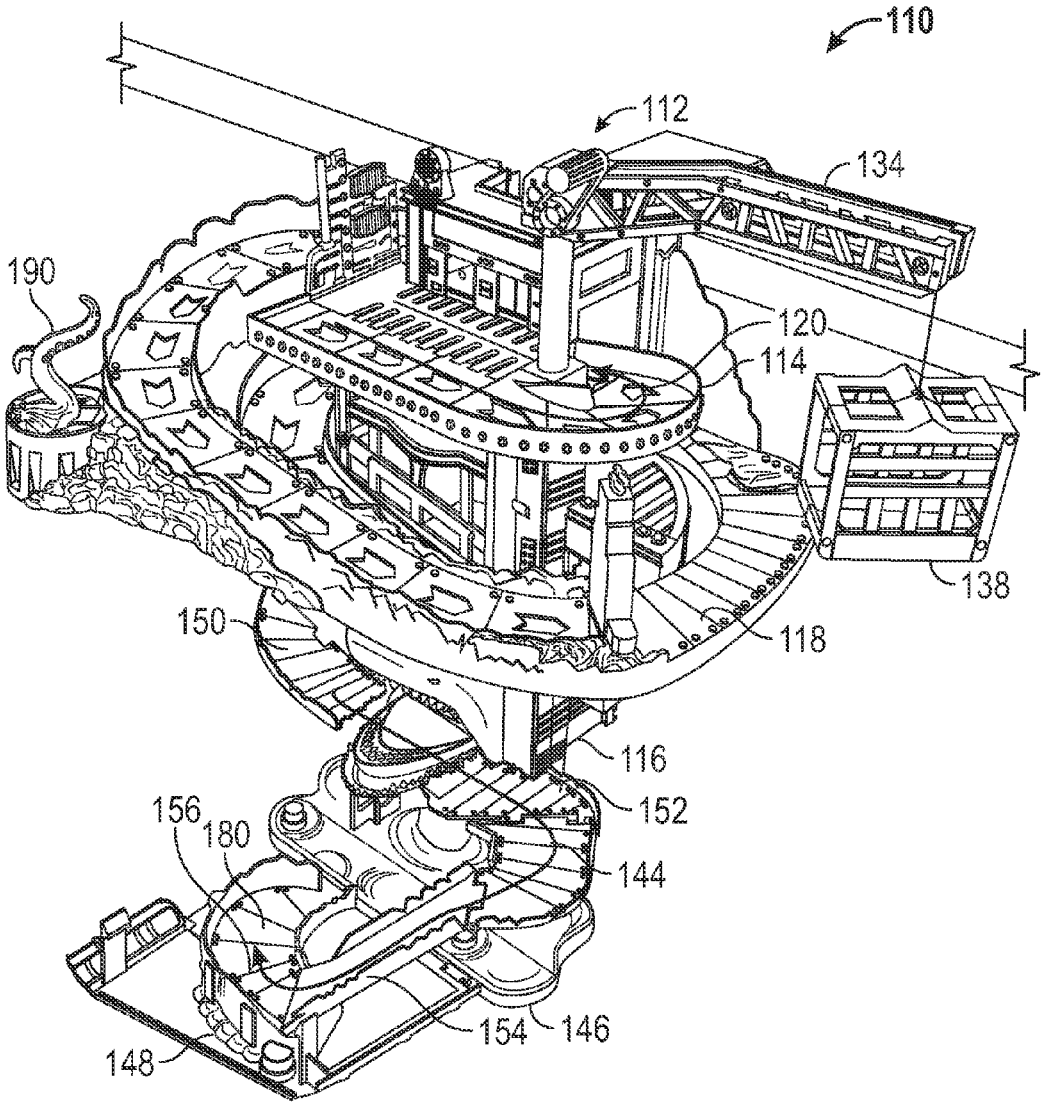
Figure 25A:
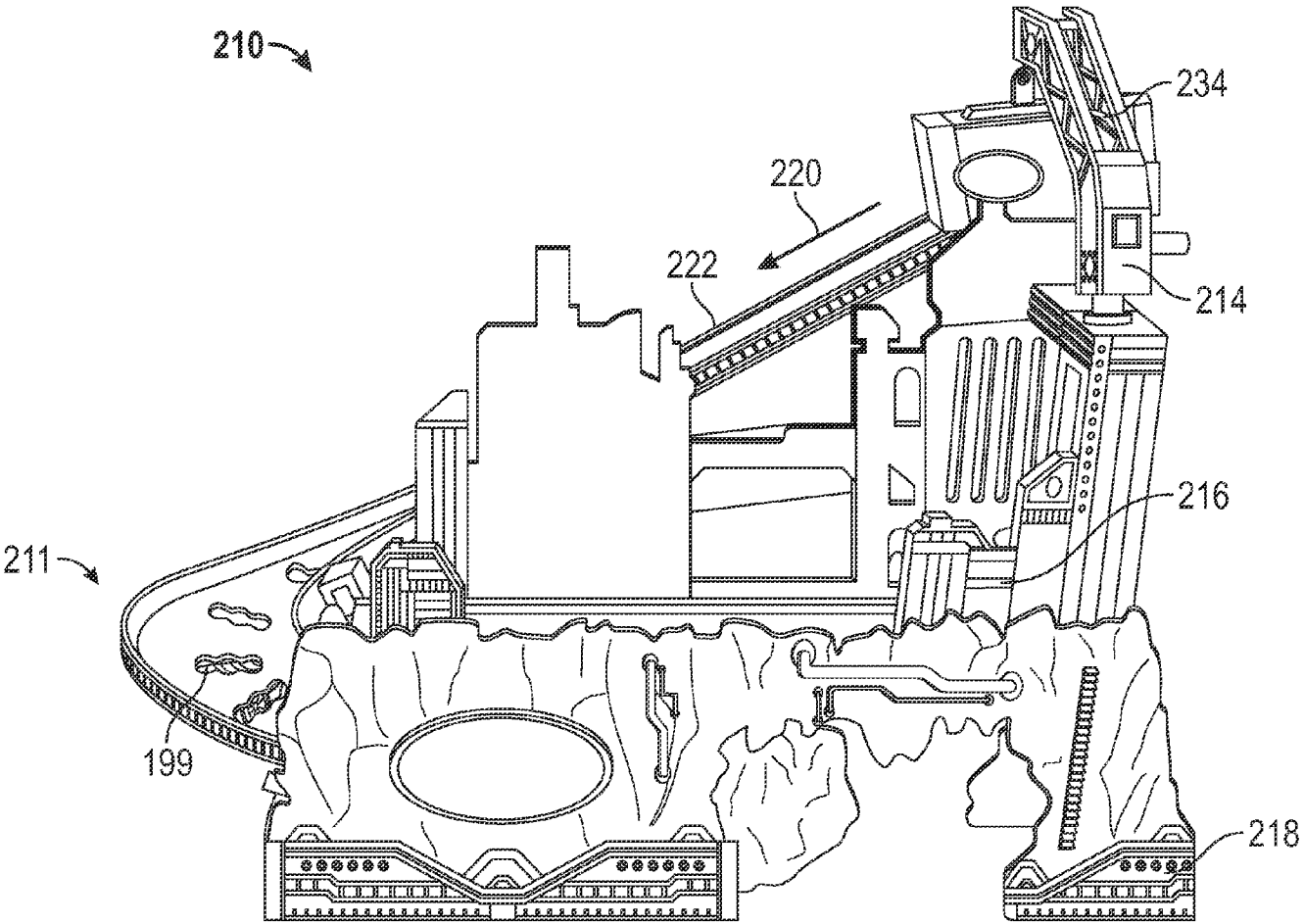
Figure 25B:
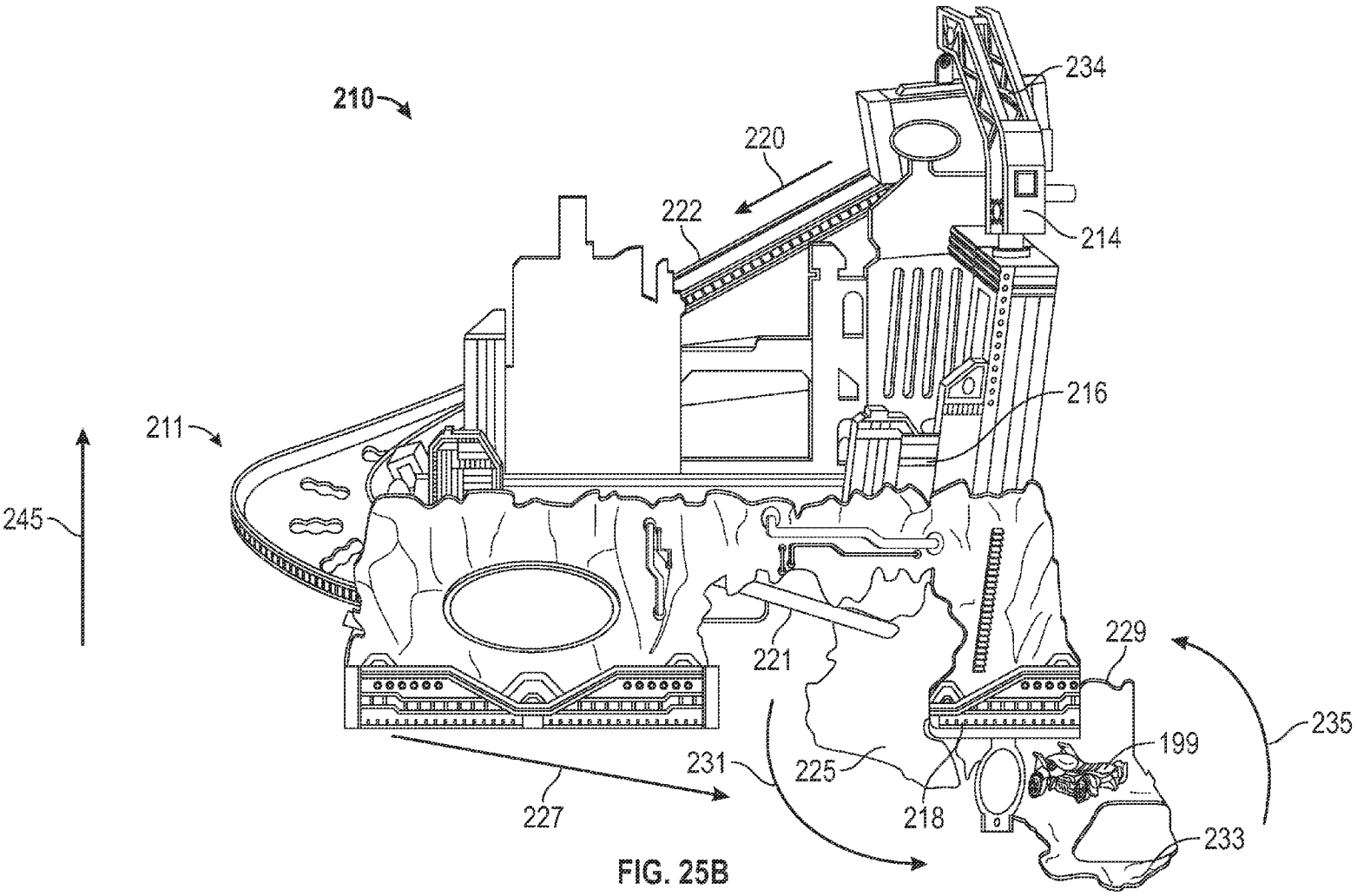
Figure 25C:
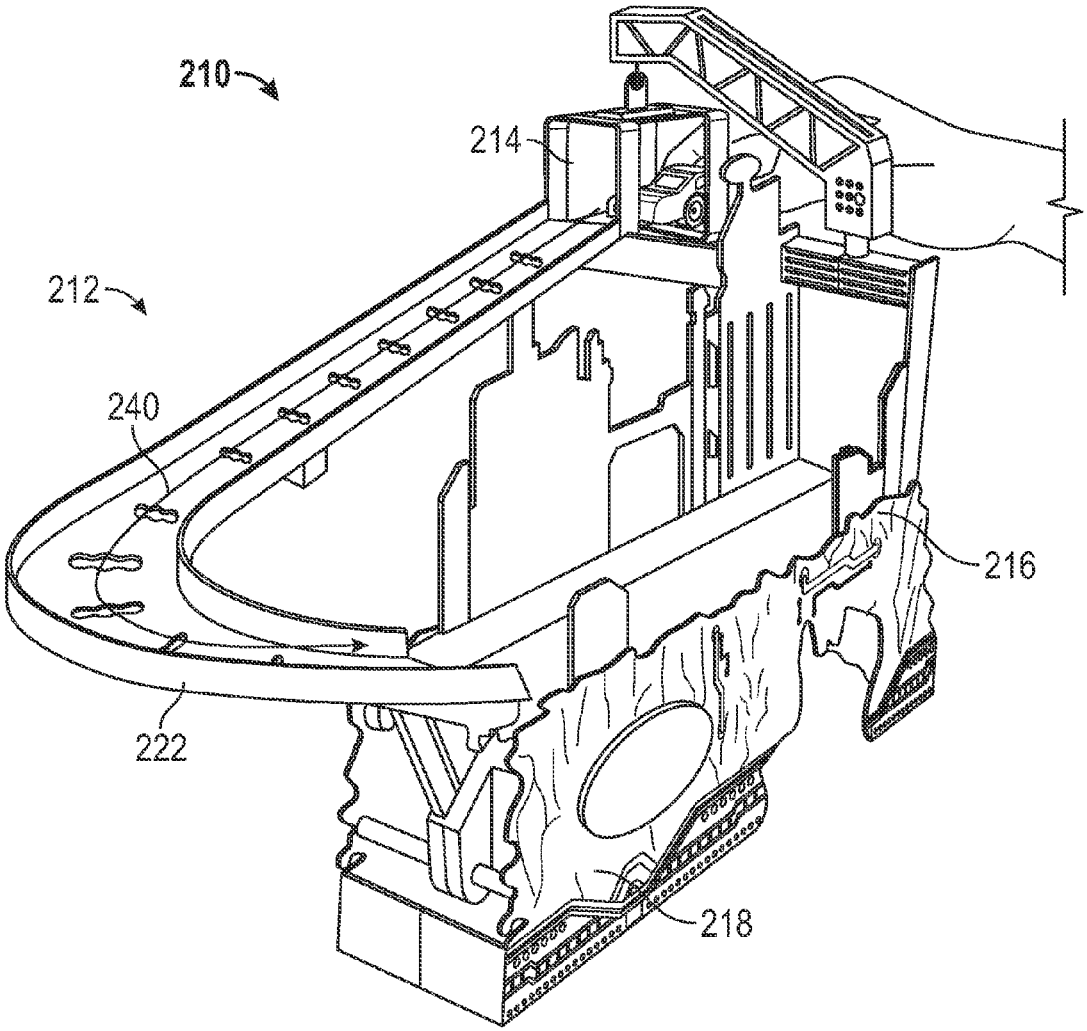
Figure 25D:
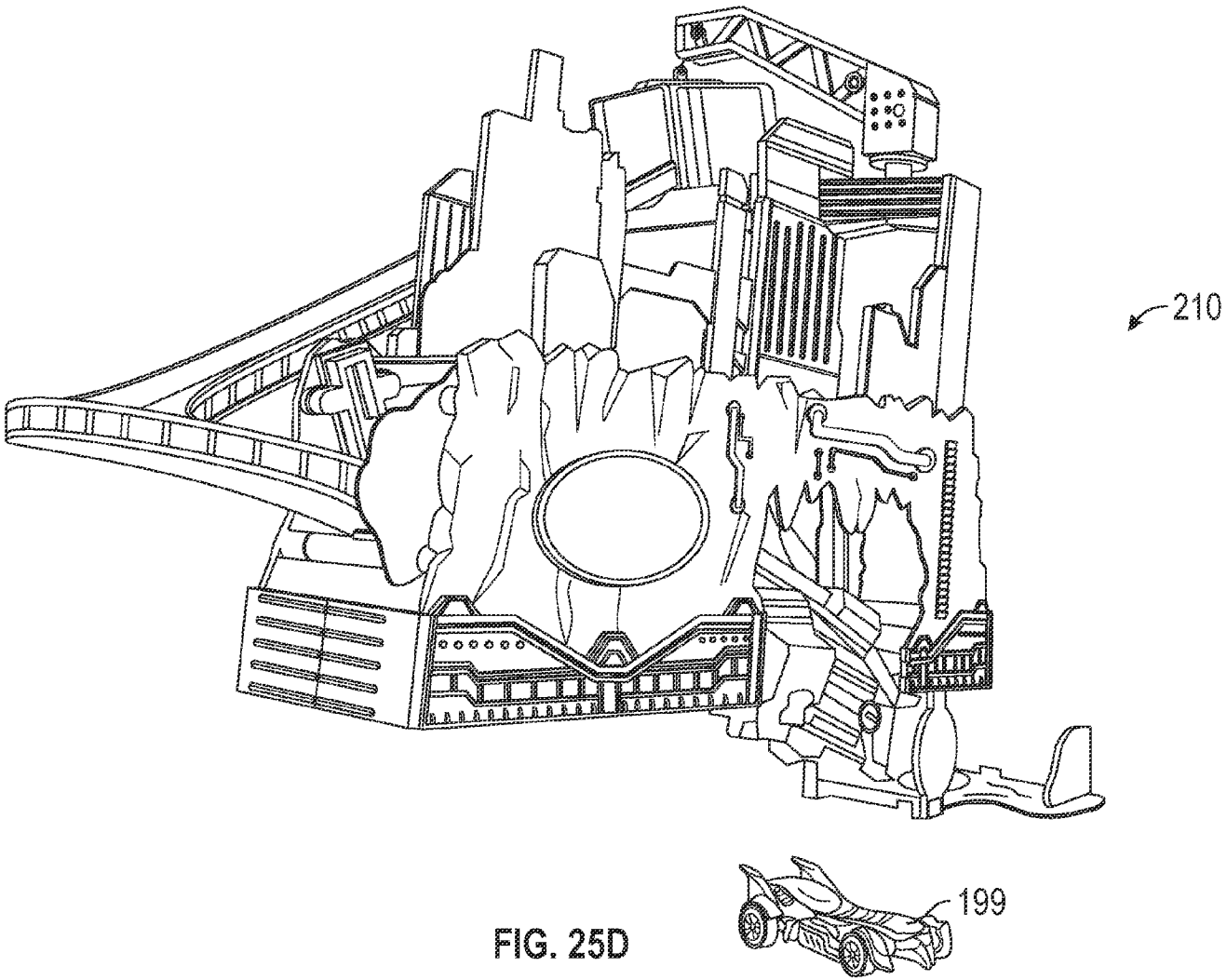
Figure 25E:
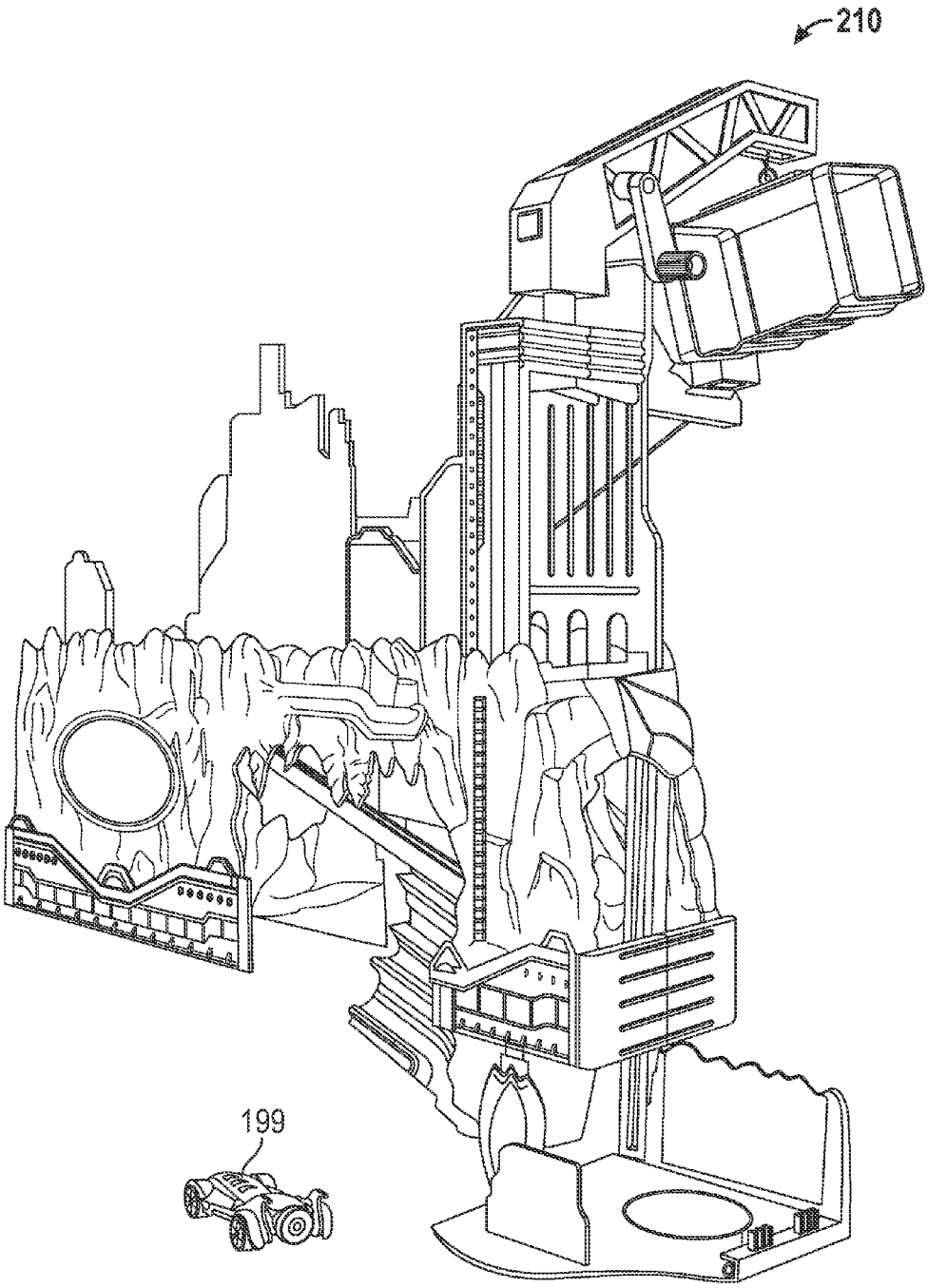
Figure 25F:
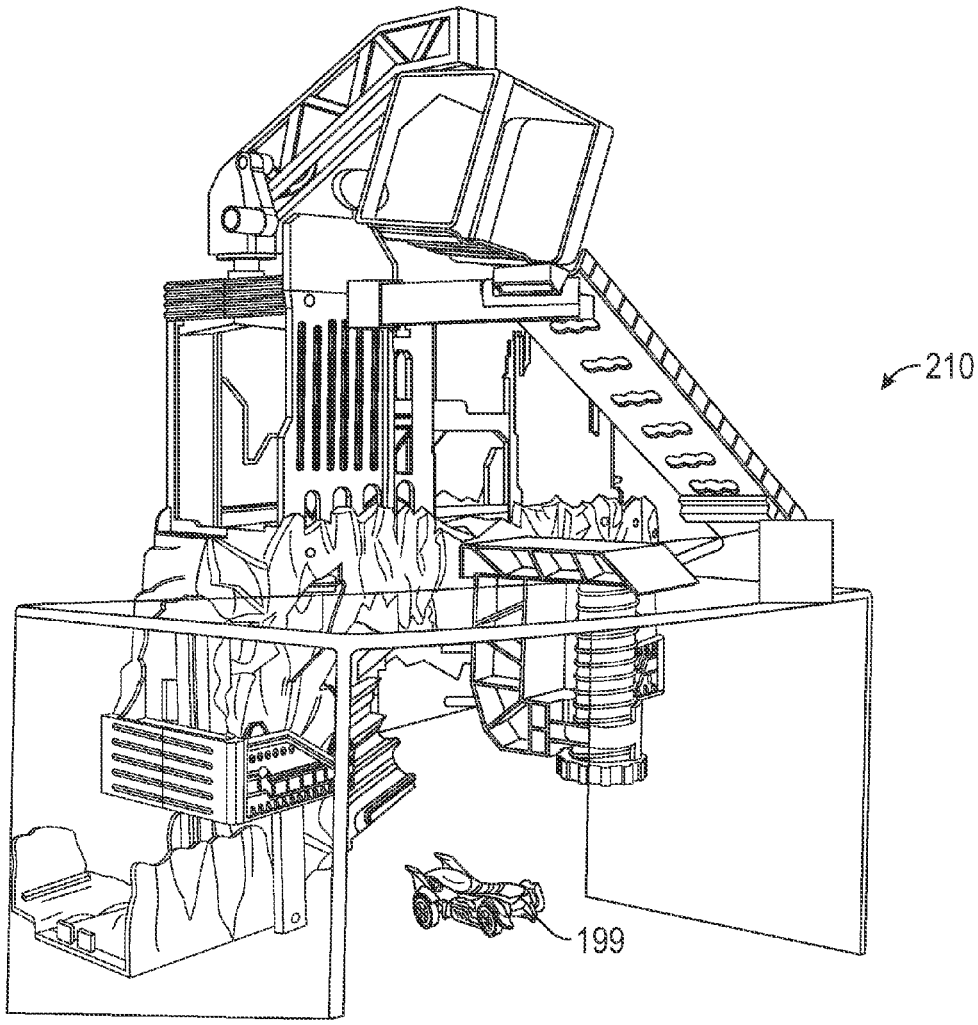
Figure 25G:
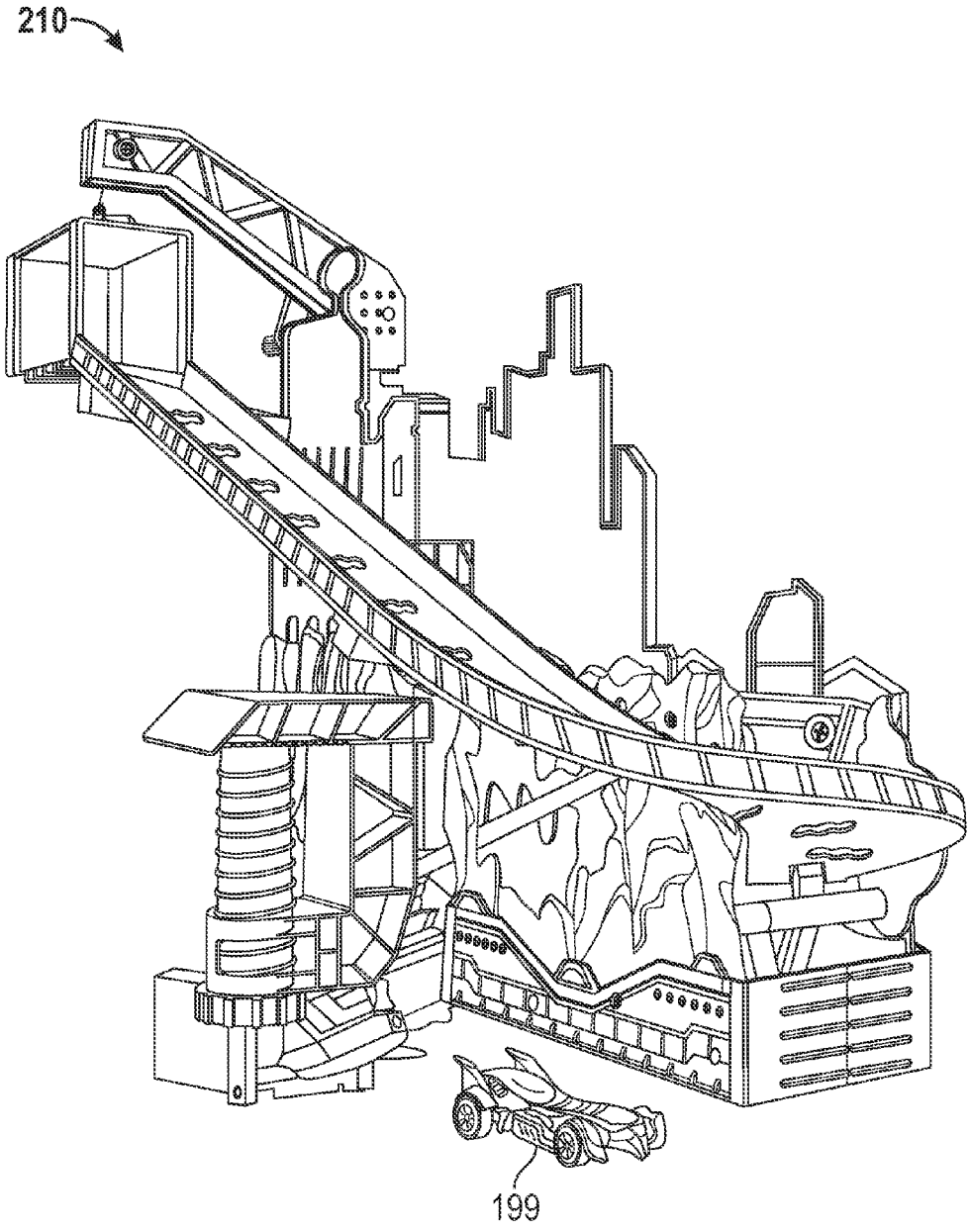
Figure 25H:
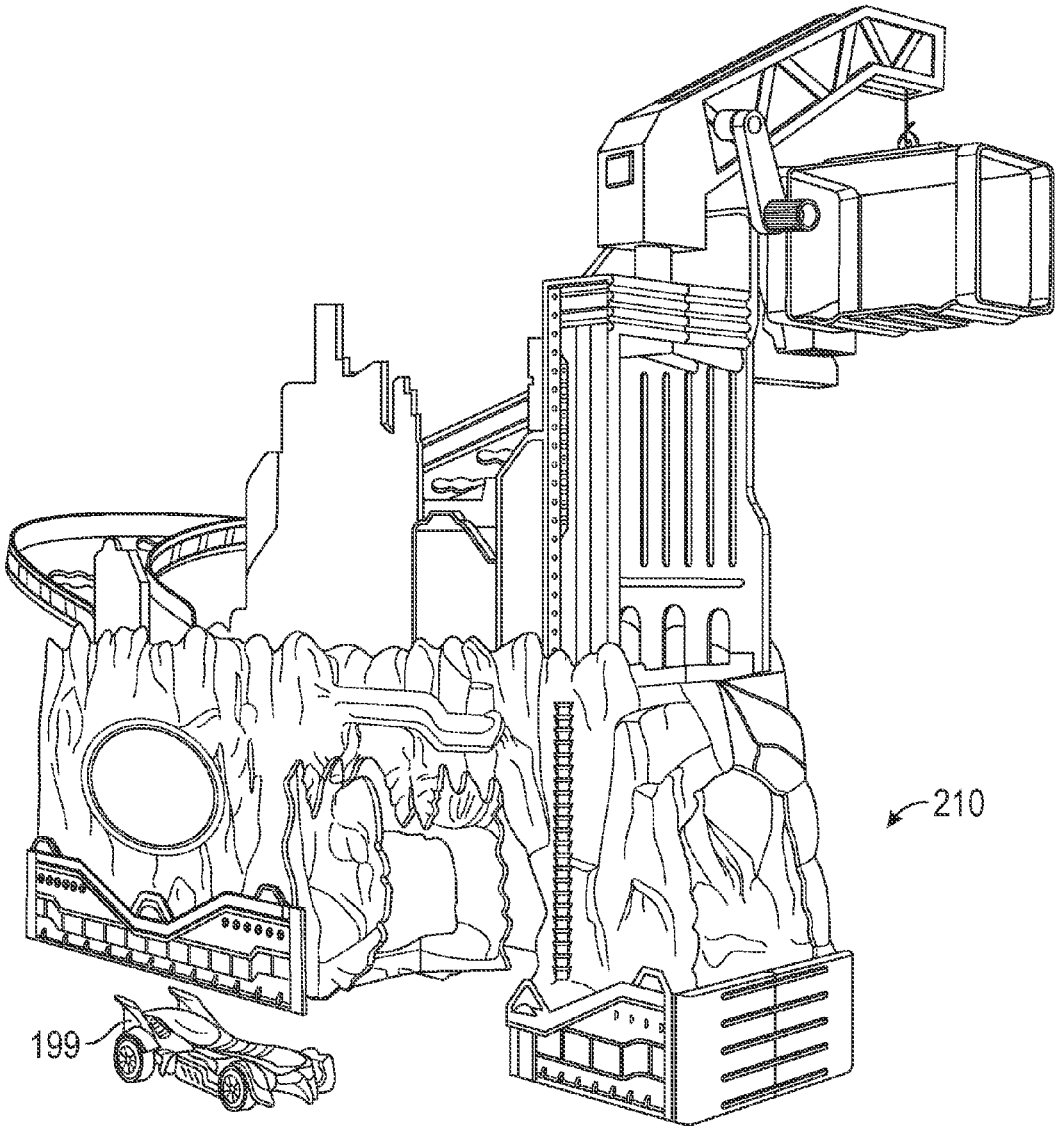
Figure 25I:
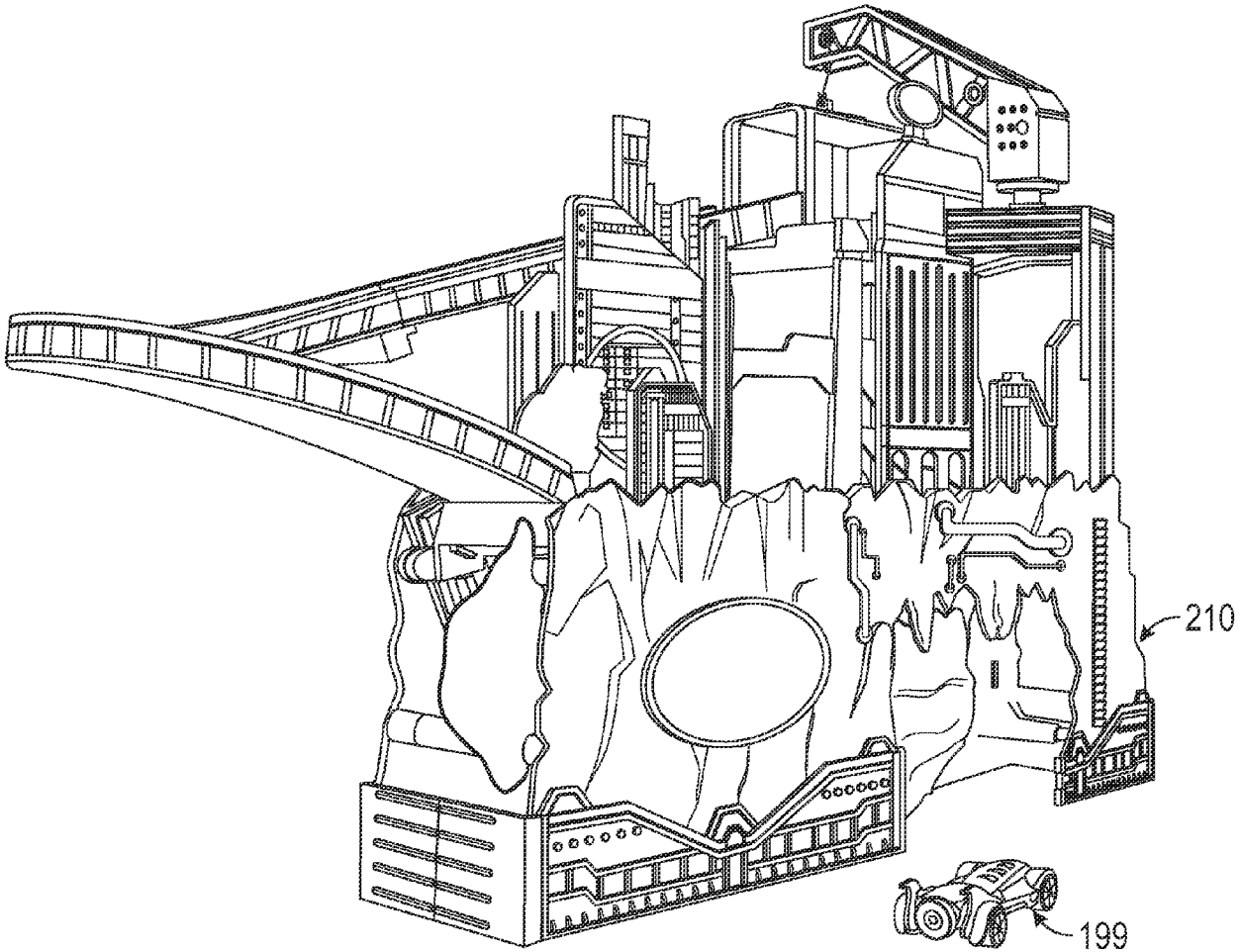
Figure 25J:
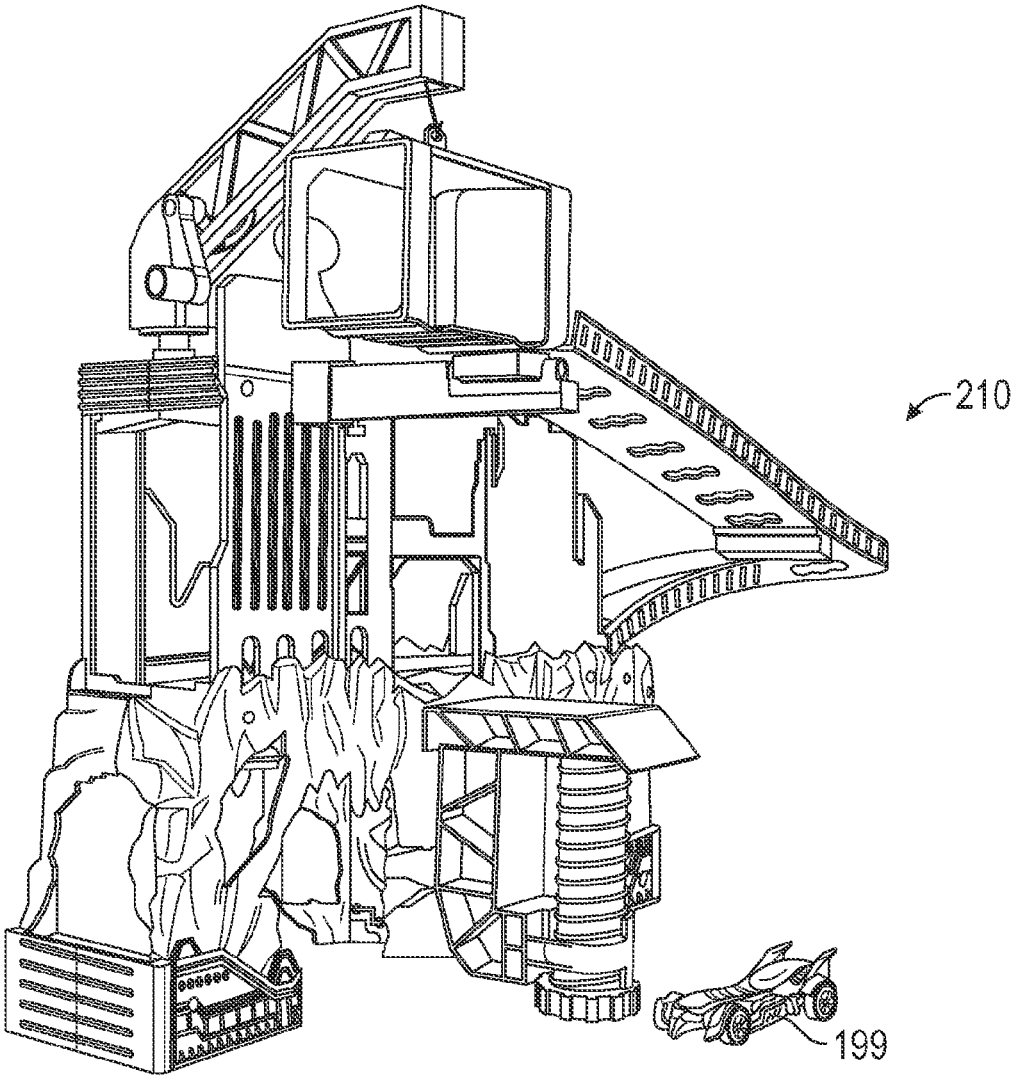
Figure 25K:
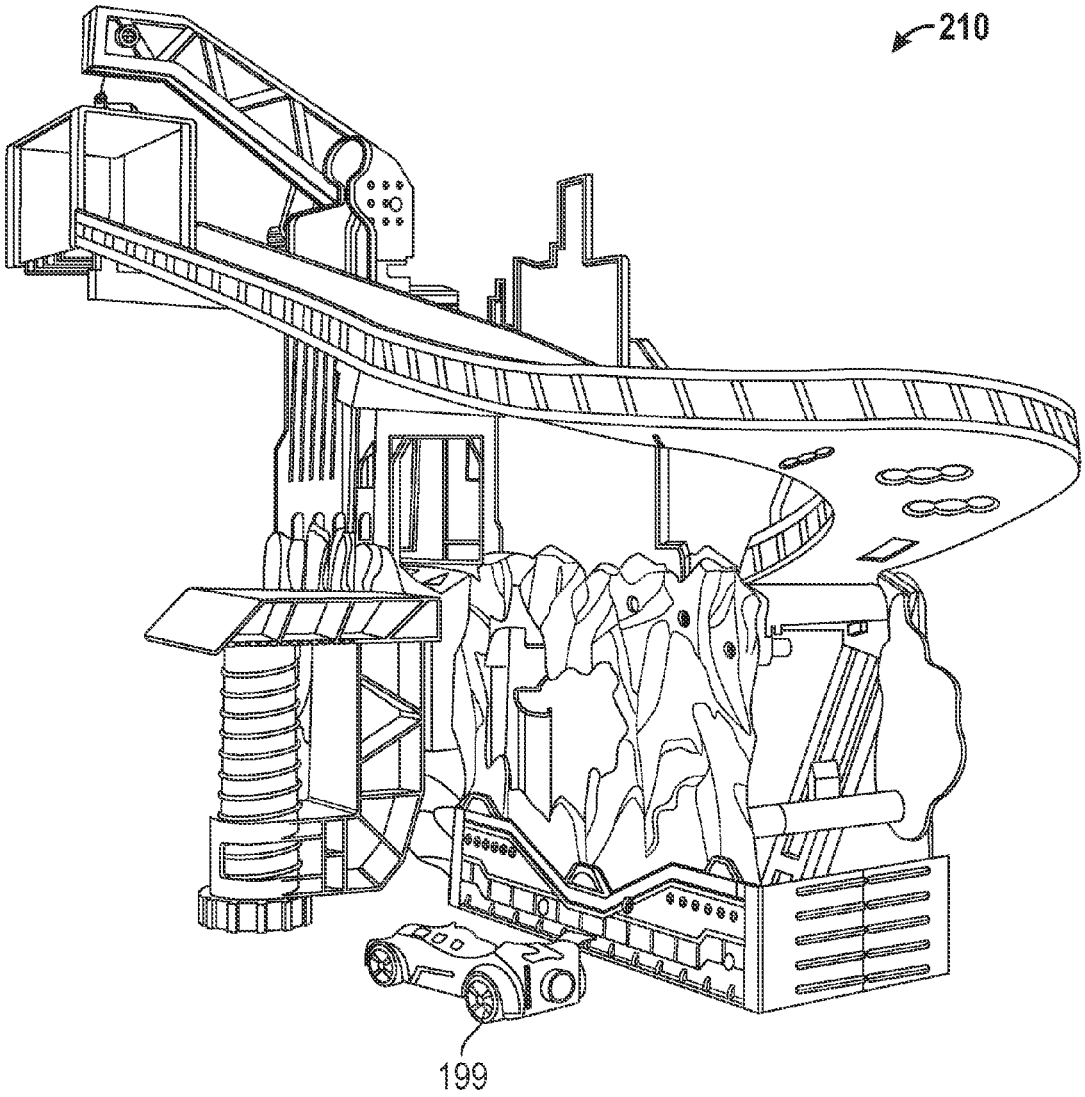
Figure 26A:
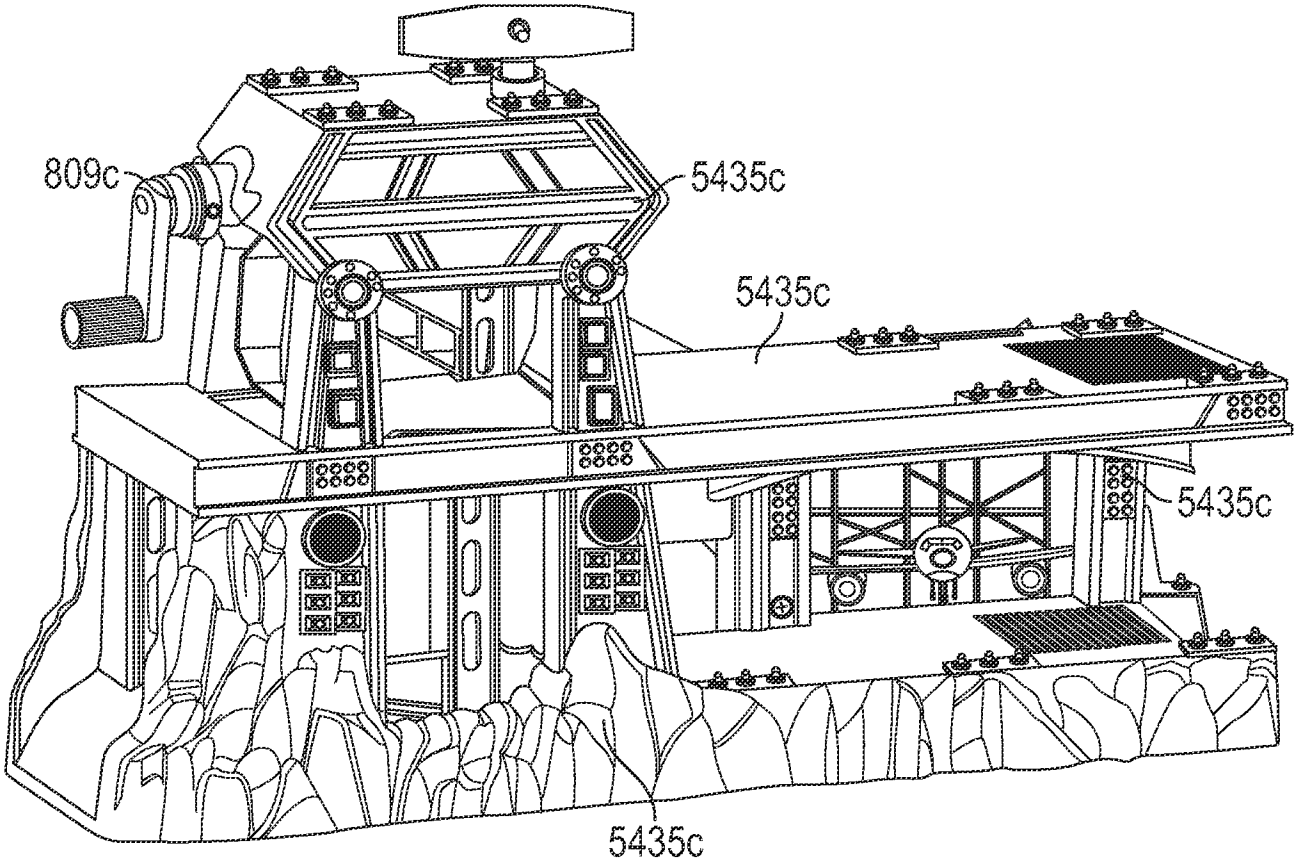
Figure 26B:
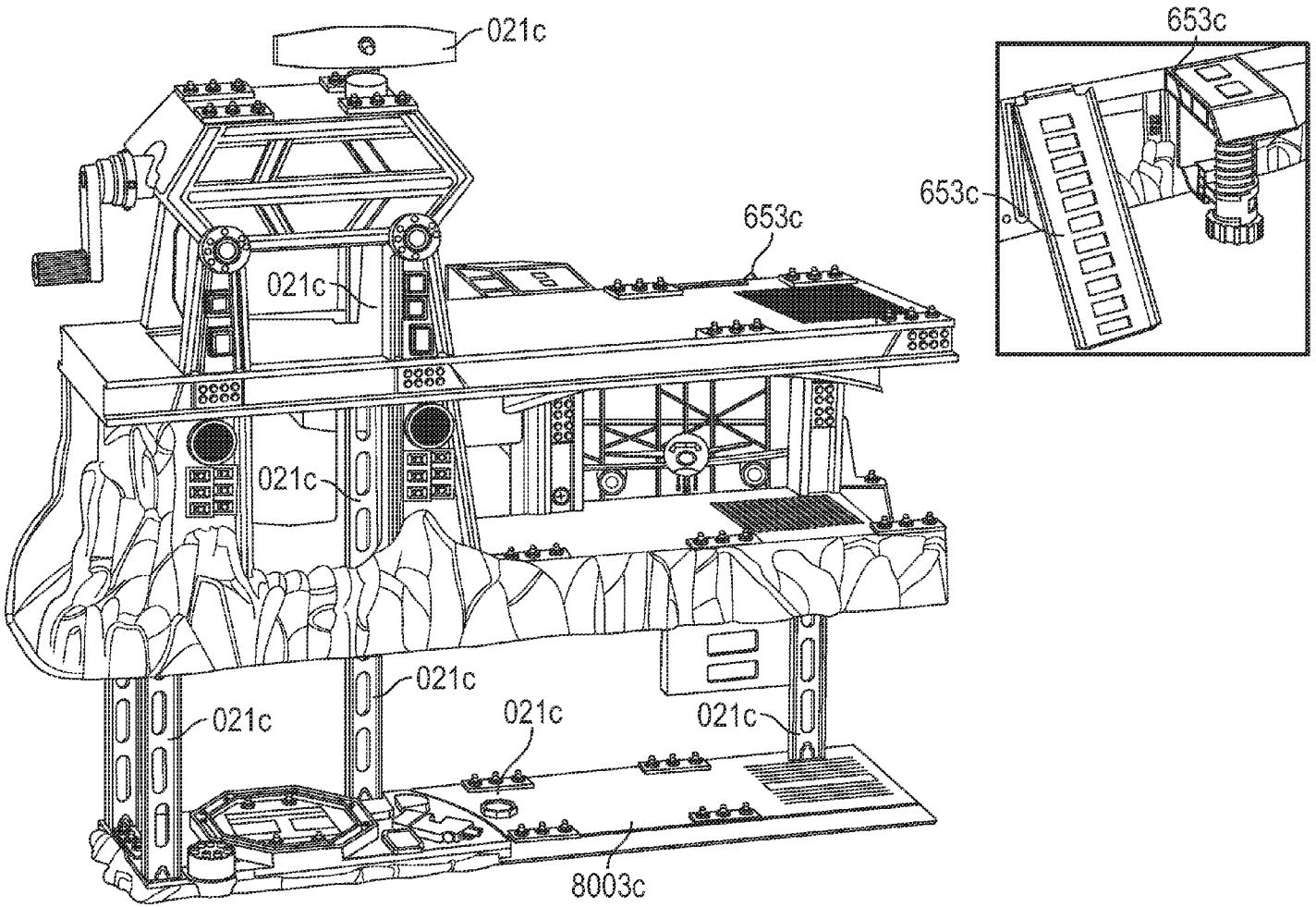
Figure 27A:
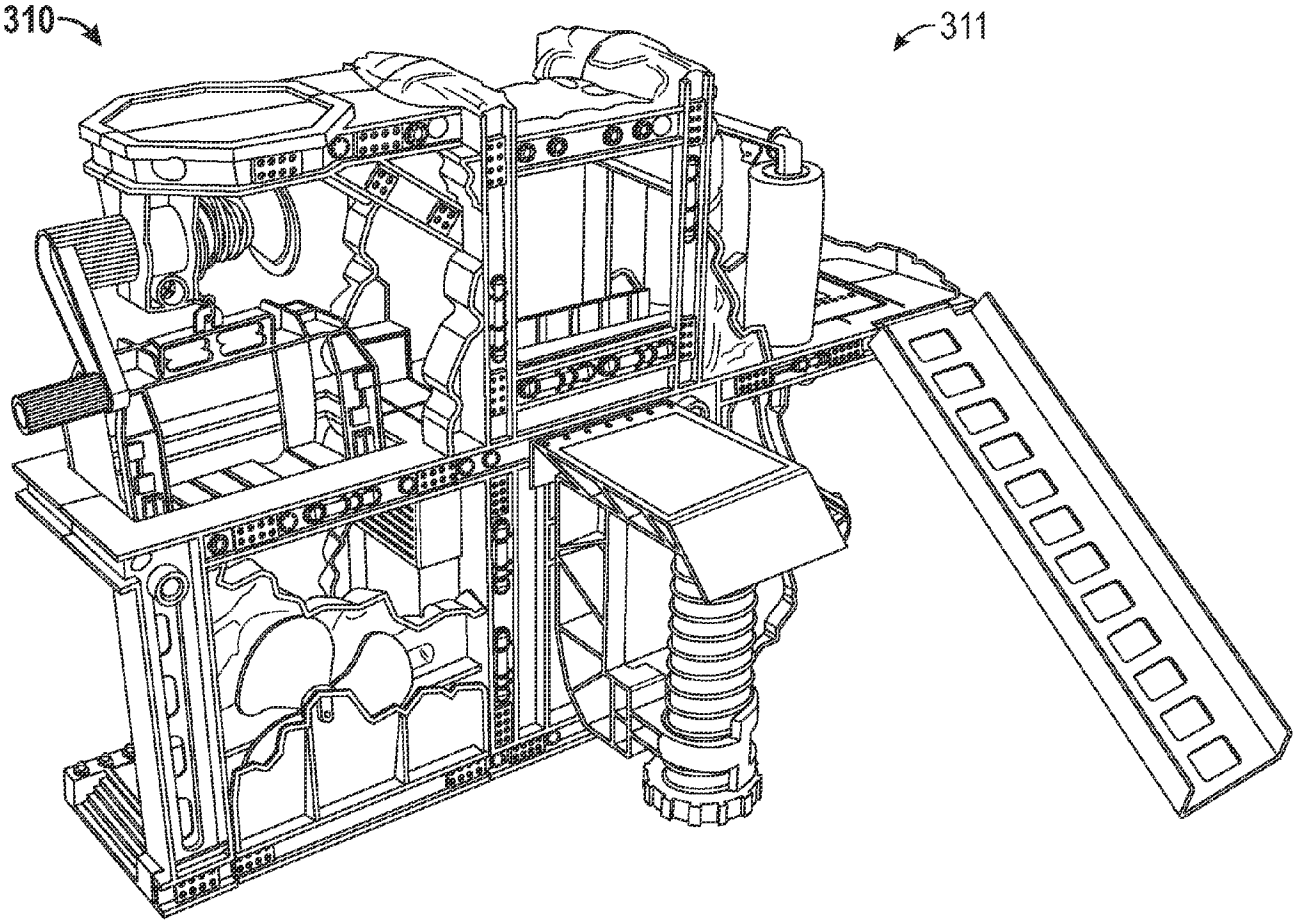
Figure 27B:
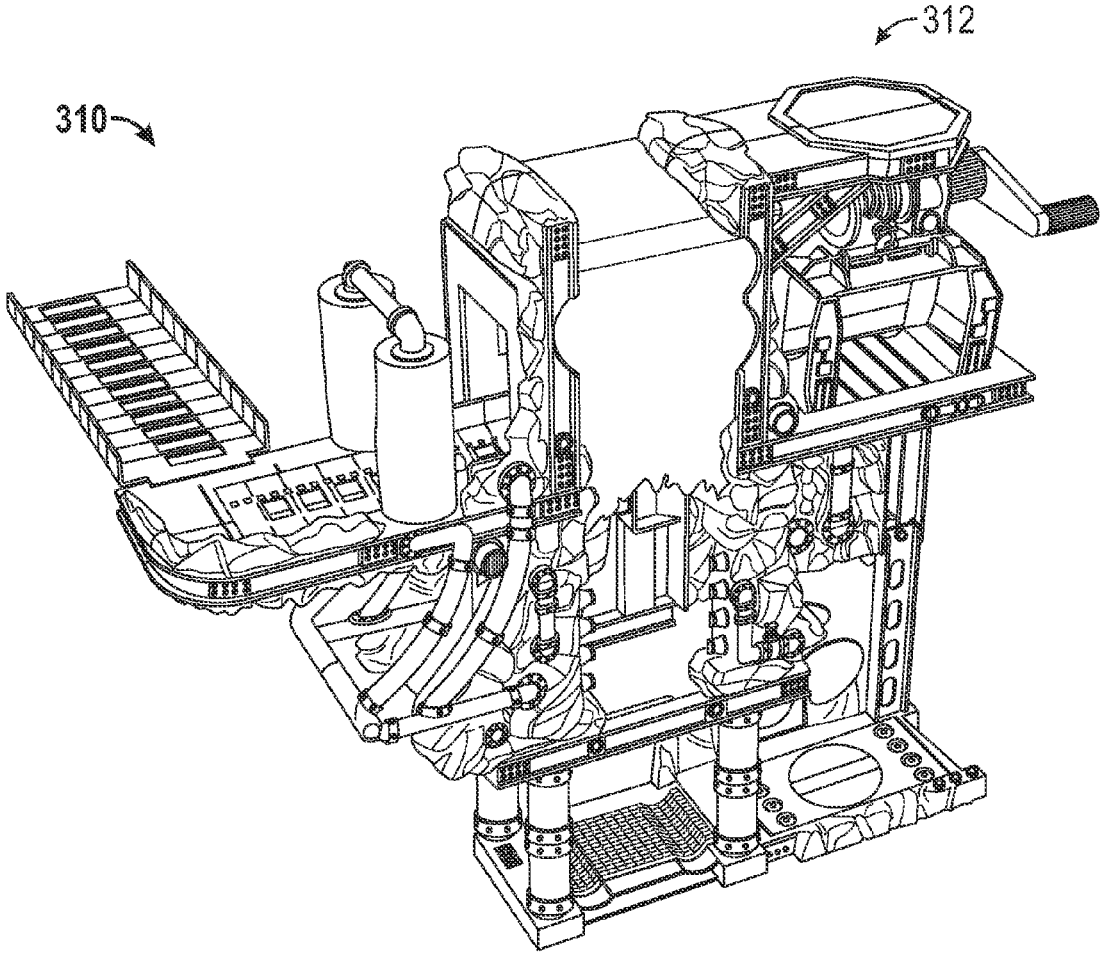
Figure 28A:
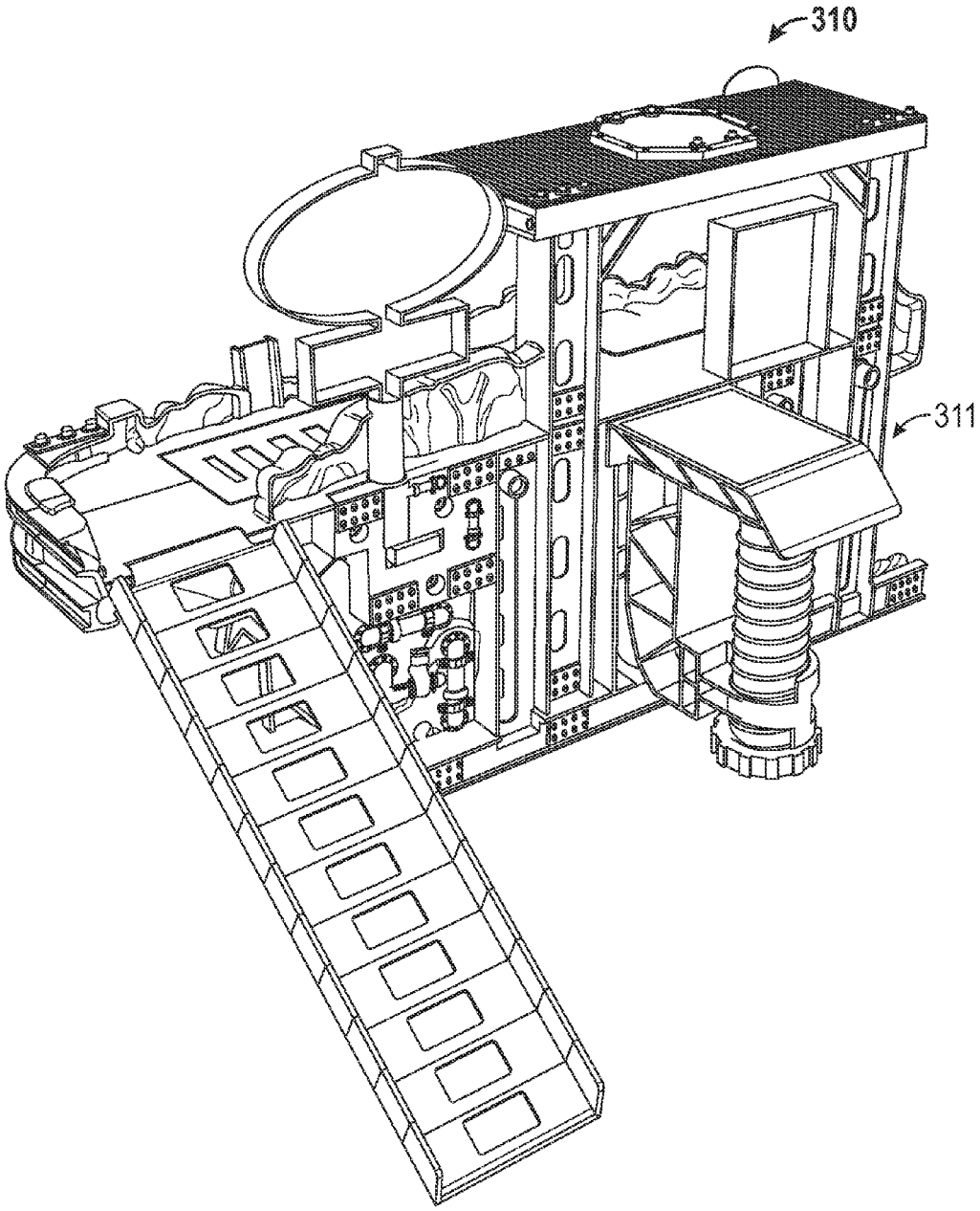
Figure 28B:
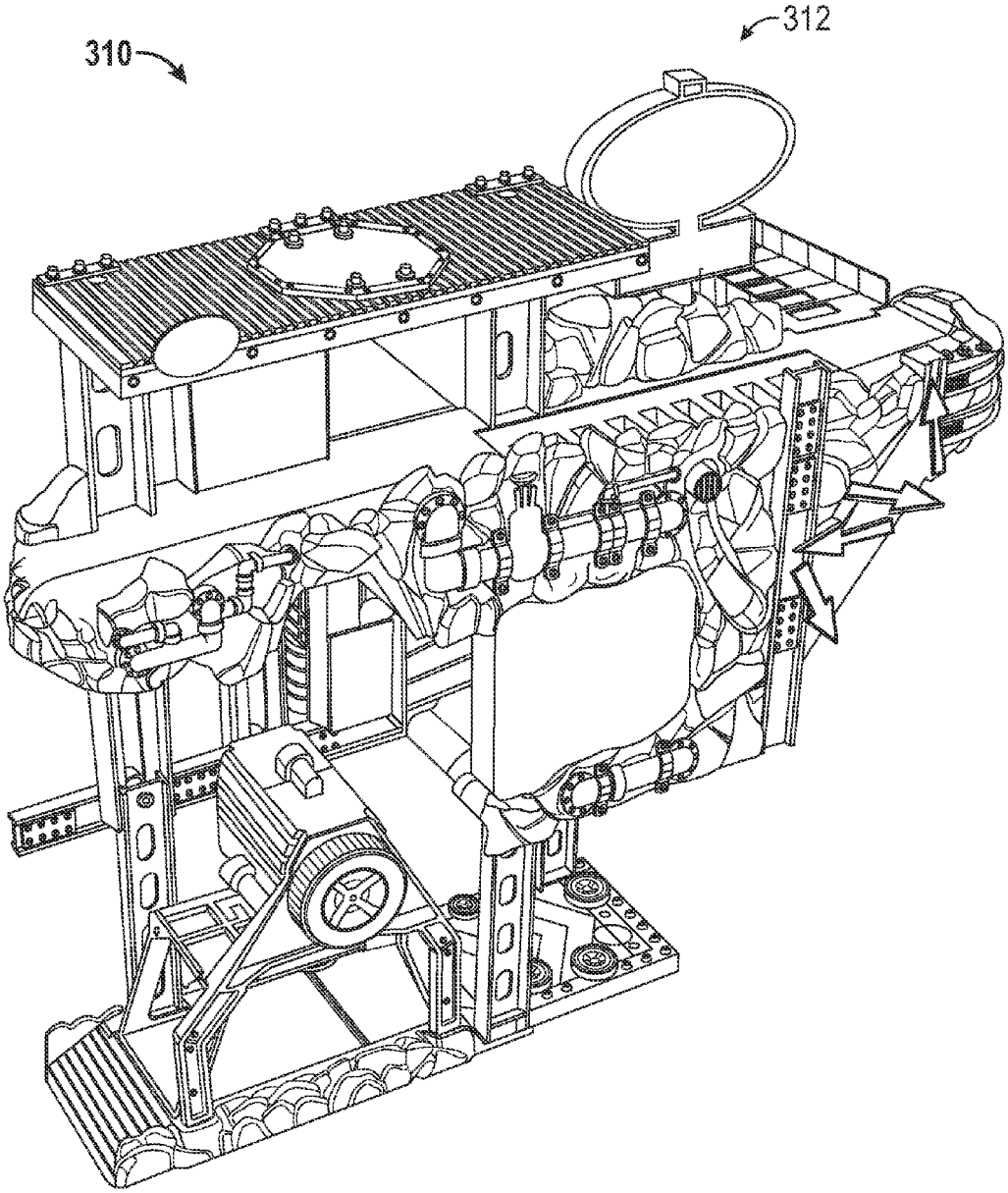
Figure 29A:
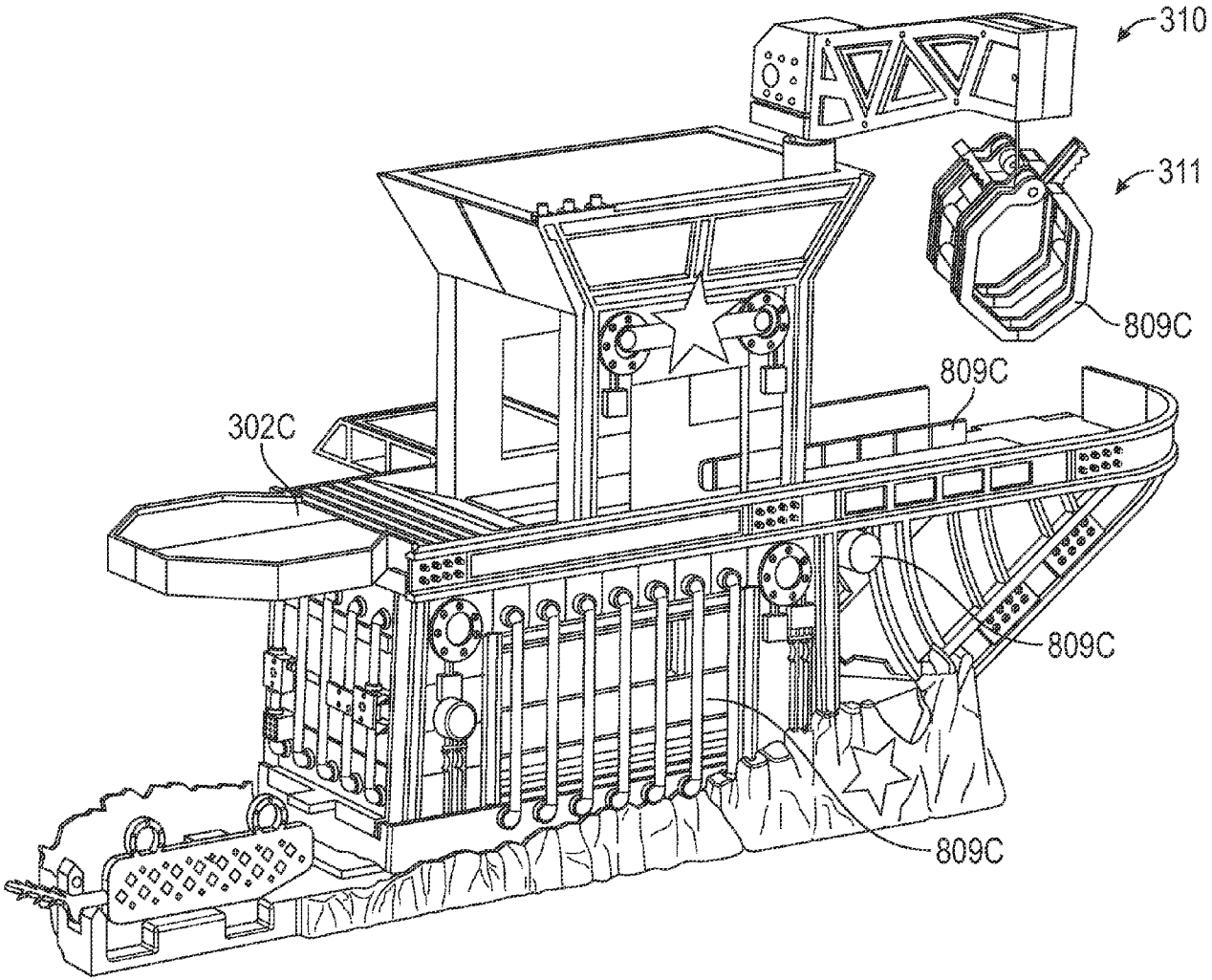
Figure 29B:
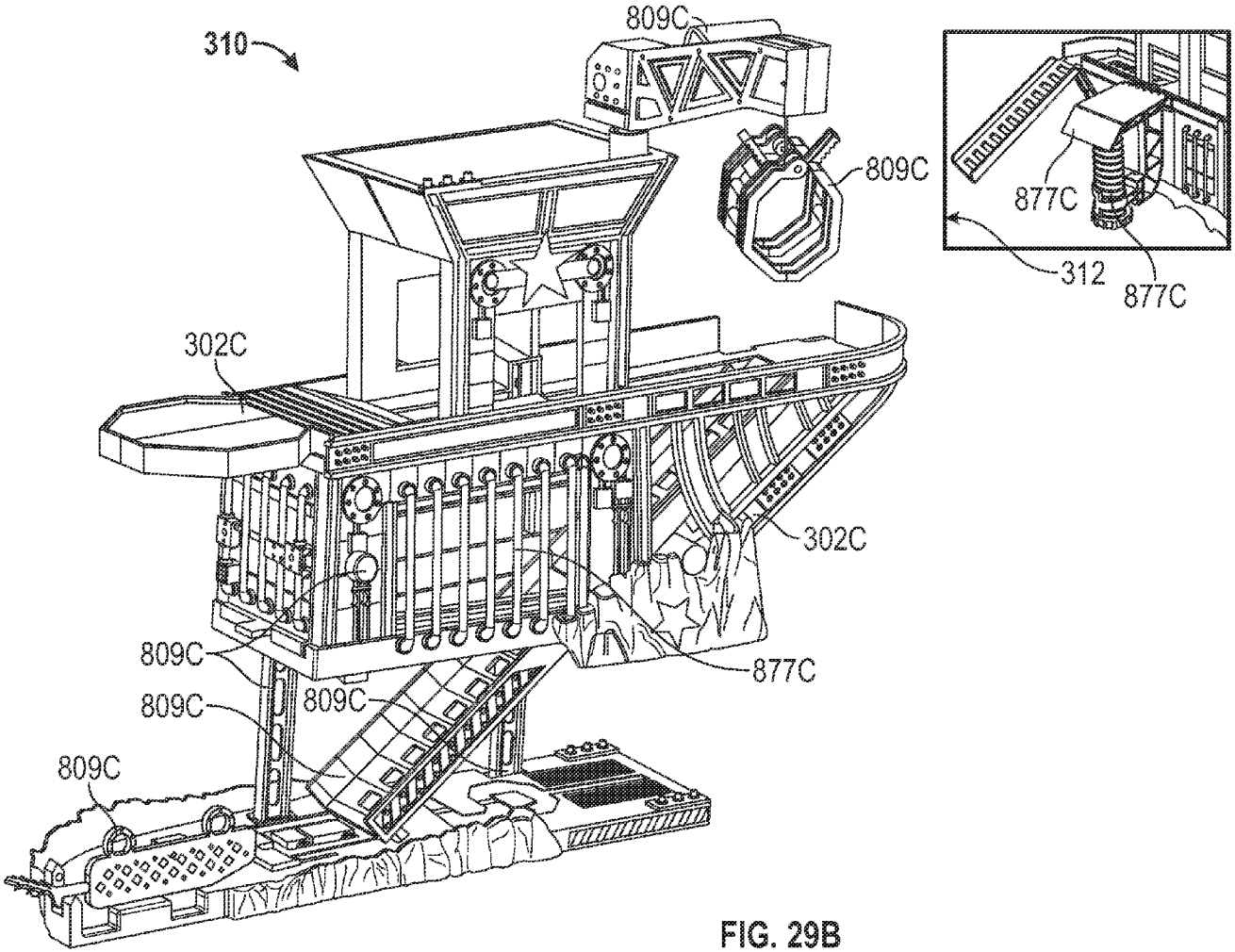

Referring now to FIGS. 22A-24C an alternative exemplary embodiment of the present invention is illustrated. Here playset 110 is reconfigurable from a first orientation 111 illustrated in FIGS. 22A-23B to a second orientation 112 (FIGS. 24A-24C). In the first orientation, the playset 110 has a plurality of levels 114, 116 and 118. In one embodiment, the playset 110 has a vehicle track path 120 which travels from a top-level 114 around an intermediary level 116 to a bottom level 118.

In accordance with an exemplary embodiment, the playset 110 is configured to be secured to an edge 176 of a surface 174 such as a tabletop. In order to secure the playset 110 to the surface 174, a clamping mechanism 130 is provided. In one non-limiting embodiment, clamping mechanism 130 has an adjustable screw 132 for securing the same to the edge 176 of the surface 174 by for example engaging the surface between the adjustable screw 132 and a flange portion 133 of the clamping mechanism. In the illustrated embodiment, a crane 134 is provided. Crane 134 is rotatably secured to playset 110 to allow for movement in the direction of arrows 136 also shown is a basket or cage 138 that can be raised or lowered via crane 134.

Referring now to FIGS. 24A-24C, the playset 110 is illustrated in the second orientation 112. As illustrated and when the playset 110 is in the second orientation, an inner section 140 comprising top-level 114 and intermediary level 116 are lowered with respect to bottom level 118. As the inner section 140 moves with respect to bottom level 118, top-level 114 is now lower than surface 174 as opposed to its position in the first orientation wherein the top-level 114 is above surface 174.

In addition and as the inner section 140 moves from the first orientation to the second orientation, another level 142 is defined below intermediary level 116 and an alternative vehicle track path 144 is provided. Level 142 is provided by a base member 146 that drops down from intermediary level 116 and a wall portion 148 that is pivotally secured to the base member 146 and pivots from an upright position to a horizontal position in the second orientation. In addition, portions of the alternative vehicle track path 144 are also provided by track segments 150, 152 and 154 which are pivotally secured to base member 146 and/or wall portion 148 such that alternative vehicle track path 144 can be defined as the playset 110 transitions from the first orientation to the second orientation.

In addition and in accordance with an exemplary embodiment, the playset 110 is provided with a slow release ratcheting mechanism 159, which provides a braking force to inner section 140 as a transitions transit with respect to lower level 118. In one non-limiting embodiment, the slow release ratcheting mechanism 159 comprises a rack 171 and gear arrangement or any other equivalent device that cooperates with a release mechanism, which when activated maintains the playset 110 in the first orientation by preventing movement of the rack and/or gear of the gear arrangement with respect to each other.

Accordingly, and in order to transition the playset from the first orientation to the second orientation the release mechanism has a trigger or switch 170 located in a portion of the vehicle path 120 located on the lower level 118 such that as a toy vehicle is traveling down this vehicle path it can contact trigger or switch 170 and release the release mechanism 159 so that the playset 110 can transition from the first orientation into the second orientation. Of course, other locations of trigger switch 170 are contemplated to be within the scope of various embodiments of the present invention. Once the trigger or switch 170 is actuated a catch or other release mechanism is actuated and a deployable portion(s) of the playset are now free to move away from another portion of the playset, which in one non-limiting embodiment is due to gravity forces acting upon the movable portion of the playset. Accordingly and once the trigger is actuated, the playset 410 transitions from first orientation to the second orientation. Thereafter and in order to transition the playset from the second orientation back into the first orientation, a user folds or moves wall portion 148 back into its vertical configuration along with pivotal movement of track sections 150, 152 and 154 such that base member 146 can be pushed upward back into its position corresponding to the first orientation of the playset. Once this is accomplished a user simply pushes the inner section 140 upwardly until the playset is in the first orientation and the slow release ratcheting mechanism 159 is reengaged such that trigger 170 must be activated again to allow the playset to transition back into the second orientation.

As illustrated in FIG. 24A, a portion of the alternative vehicle track path 144 has a gap wherein a vehicle a capturing device 172 is provided. In the illustrated embodiment, vehicle capturing device 172 resembles a creature such as the shark having a pair of pivotable jaw portions 174 and 176, at least one of which is movably mounted with respect to the other one such that the jaws can transition between an open position wherein a vehicle will pass through the jaws to a closed position wherein a vehicle traveling through the jaws is captured. Still further, and if a vehicle has successfully traveled past the vehicle capturing device 172 along vehicle track path 144, the vehicle will travel down track segment 152 into a track segment 156 integrally formed with wall portion 148. An end portion wall portion 180 of track segment 156 is movably mounted to a pivotally mounted member 182 such that movement of wall portion to one of several positions can provide alternative outcomes at the end of vehicle track path 144. In one outcome, movable mounted wall portion 180 and pivotally mounted member 182 causes a toy vehicle traveling thereon to be flipped off of the wall portion 148 in the direction of arrow 184 based upon the location of wall portion 180. Alternatively, the movable mounted wall member 180 can be reconfigured such that a toy vehicle traveling on track segment 156 will make contact with an actuation button 186 located on a surface of the vehicle capturing device 172 such that actuation of actuation button 186 causes the vehicle capturing device 172 (e.g., shark) to have its pivoting jaw members moved out of the gap in vehicle track path 144. Movement of the pivoting jaw members out of the gap in vehicle track path 144 will provide added play features in that, one embodiment will require the pivoting jaw members to be arranged in a vertical orientation with respect to the rest of the shark body in order to allow the playset 110 to transition from the second orientation 112 back into the first orientation 111.

In other words and in order to return the playset back to the original or first orientation 111, a user will have to complete the entire vehicle track path 144 and contact the actuation button 186 on the shark so that the playset can be reconfigured.

In addition, a portion of the vehicle track path is disposed on base level 118 and a movable gate 190 is pivotally mounted to the base level 118 for movement between a first blocking position, wherein vehicles traveling along the vehicle track on the base level 118 are prevented from contacting the trigger 170 of the slow release mechanism 159 and a second non-blocking position, wherein vehicles traveling along the vehicle track on the base level 118 can pass the movable gate 190 and contact the trigger 170.

Referring now to FIGS. 25A-25K an alternative exemplary embodiment of the present invention is illustrated. Here playset 210 is reconfigurable from a first orientation 211 illustrated at least in FIGS. 25A-25B to a second orientation 212 (illustrated at least in FIG. 25C). In the first orientation, a vehicle track path 220 defined by a track segment 222 causes a toy vehicle 199 to travel from a top-level 214 below an intermediary level 216 to a bottom level 218. In this configuration and when the toy vehicle travels into the bottom level 218 the vehicle will be received within a carriage 219 slidably received upon a guide 221 that slides from a first position 223 to a second position 225 in the direction of arrow 227 in response to the vehicle being received by the carriage. Simultaneously, this movement causes a portion 229 of the playset to pivot in a first direction 231 and thereafter a second portion 233 pivots in another direction 235 wherein a surface 237 is provided to receive the toy vehicle 199 from the carriage 219.

Alternatively, the playset 210 can be configured into the second orientation 212 wherein an alternative vehicle track path 240 is provided and vehicle track segment 222 is elevated in the direction of arrow 245 such that it now delivers the toy vehicle to the intermediary level 216. Similar to the previous embodiment, the playset 210 has a crane member 234 rotatably secured thereto. FIGS. 25D-25K illustrate various views of the playset in either of the first orientation 211 or the second orientation 212.

Referring now to FIGS. 25A-29B other alternative playsets 310 are illustrated in a first orientation 311 and a second orientation 312. As with previous embodiments each of the aforementioned playsets are configured to be secured to an edge of a surface such as a tabletop with a clamping mechanism. Thereafter, each of the playsets are capable of being manipulated between the first orientation in the second orientation while being secured the surface such that levels or surfaces of the playsets are adjusted either upwardly, downwardly or laterally with respect to the surface they are secured to.

Referring now to FIGS. 30A-32C other alternative playsets 410 are illustrated in a first orientation 411 and a second orientation 412. As with previous embodiments each of the aforementioned playsets are configured to be secured to an edge of a surface such as a tabletop with a clamping mechanism 430. Thereafter, each of the playsets are capable of being manipulated between the first orientation 411 and the second orientation 412 while being secured the surface such that levels or surfaces of the playsets are adjusted either upwardly, downwardly or laterally with respect to the surface they are secured to.

Figure 30A:
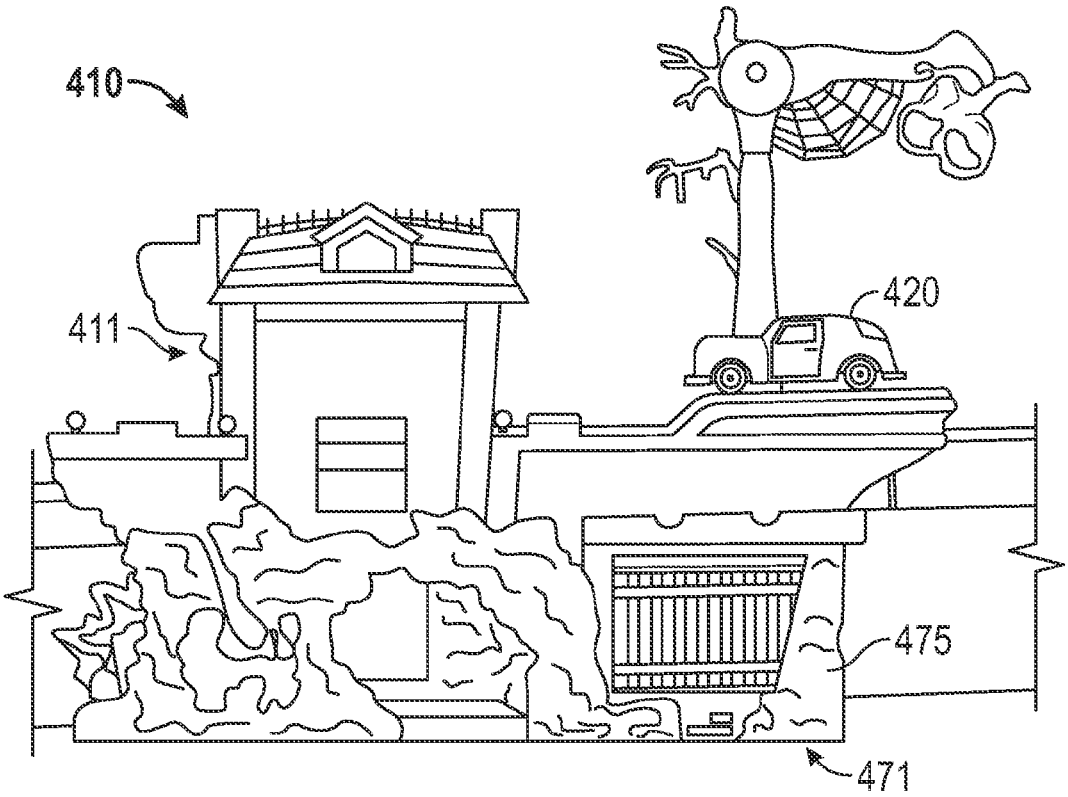
FIGS. 30A-32C illustrate various views of still other alternative exemplary embodiments of the present invention.
Figure 30B:
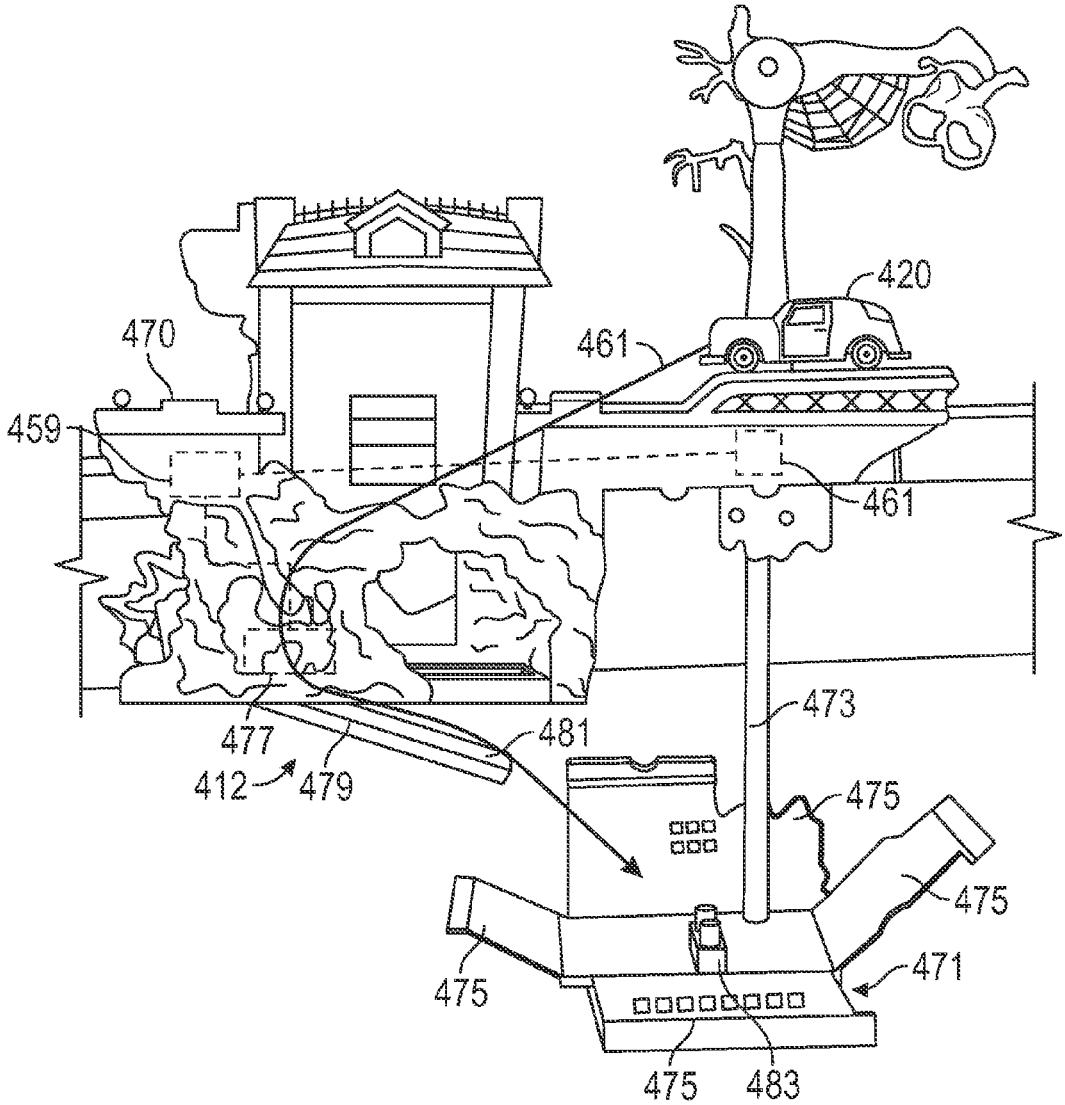
Figure 30C:
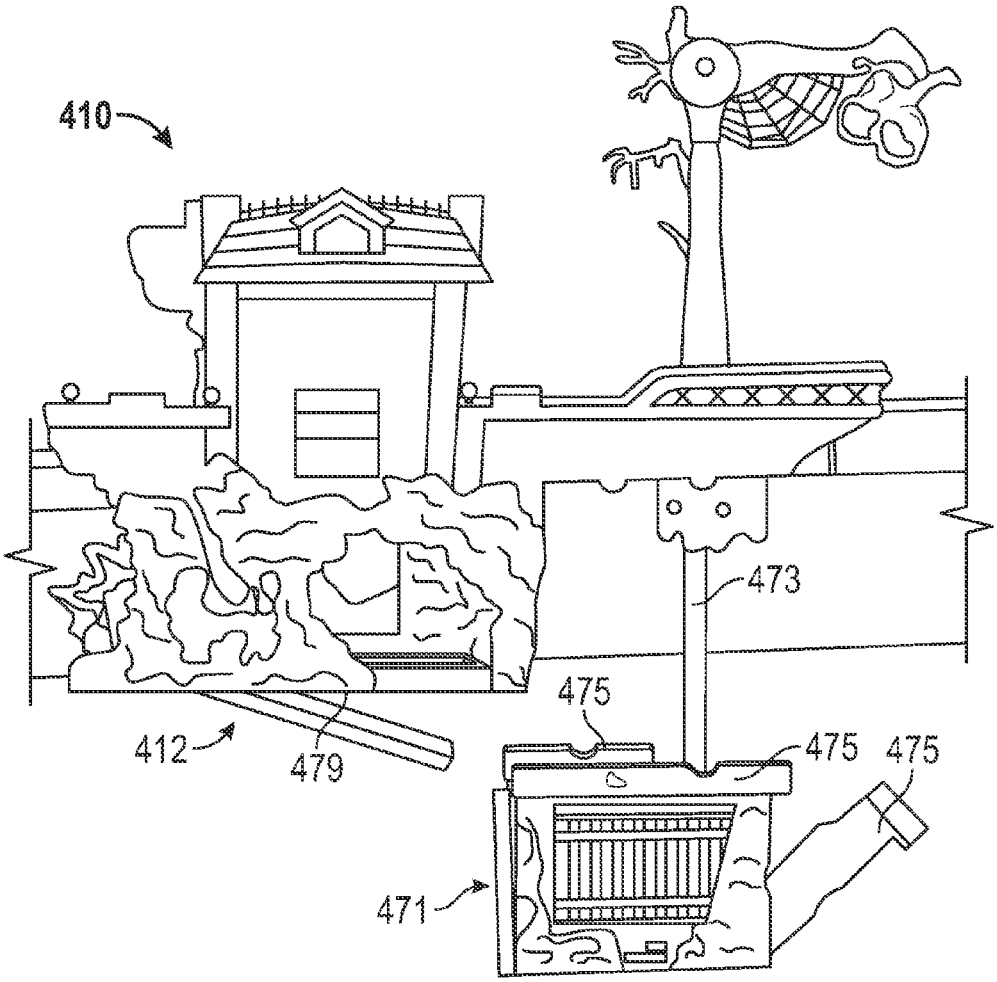
Figure 31A:
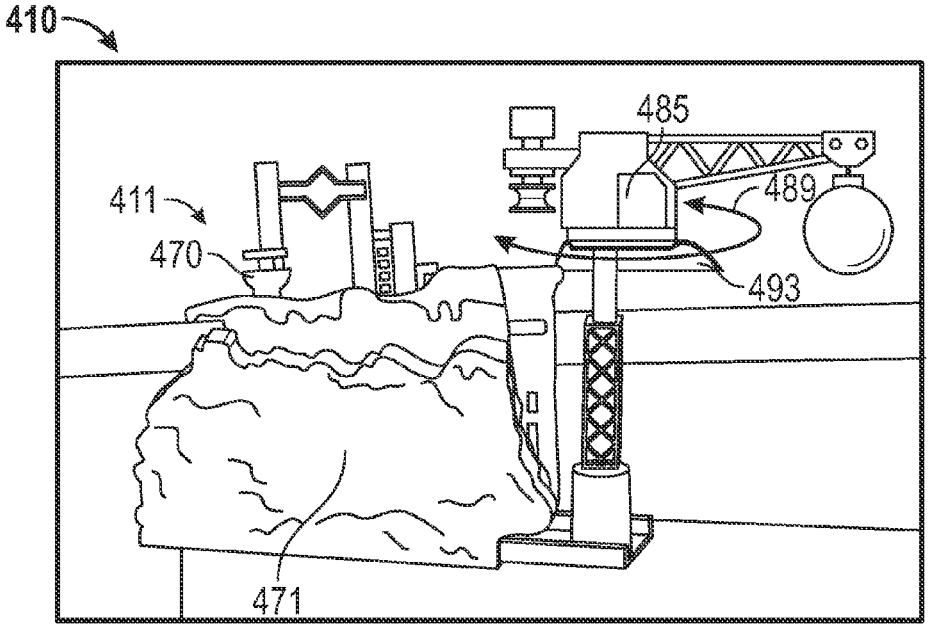
Figure 31B:
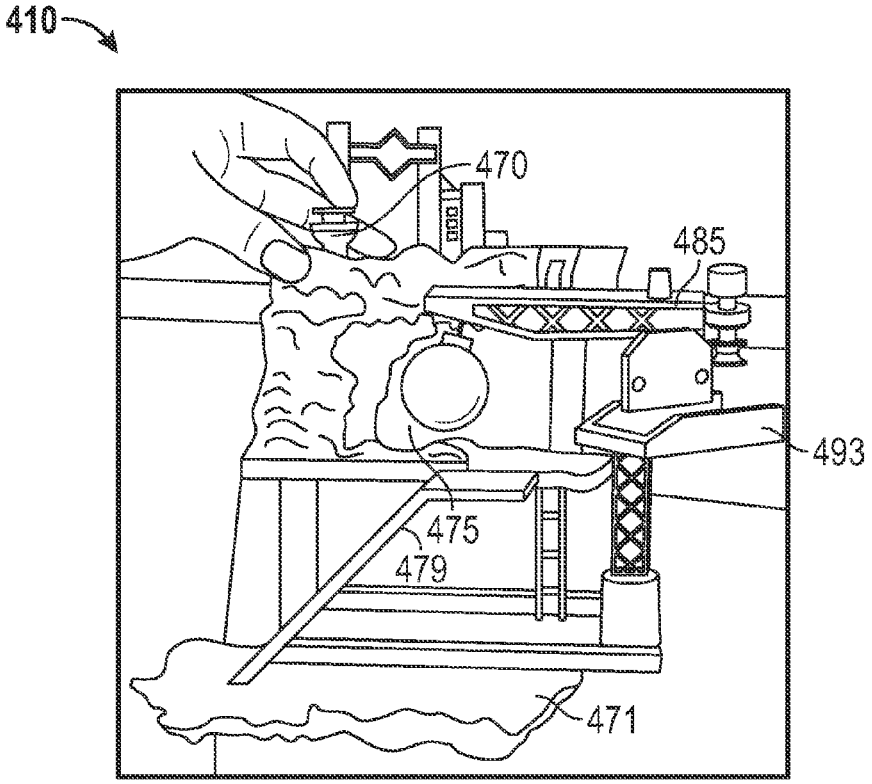
Figure 31C:
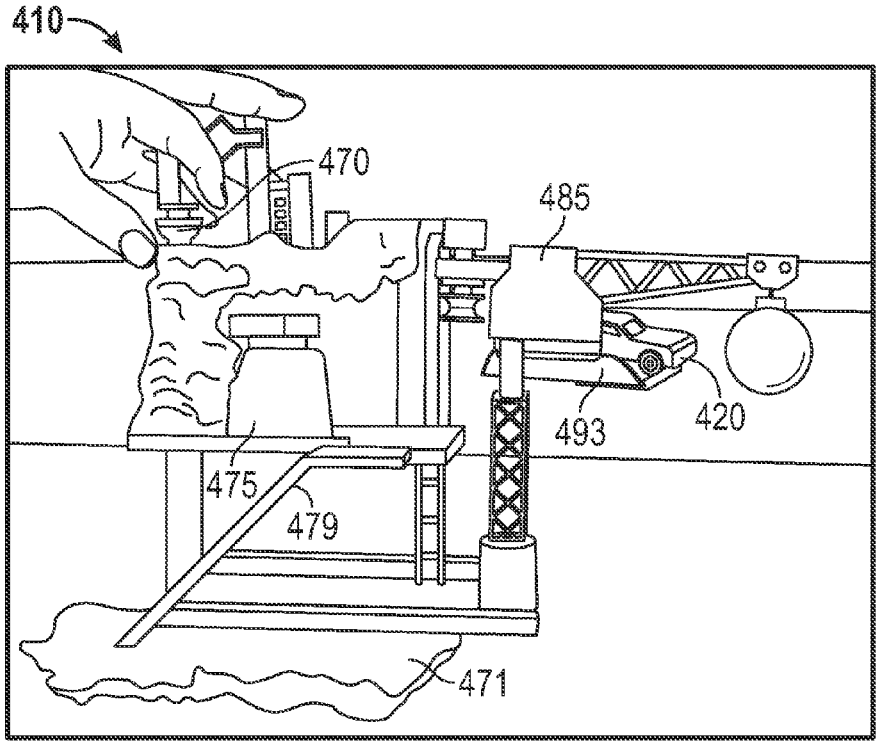
Figure 31D:
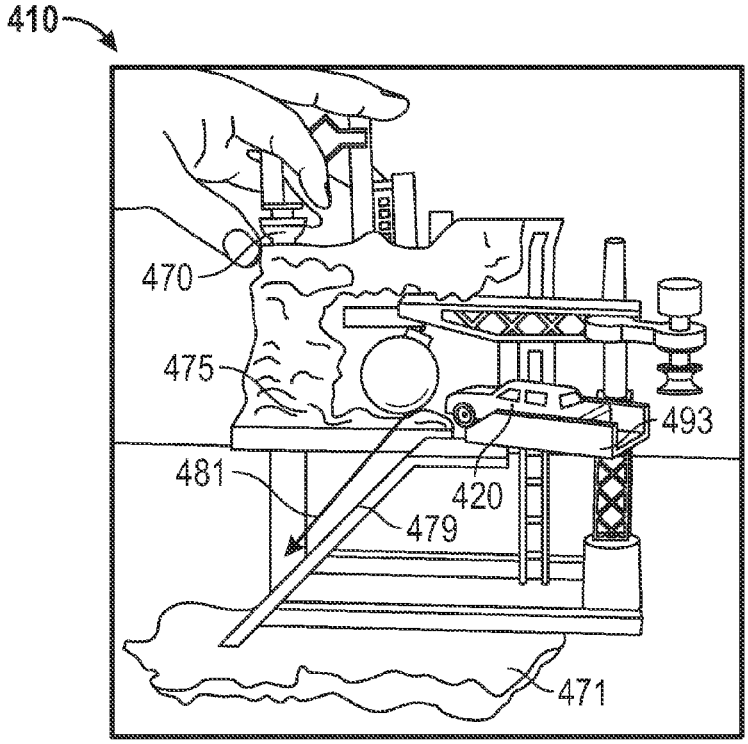

For example and referring now to FIGS. 30A-30C and as in some of the previous embodiments, a release mechanism 459 has a trigger or switch 470 coupled thereto wherein actuation of the release mechanism 459 causes the playset 410 to transition from the first orientation 411 into the second orientation 412 by for example, releasing a catch 461 that releasably holds a deployable portion 471 of the playset 110 in the first orientation 411. Once the deployable portion 471 is released gravity forces cause it to move from the first orientation 411 to the second orientation 412. In this embodiment the deployable portion slides downwardly with a shaft or rod 473 such that deployable portion 471 is lower than other portions of the playset 410. As the deployable portion moves from the first orientation 411 to the second orientation, a plurality of sidewalls 475 pivotally secured to the deployable portion 471 transition from a closed position (FIG. 30A) to an open position (FIGS. 30B and 30C).

In addition and when the trigger or switch 470 is actuated another catch 477 is actuated such that a pivotally mounted ramp 479 can transition from a first closed position (FIG. 30A) to a second open position (FIGS. 30B and 30C). Again, this is achieved by gravity forces although alternative embodiments contemplate spring biased mechanism or equivalents thereof. Once in the open position the ramp 479 provides a portion of a path 481 an object or toy vehicle 420 can travel down. In one embodiment and once the car or object 420 travels down path 481 and onto deployable portion 471 an actuator 483 coupled to sidewalls 475 causes them to transition from an open position (FIG. 30B) to a closed position (FIG. 30C). Movement of the side walls 475 may be achieved by any mechanism known to those skilled in the related arts for example a linkage coupling actuator 483 to side walls 475 or a spring biased mechanism that releases potential energy once actuator 483 is manipulated by car or object 420 making contact with the same.

FIGS. 31A-31D illustrate yet another alternative embodiment wherein a release mechanism 459 has a trigger or switch 470 coupled thereto wherein actuation of the trigger or switch 470 causes the release mechanism 459 of the playset 410 to transition from the first orientation 411 into the second orientation 412 by for example, releasing a catch 461 that releasably holds a deployable portion 471 of the playset 110 in the first orientation 411. Once the deployable portion 471 is released it pivots to an open position illustrated in FIGS. 31B-31D and a ramp 479 pivotally mounted to the playset 410 moves downwardly and defines a portion of a path 481 the toy vehicle or object 420 can travel on. In this embodiment, the playset 410 further comprises a item 485 pivotally mounted to a shaft or member 487 such that once the playset 410 is moved into the second orientation 412 the item 485 oscillates back and forth in the direction of arrows 489 due to item 485 being configured to travel down a serpentine path or groove 491 of the shaft or member 487. The item 485 will be movably mounted to the shaft 487 via a collar or other equivalent member having a protrusion configured to engage the serpentine path or shaft 487 such that as gravity pulls the item downwardly, the slidable engagement of the protrusion with groove 491 causes the item 485 to oscillate back and forth.

In one non-limiting embodiment, the item 485 is configured to resemble a crane and has a tray 493 configured to receive the car or object 420 thereon. As illustrated, the tray 493 oscillates back and forth with the body of item 485 until it travels from an elevated position in FIG. 31A to the deployed or lower position in FIG. 31D. Once the item 485 is in the deployed or lower position, the tray 493 is aligned with ramp member 479. In this embodiment, the playset 410 also has a collapsible wall member 475 that is capable of moving from an upright position in FIG. 31C to a knocked down position in FIG. 31D when the crane or item 485 is moved into the lower position. Accordingly and as the crane oscillates back in forth in the direction or arrows 489, a portion of the crane makes contact with the pivotally mounted wall member 475 and knocks it down. At the same time, the tray 493 is in a position to drop a toy car 420 down ramp 479, which comprises a portion of path 381.

Figure 32A:
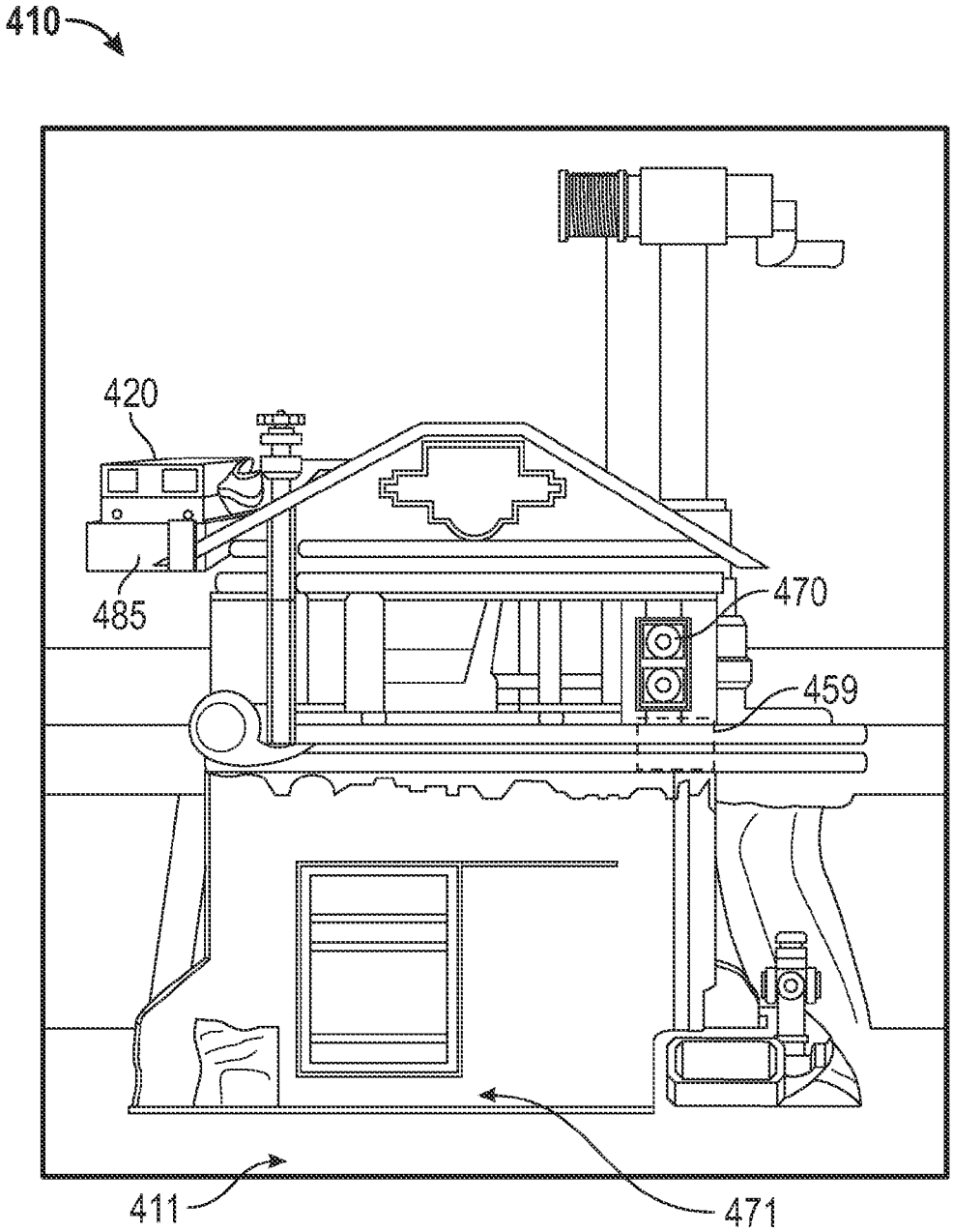
Figure 32B:
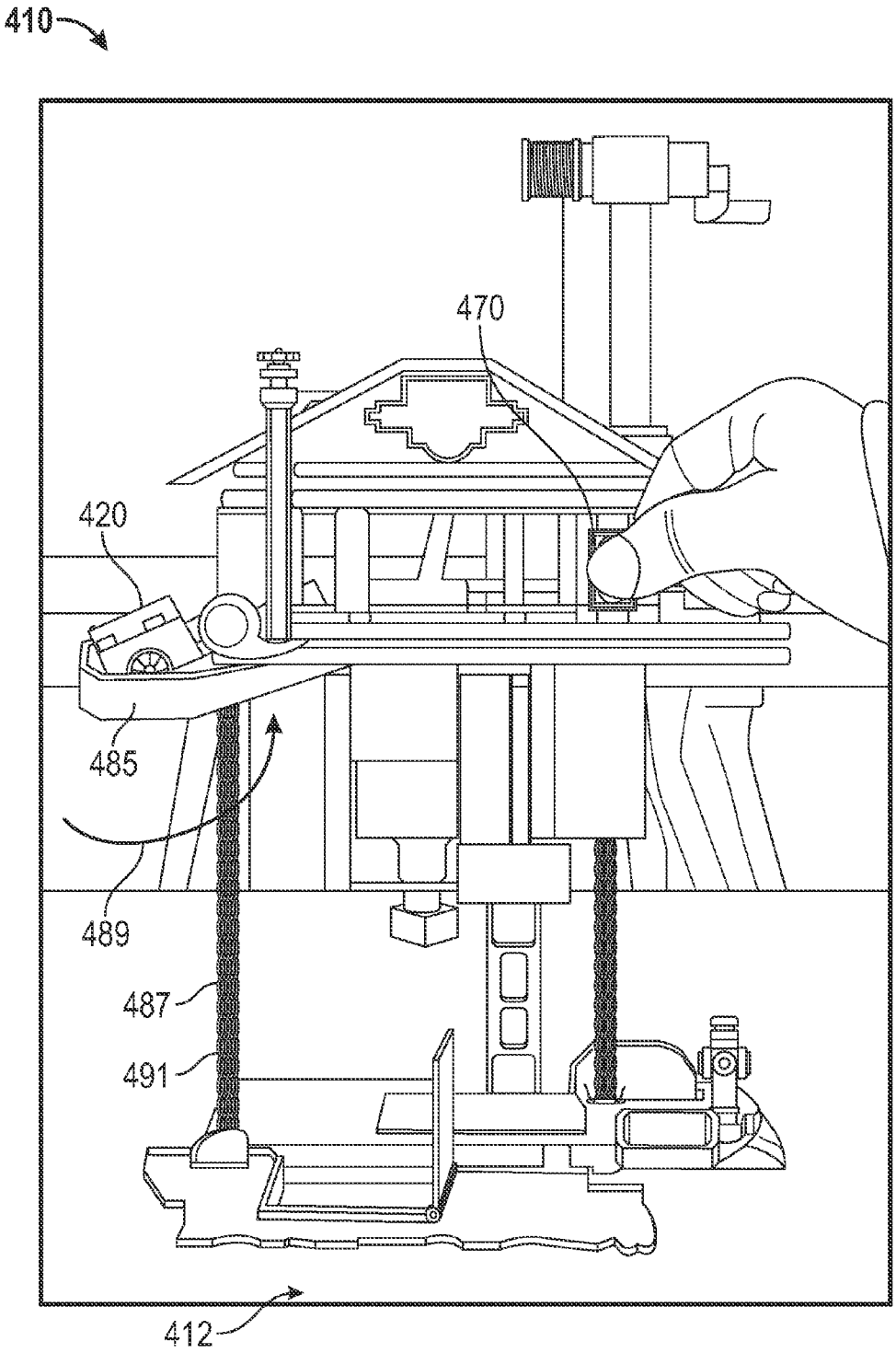
Figure 32C:
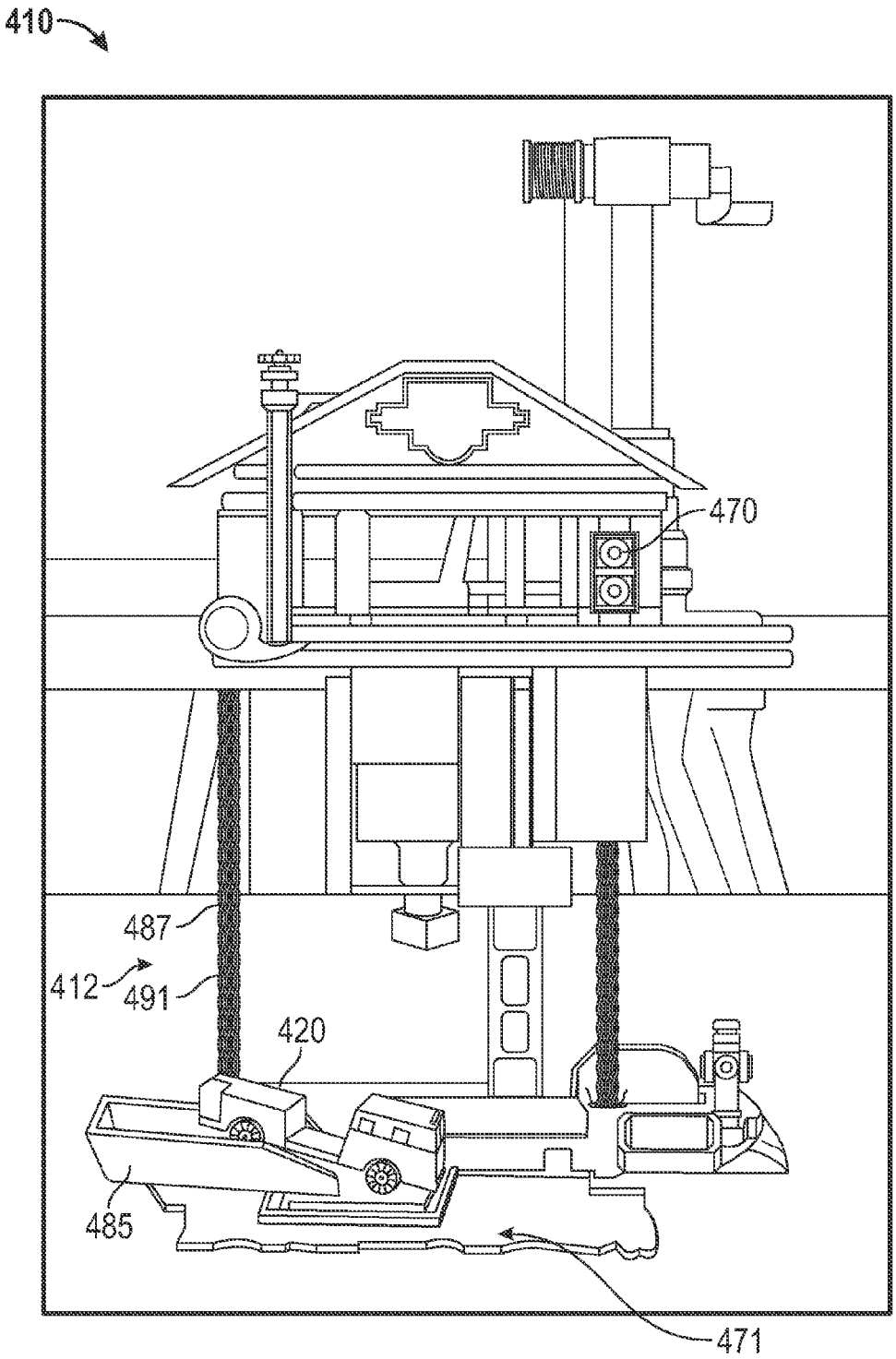

FIGS. 32A-32C illustrate still yet another alternative embodiment wherein a release mechanism 459 has a trigger or switch 470 coupled thereto wherein actuation of the trigger or switch 470 causes the release mechanism 459 of the playset 410 to transition from the first orientation 411 into the second orientation 412 by for example, releasing a catch 461 that releasably holds a deployable portion 471 of the playset 110 in the first orientation 411. Once the deployable portion 471 is released it drops downwardly due to gravity and pivots to an open position illustrated in FIGS. 32B-32C. In this embodiment, the playset 410 further comprises a item 485 rotatably mounted to a shaft or member 487 such that once the playset 410 is moved into the second orientation 412 the item 485 rotates in the direction of arrow 489 due to item 485 being configured to travel down a circular path or groove 491 of the shaft or member 487. The item 485 will be movably secured to the shaft 487 via a collar or other equivalent member having a protrusion configured to engage the groove or path or shaft 491.

In one non-limiting embodiment, the item 485 is configured to resemble a tray 493 configured to receive the car or object 420 thereon. As illustrated, the tray 493 rotates about pole 487 until it travels from an elevated position in FIG. 32A to the deployed or lower position in FIG. 32D. Once the item 485 is in the deployed or lower position, the tray 493 is aligned a lower portion of the playset, which is shown in the deployed configuration.

Although a preferred embodiment of this invention has been disclosed, one of ordinary skill in this art would recognize that certain modifications would come within the scope of this invention and it is not intended that these embodiments illustrate and describe all possible forms of the invention. Rather, the words used in the specification are words of description rather than limitation, and it is understood that various changes may be made without departing from the spirit and scope of the invention. For that reason, the following claims should be studied to determine the true scope and content of this invention.

What is claimed is:

1. A playset comprising:

a structure having a first level and a second level, the second level being located above the first level;

a mechanism secured to the structure for moving an object from the first level to the second level; and a collapsible third level located below the first level, the collapsible third level being configured for movement between a contracted position and an expanded position with respect to the first level, wherein a portion of the first level is configured to support the structure on an edge of an elevated surface such that collapsible third level is capable of being moved into the expanded position.

2. The play set as in claim 1, wherein the mechanism is a platform pivotally secured to the structure for movement between a first position wherein an edge of the platform is adjacent to the first level and a second position wherein another edge of the platform is adjacent to the second level.

3. The play set as in claim 1, wherein the mechanism is an elevator movably secured to the structure for movement between a first position wherein a floor of the elevator is flush with a floor of the first level and a second position wherein the floor of the elevator is flush with a floor of the second level.

4. The play set as in claim 1, wherein the mechanism is a retractable claw member configured to be mounted on the structure in a plurality of locations.

5. The play set as in claim 1, wherein the mechanism is a platform rotationally mounted to a pole member secured to the structure, wherein the platform is configured for movement between a first position wherein an edge of the platform is adjacent to a roof of the second level and a second position wherein another edge of the platform is adjacent to the first level and wherein the platform moves vertically with respect to the pole member as it rotates about the pole member from the first position to the second position.

6. The play set as in claim 1, wherein the mechanism is an elevator movably secured to the structure for movement between a first position wherein a floor of the elevator is flush with a floor of the first level, a second position wherein the floor of the elevator is flush with a floor of the second level and a third position wherein the floor the elevator is flush with a roof of the second level.

7. The play set as in claim 1, wherein the third level moves to the expanded position when an actuation button located on the first level is manipulated.

8. The play set as in claim 1, further comprising a ramp member that extends from the first level to the third level when the third level is in the expanded position.

9. The play set as in claim 1, wherein the playset further comprises an extendable platform that rotates from the third level when the third level is in the expanded position.

10. The play set as in claim 1, wherein the playset further comprises a ramp member that is pivotally mounted to only the third level at one end and is configured for movement between a first position wherein the ramp member is flush with a floor of the third level and a second position wherein a portion of the ramp member is located below the floor of the third level.

11. The play set as in claim 1, wherein the mechanism is plurality of mechanisms and one of the plurality of mechanisms is a platform pivotally secured to the structure for movement between a first position wherein an edge of the platform is adjacent to the first level and a second position wherein another edge of the platform is adjacent to the second level and another one of the plurality of mechanisms is an elevator movably secured to the structure for movement between a first position wherein a floor of the elevator is flush with a floor of the first level and a second position wherein the floor of the elevator is flush with a floor of the second level and another one of the plurality of mechanisms is a retractable claw member configured to be mounted on the structure in a plurality of locations and another one of the plurality of mechanisms is a platform rotationally mounted to a pole member secured to the structure, wherein the platform is configured for movement between a first position wherein an edge of the platform is adjacent to a roof of the second level and a second position wherein another edge of the platform is adjacent to the first level and wherein the platform moves vertically with respect to the pole member as it rotates about the pole member from the first position to the second position.

12. The play set as in claim 1, wherein the third level moves to the expanded position when an actuation button located on the first level is manipulated and the playset further comprises a ramp member that automatically extends from the first level to the third level when the third level moves to the expanded position through manipulation of the actuation button.

13. The play set as in claim 12, wherein the playset further comprises an extendable platform that rotates from the third level when the third level is in the expanded position.

14. The play set as in claim 12, wherein the playset further comprises a ramp member that is pivotally mounted to only the third level at one end and is configured for movement between a first position wherein the ramp member is flush with a floor of the third level and a second position wherein a portion of the ramp member is located below the floor of the third level.

15. The play set as in claim 12, wherein the mechanism is plurality of mechanisms and one of the plurality of mechanisms is a platform pivotally secured to the structure for movement between a first position wherein an edge of the platform is adjacent to the first level and a second position wherein another edge of the platform is adjacent to the second level and another one of the plurality of mechanisms is an elevator movably secured to the structure for movement between a first position wherein a floor of the elevator is flush with a floor of the first level and a second position wherein the floor of the elevator is flush with a floor of the second level and a third position wherein the floor of the elevator is flush with a roof of the second level and another one of the plurality of mechanisms is a retractable claw member configured to be mounted on the structure in a plurality of locations and another one of the plurality of mechanisms is a platform rotationally mounted to a pole member secured to the structure, wherein the platform is configured for movement between a first position wherein an edge of the platform is adjacent to a roof of the second level and a second position wherein another edge of the platform is adjacent to the first level and wherein the platform moves vertically with respect to the pole member as it rotates about the pole member from the first position to the second position.

16. A playset comprising:

a structure having a first side resembling a façade and a second side opposite the first side wherein objects can be inserted behind the façade, the structure further comprising a first level and a second level, the second level being located above the first level;

a mechanism secured to the structure for moving an object from the first level to the second level; and a collapsible third level located below the first level, the collapsible third level being configured for movement between a contracted position and an expanded position with respect to the first level, wherein the first level is configured to support the structure on an edge of an elevated surface such that collapsible third level is capable of being moved into the expanded position.

17. The play set as in claim 16, wherein the mechanism is plurality of mechanisms and one of the plurality of mechanisms is a platform pivotally secured to the structure for movement between a first position wherein an edge of the platform is adjacent to the first level and a second position wherein another edge of the platform is adjacent to the second level and another one of the plurality of mechanisms is an elevator movably secured to the structure for movement between a first position wherein a floor of the elevator is flush with a floor of the first level and a second position wherein the floor of the elevator is flush with a floor of the second level and another one of the plurality of mechanisms is a retractable claw member configured to be mounted on the structure in a plurality of locations and another one of the plurality of mechanisms is a platform rotationally mounted to a pole member secured to the structure, wherein the platform is configured for movement between a first position wherein an edge of the platform is adjacent to a roof of the first level and a second position wherein another edge of the platform is adjacent to the first level and wherein the platform moves vertically with respect to the pole member as it rotates about the pole member from the first position to the second position.

18. The play set as in claim 17, wherein the third level moves to the expanded position when an actuation button located on the first level is manipulated and the playset further comprises a ramp member that automatically extends from the first level to the third level when the third level moves to the expanded position through manipulation of the actuation button.

19. The play set as in claim 18, wherein the playset further comprises an extendable platform that rotates from the third level when the third level is in the expanded position and wherein the playset further comprises a ramp member that is pivotally mounted to only the third level at one end and is configured for movement between a first position wherein the ramp member is flush with a floor of the third level and a second position wherein a portion of the ramp member is located below the floor of the third level.

* * * * *